US011572659B2

(12) United States Patent
Phipps et al.

(10) Patent No.: US 11,572,659 B2
(45) **Date of Patent: *Feb. 7, 2023**

(54) COMPOSITIONS COMPRISING MICROFIBRILLATED CELLULOSE AND POLYMERS AND METHODS OF MANUFACTURING FIBRES AND NONWOVEN MATERIALS THEREFROM

(71) Applicant: FiberLean Technologies Limited, Par (GB)

(72) Inventors: Jonathan Stuart Phipps, Gorran Haven (GB); Sean Ireland, Hampden, ME (US); David Skuse, Truro (GB)

(73) Assignee: FiberLean Technologies Limited, Par (GB)

( * ) Notice: Subject to any disclaimer, the term of this patent is extended or adjusted under 35 U.S.C. 154(b) by 1 day.

This patent is subject to a terminal disclaimer.

(21) Appl. No.: 17/007,836

(22) Filed: Aug. 31, 2020

(65) Prior Publication Data

US 2020/0399832 A1 Dec. 24, 2020

Related U.S. Application Data

(63) Continuation of application No. 15/494,005, filed on Apr. 21, 2017, now Pat. No. 10,794,006.

(Continued)

(51) Int. Cl.
*D01F 2/00* (2006.01)
*D04H 3/16* (2006.01)

(Continued)

(52) U.S. Cl.
CPC ..... *D21H 11/18* (2013.01); *D01D 1/02* (2013.01); *D01D 5/08* (2013.01); *D01F 1/10* (2013.01); *D01F 2/00* (2013.01); *D04H 1/4258* (2013.01); *D04H 1/492* (2013.01); *D04H 1/54* (2013.01); *D04H 1/724* (2013.01); *D04H 3/08* (2013.01);

(Continued)

(58) Field of Classification Search
None
See application file for complete search history.

(56) References Cited

U.S. PATENT DOCUMENTS 2,006,209 A 6/1935 Bradner
3,075,710 A 1/1963 Feld et al.

(Continued)

FOREIGN PATENT DOCUMENTS

AU 2010247184 B2 1/2013
BE 1006908 A3 1/1995

(Continued)

OTHER PUBLICATIONS

Korean Notice of Office Action dated Oct. 8, 2020 for Korean Application No. 10-2020-7027604, 13 pages.

(Continued)

*Primary Examiner* — Shawn Mckinnon
(74) *Attorney, Agent, or Firm* — Raymond G. Arner; Pierce Atwood LLP

(57) ABSTRACT

Fibres and nonwoven materials comprising microfibrillated cellulose, and optionally inorganic particulate material and/or additional additives, and optionally a water soluble or dispersible polymer. Nonwoven materials made from fibres comprising microfibrillated cellulose, and optionally inorganic particulate material and/or a water soluble or dispersible polymer.

19 Claims, 10 Drawing Sheets

Related U.S. Application Data

(60) Provisional application No. 62/326,180, filed on Apr. 22, 2016.

(51) Int. Cl.

| | |
|---|---|
| ***D01D 1/02*** | (2006.01) |
| ***D01D 5/08*** | (2006.01) |
| ***D04H 1/4258*** | (2012.01) |
| ***D04H 1/492*** | (2012.01) |
| ***D04H 1/54*** | (2012.01) |
| ***D04H 1/724*** | (2012.01) |
| ***D21B 1/30*** | (2006.01) |
| ***D21H 11/18*** | (2006.01) |
| ***D01F 1/10*** | (2006.01) |
| ***D04H 3/08*** | (2006.01) |
| *D01D 5/098* | (2006.01) |

(52) U.S. Cl.
CPC ..... *D04H 3/16* (2013.01); *D21B 1/30* (2013.01); *D01D 5/0985* (2013.01)

(56) References Cited

U.S. PATENT DOCUMENTS 3,765,921 A 10/1973 Puskar
3,794,558 A 2/1974 Back
3,820,548 A 6/1974 Buchmann et al.
3,921,581 A 11/1975 Brewer
4,026,762 A 5/1977 Bauman
4,087,317 A 5/1978 Roberts
4,167,548 A 9/1979 Arduini et al.
4,229,250 A 10/1980 Lehtinen
4,275,084 A 6/1981 Ohyabu et al.
4,285,842 A 8/1981 Herr
4,318,959 A 3/1982 Evans et al.
4,341,807 A 7/1982 Turbak et al.
4,356,060 A 10/1982 Neckermann et al.
4,374,702 A 2/1983 Turbak et al.
4,378,381 A 3/1983 Turbak et al.
4,452,721 A 6/1984 Turbak et al.
4,452,722 A 6/1984 Turbak et al.
4,460,737 A 7/1984 Evans et al.
4,464,287 A 8/1984 Turbak et al.
4,474,949 A 10/1984 Chatterjee et al.
4,481,076 A 11/1984 Herrick
4,481,077 A 11/1984 Herrick
4,487,634 A 12/1984 Turbak et al.
4,500,546 A 2/1985 Turbak et al.
4,510,020 A 4/1985 Green et al.
4,705,712 A 11/1987 Cashaw et al.
4,744,987 A 5/1988 Mehra et al.
4,761,203 A 8/1988 Vinson
4,820,813 A 4/1989 Schulz
4,889,594 A 12/1989 Gavelin
4,952,278 A 8/1990 Gregory et al.
5,009,886 A 4/1991 Ahmad et al.
5,098,520 A 3/1992 Begala
5,104,411 A 4/1992 Makoui et al.
5,123,962 A 6/1992 Komuro et al.
5,223,090 A 6/1993 Klungness et al.
5,225,041 A 7/1993 Richard et al.
5,227,024 A 7/1993 Gomez
5,228,900 A 7/1993 Stephens et al.
5,240,561 A 8/1993 Kaliski
5,244,542 A 9/1993 Bown et al.
5,269,470 A 12/1993 Ishikawa et al.
5,274,199 A 12/1993 Uryu et al.
5,279,663 A 1/1994 Kaliski
5,312,484 A 5/1994 Kaliski
5,316,621 A 5/1994 Kitao et al.
5,385,640 A 1/1995 Weibel et al.
5,443,902 A 8/1995 Knox et al.
5,576,617 A 11/1996 Webb et al.
5,731,080 A 3/1998 Cousin et al.
5,817,381 A 10/1998 Chen et al.
5,837,376 A 11/1998 Knox et al.
5,840,320 A 11/1998 Odom
5,964,983 A 10/1999 Dinand et al.
6,037,380 A 3/2000 Venables et al.
6,074,524 A 6/2000 Wu et al.
6,083,582 A 7/2000 Chen et al.
6,102,946 A 8/2000 Nigam
6,117,305 A 9/2000 Bando et al.
6,117,474 A 9/2000 Kamada et al.
6,117,545 A 9/2000 Cavaille et al.
6,117,804 A 9/2000 Cho
6,132,558 A 10/2000 Dyllick-Brenzinger et al.
6,156,118 A 12/2000 Silenius
6,159,335 A 12/2000 Owens et al.
6,183,596 B1 2/2001 Matsuda et al.
6,202,946 B1 3/2001 Virtanen
6,214,163 B1 4/2001 Matsuda et al.
6,235,150 B1 5/2001 Middleton et al.
6,235,392 B1 5/2001 Luo et al.
6,306,334 B1 10/2001 Luo et al.
6,312,669 B1 11/2001 Cantiani et al.
6,339,898 B1 1/2002 Toye
6,379,594 B1 4/2002 Döpfner et al.
6,436,232 B1 8/2002 Silenius et al.
6,579,410 B1 6/2003 Bleakley et al.
6,604,698 B2 8/2003 Verhoff et al.
6,647,662 B2 11/2003 Toye
6,669,882 B2 12/2003 Seok
6,726,807 B1 4/2004 Mathur
6,787,497 B2 9/2004 Dellve et al.
6,861,081 B2 3/2005 Weibel
7,022,756 B2 4/2006 Singer
7,048,900 B2 5/2006 Mathur et al.
7,083,703 B2 8/2006 Aho et al.
7,169,258 B2 1/2007 Rheims et al.
7,179,347 B2 2/2007 Rheims et al.
7,285,182 B2 10/2007 Mason et al.
7,381,294 B2 6/2008 Suzuki et al.
7,459,493 B2 12/2008 Singer
7,462,232 B2 12/2008 Tuason et al.
7,594,619 B2 9/2009 Ghere, Jr. et al.
7,726,592 B2 6/2010 Fernandez et al.
7,790,276 B2 9/2010 Kanakarajan
7,799,358 B2 9/2010 Weibel
8,012,312 B2 9/2011 Goto et al.
8,728,273 B2 5/2014 Heiskanen et al.
9,322,117 B2 4/2016 Salmela et al.
2001/0011516 A1 8/2001 Cantiani et al.
2002/0031592 A1 3/2002 Weibel
2002/0059886 A1 5/2002 Merkley et al.
2002/0081362 A1 6/2002 Weibel
2002/0198293 A1 12/2002 Craun et al.
2003/0051841 A1 3/2003 Mathur et al.
2003/0094252 A1 5/2003 Sundar et al.
2003/0114641 A1 6/2003 Kelly et al.
2004/0108081 A1 6/2004 Hughes
2004/0146605 A1 7/2004 Weibel
2004/0149403 A1 8/2004 Rheims et al.
2004/0168782 A1 9/2004 Silenius et al.
2004/0168783 A1 9/2004 Munchow
2004/0173329 A1 9/2004 Silenius et al.
2005/0000665 A1 1/2005 Doelle
2005/0045288 A1 3/2005 Riou
2005/0051054 A1 3/2005 White et al.
2005/0089601 A1 4/2005 Weibel
2005/0103459 A1 5/2005 Mathur
2005/0133643 A1 6/2005 Fernandez et al.
2005/0194477 A1 9/2005 Suzuki
2005/0256262 A1 11/2005 Hill et al.
2006/0078647 A1 4/2006 Weibel
2006/0201646 A1 9/2006 Gussinyer Canadell
2006/0266485 A1 11/2006 Knox et al.
2006/0280839 A1 12/2006 Weibel
2006/0289132 A1 12/2006 Heijnesson-Hulten
2007/0062009 A1 3/2007 Ghere, Jr. et al.
2007/0131361 A1 6/2007 Doelle et al.
2007/0148365 A1 6/2007 Knox et al.
2007/0224419 A1 9/2007 Sumnicht et al.

(56) References Cited

U.S. PATENT DOCUMENTS

| | | | |
|---|---|---|---|
| 2007/0226919 | A1 | 10/2007 | Mheidle |
| 2007/0231568 | A1 | 10/2007 | Kanakarajan |
| 2007/0272376 | A1 | 11/2007 | Maijala et al. |
| 2008/0023161 | A1 | 1/2008 | Gather |
| 2008/0057307 | A1 | 3/2008 | Koslow et al. |
| 2008/0060774 | A1 | 3/2008 | Zuraw et al. |
| 2008/0146701 | A1 | 6/2008 | Sain et al. |
| 2008/0210391 | A1 | 9/2008 | Pfalzer et al. |
| 2008/0265222 | A1 | 10/2008 | Ozersky et al. |
| 2009/0020139 | A1 | 1/2009 | Sumnicht et al. |
| 2009/0020248 | A1 | 1/2009 | Sumnicht et al. |
| 2009/0065164 | A1 | 3/2009 | Goto et al. |
| 2009/0084874 | A1 | 4/2009 | Alam et al. |
| 2009/0221812 | A1 | 9/2009 | Ankerfors et al. |
| 2010/0059191 | A1 | 3/2010 | Garcia Melgarejo et al. |
| 2010/0132901 | A1 | 6/2010 | Wild |
| 2010/0139527 | A1 | 6/2010 | Fernandez-Garcia |
| 2010/0212850 | A1 | 8/2010 | Sumnicht et al. |
| 2011/0088860 | A1 | 4/2011 | Heijnesson-Hulten et al. |
| 2011/0114765 | A1 | 5/2011 | Brady et al. |
| 2014/0121622 | A1 | 5/2014 | Jackson et al. |
| 2014/0331893 | A1 | 11/2014 | Salmela et al. |
| 2016/0160399 | A1 | 6/2016 | Salmela et al. |
| 2017/0356102 | A1 | 12/2017 | Shen et al. |
| 2018/0112335 | A1 | 4/2018 | Liukkonen et al. |
| 2018/0119315 | A1 | 5/2018 | Liukkonen et al. |

FOREIGN PATENT DOCUMENTS

| | | | |
|---|---|---|---|
| CA | 1096676 | A | 3/1981 |
| CA | 1149219 | A | 7/1983 |
| CA | 1162819 | A | 2/1984 |
| CA | 2292587 | A1 | 12/1998 |
| CA | 2093545 | C | 3/2001 |
| CA | 2437616 | A1 | 2/2005 |
| CA | 2750082 | A1 | 8/2010 |
| CH | 648071 | A5 | 2/1985 |
| CN | 1173904 | A | 2/1998 |
| CN | 1278830 | A | 1/2001 |
| CN | 1086189 | C | 6/2002 |
| CN | 1585839 | A | 2/2005 |
| CN | 1325725 | C | 7/2007 |
| CN | 105332306 | A | 2/2016 |
| DK | 175143 | B1 | 6/2004 |
| EP | 0039628 | A1 | 11/1981 |
| EP | 0051230 | A1 | 5/1982 |
| EP | 0273745 | B1 | 2/1991 |
| EP | 0442183 | A1 | 8/1991 |
| EP | 0492600 | A1 | 7/1992 |
| EP | 0499578 | A1 | 8/1992 |
| EP | 0579171 | A1 | 1/1994 |
| EP | 0619140 | A2 | 10/1994 |
| EP | 0785307 | A2 | 7/1997 |
| EP | 0790135 | A2 | 8/1997 |
| EP | 0614948 | B1 | 8/1999 |
| EP | 0988322 | B1 | 1/2002 |
| EP | 1053213 | B1 | 5/2002 |
| EP | 1469126 | A1 | 10/2004 |
| EP | 1538257 | A1 | 6/2005 |
| EP | 1936032 | A1 | 6/2008 |
| EP | 2196579 | A1 | 6/2010 |
| EP | 2216345 | A1 | 8/2010 |
| EP | 2236545 | A1 | 10/2010 |
| EP | 2236664 | A1 | 10/2010 |
| EP | 2753738 | B1 | 11/2016 |
| EP | 3162931 | A1 | 5/2017 |
| ES | 2100781 | A1 | 6/1997 |
| FR | 2689530 | A1 | 10/1993 |
| FR | 2774702 | A1 | 8/1999 |
| GB | 663621 | A | 12/1951 |
| GB | 2260146 | A | 4/1993 |
| GB | 2265916 | A | 10/1993 |
| GB | 2275876 | A | 9/1994 |
| JP | S59132926 | A | 7/1984 |
| JP | 1156587 | A | 6/1989 |
| JP | H 05-098589 | A | 4/1993 |
| JP | 6158585 | A | 6/1994 |
| JP | H08-81896 | A | 3/1996 |
| JP | 2528487 | B2 | 8/1996 |
| JP | 8-284090 | A | 10/1996 |
| JP | 9-124702 | A | 5/1997 |
| JP | H09124702 | A | 5/1997 |
| JP | 10158303 | A | 6/1998 |
| JP | 2-976485 | B2 | 11/1999 |
| JP | 2004-231796 | A | 8/2004 |
| JP | 2004-523676 | A | 8/2004 |
| JP | 2006-008857 | A | 1/2006 |
| JP | 2007-262594 | A | 10/2007 |
| JP | 2008-169497 | A | 7/2008 |
| JP | 2009-161613 | A | 7/2009 |
| JP | 2009-243014 | A | 10/2009 |
| JP | 2009-263854 | A | 11/2009 |
| JP | 2010-503775 | A | 2/2010 |
| JP | 2010-513741 | A | 4/2010 |
| JP | 2010-168716 | A | 8/2010 |
| JP | 2012-514137 | | 6/2012 |
| JP | 2012-522145 | A | 9/2012 |
| JP | 2013-527333 | A | 6/2013 |
| JP | 2014-503696 | A | 2/2014 |
| JP | 2014-510845 | | 5/2014 |
| JP | 5572169 | B2 | 7/2014 |
| JP | 2015-508112 | | 3/2015 |
| KR | 10-2009-0109532 | A | 10/2009 |
| KR | 10-2011-0091025 | | 8/2011 |
| KR | 10-2015-0080514 | | 7/2015 |
| NL | 8102857 | A | 1/1983 |
| SU | 499366 | A1 | 1/1977 |
| TW | 201013017 | A1 | 4/2010 |
| WO | 93/01333 | A1 | 1/1993 |
| WO | 93/15270 | A1 | 8/1993 |
| WO | 94/04745 | A1 | 3/1994 |
| WO | 97/18897 | A2 | 5/1997 |
| WO | 98/55693 | A1 | 12/1998 |
| WO | 98/56826 | A1 | 12/1998 |
| WO | 99/54045 | A1 | 10/1999 |
| WO | 00/66510 | A1 | 11/2000 |
| WO | 01/66600 | A1 | 9/2001 |
| WO | 01/98231 | A1 | 12/2001 |
| WO | 02/086238 | A1 | 10/2002 |
| WO | 02/100955 | A1 | 12/2002 |
| WO | 03/033815 | A2 | 4/2003 |
| WO | 03/044250 | A1 | 5/2003 |
| WO | 2004/016852 | A2 | 2/2004 |
| WO | 2004/055267 | A1 | 7/2004 |
| WO | 2005/014934 | A2 | 2/2005 |
| WO | 2005/100489 | A1 | 10/2005 |
| WO | 2005/123840 | A1 | 12/2005 |
| WO | 2006/009502 | A1 | 1/2006 |
| WO | 2007/088974 | A1 | 8/2007 |
| WO | 2007/091942 | A1 | 8/2007 |
| WO | 2007/096180 | A2 | 8/2007 |
| WO | 2007/110639 | A1 | 10/2007 |
| WO | 2008/033283 | A1 | 3/2008 |
| WO | 2008/076056 | A1 | 6/2008 |
| WO | 2008/076071 | A1 | 6/2008 |
| WO | 2008/095764 | A1 | 8/2008 |
| WO | 2008/132228 | A1 | 11/2008 |
| WO | 2009/074491 | A1 | 6/2009 |
| WO | 2009/122982 | A1 | 10/2009 |
| WO | 2009/126106 | A1 | 10/2009 |
| WO | 2010/015726 | A1 | 2/2010 |
| WO | 2010/092239 | A1 | 8/2010 |
| WO | 2010/102802 | A1 | 9/2010 |
| WO | 2010/112519 | A1 | 10/2010 |
| WO | 2010/113805 | A1 | 10/2010 |
| WO | 2010/115785 | A1 | 10/2010 |
| WO | 2010/125247 | A2 | 11/2010 |
| WO | 2010/131016 | A2 | 11/2010 |
| WO | 2010131016 | A2 | 11/2010 |
| WO | 2011/004300 | A1 | 1/2011 |
| WO | 2011/004301 | A1 | 1/2011 |
| WO | 2011/064441 | A1 | 6/2011 |
| WO | 2011/134939 | A1 | 11/2011 |
| WO | 2011/141877 | A1 | 11/2011 |

(56) References Cited

FOREIGN PATENT DOCUMENTS

| | | | |
|---|---|---|---|
| WO | 2012/066308 | A2 | 5/2012 |
| WO | 2012/098296 | A2 | 7/2012 |
| WO | 2013/034814 | A1 | 3/2013 |
| WO | 2013/117823 | A1 | 8/2013 |
| WO | 2014/068441 | | 5/2014 |
| WO | 2014/068441 | A1 | 5/2014 |
| WO | 2014/091212 | A1 | 6/2014 |
| WO | 2016/102782 | A1 | 6/2016 |
| WO | 2016/174306 | A1 | 11/2016 |
| WO | 2016/174307 | A1 | 11/2016 |
| WO | 2017/182877 | A1 | 10/2017 |

OTHER PUBLICATIONS

Chinese Notice of First Office Action dated Aug. 28, 2020 for Chinese Application No. 201780025077.6, 28 pages.
Australian Examination Report No. 1, dated Jul. 13, 2020 for Australian Application No. 2019279967, 3 pages.
International Search Report dated Jul. 26, 2017 for International Publication No. WO2017/0182877, 15 pages.
Japanese Official Communication dated Apr. 20, 2021 for Japanese Application No. 2018-548136, 8 pages.
Brazil Official Communication dated May 20, 2021 for Brazil Application No. BR1120180708461, 9 pages.
Fortunato et al, "Reinforcement of Polymeric Submicrometer-sized Fibers by Microfibrillated Cellulose", MacroMolecular Materials and Enginnering, (May 10, 2012), vol. 297, No. 6, doi:10. 1002/mame.201100408, ISSN 1438-7492, pp. 576-584, XP055029763.
Iwamoto et al, "Structure and Mechanical Properties of Wet-Spun Fibers Made From Natural Cellulose Nanofibers", BioMacromolecules, (Feb. 8, 2011), vol. 12, No. 3, doi:10.1021/bm101510r, ISSN 1525-7797, pp. 831-836, XP055027905.
Siro et al, "Microfibrillated Cellulose and New Nanocomposite Materials: A Review", Cellulose, (Feb. 21, 2010), vol. 17, No. 3, doi:10.1007/s10570-010-9405-y, ISSN 0969-0239, pp. 459-494, XP055068118.
Abe, et al. "Obtaining Cellulose Nanofibers with a Uniform Width of 15 nm from Wood, Biomacromolecules, vol. 8, Width of 15 nm from Wood", Biomacromolecules, vol. 8, 2007, pp. 3276-3278.
Ahola, Susanna, "Properties and Interfacial Behaviour of Cellulose Nanofibrils." Doctoral Thesis, 2008, 82 pages.
Ankerfors, et al. "NanoCellulose Developments in Scandinavia", Paper and Coating Chemistry Symposium (PCCS), Jun. 2009, Hamilton, Canada, 43 pages.
Ankerfors, Mikael, "The manufacture of microfibrillated cellolose (MFC) its applications", Nanostructured cellulose and new cellulose derivatives seminar, Nov. 2006, pp. 1-40.
ATREX G-Series, Megatrex, "Technology for Reject Treatment and Recovery", 2 pages.
Berglund, et al. "Nanostructured Cellulose Products", Finnish-Swedish Wood Material Science Research Programme Opening Seminar, 2004, Helsinki, Finland, 28 pages.
Bhatnagar, et al. "Processing of Cellulose Nanofiber-reinforced Composites", Journal of Reinforced Plastics and Composites, vol. 24, No. 12, 2005, pp. 1259-1268.
Characterisation Newsi Ftter, "Microfibrillated Cellulose", No. 5, Jan. 2009, pp. 1-2.
Chinga-Carrasco and Syverud, "Computer-Assisted Quantification of the Muli-Scale Structure of Films Made of Nanofibrillated Cellulose," J Nanopart Res (2010) 12:841-851.
Crofton et al., "Dielectric Studies of Cellulose and its Derivatives: 1. Acetylation of Cellulose," Polymer (1982) 23:1605-1608.
Eichhorn, et al., "Review: Current International Research into Cellulose Nanofibres and Nanocomposites," Journal of Materials Science, vol. 45, No. 1, (2010) pp. 1-33.
Esau, Katherine, "Chapter 4, Cell Wall," Anatomy of Seed Plants, 2nd Edition, (1977) pp. 43-48.
Eriksen et al., "The Use of Microfibrillated Cellulose Produced from Kraft Pulp as Strength Enhancer in TMP Paper," Nordic Pulp and Paper Research Journal, vol. 23, No. 3, (2008) pp. 299-304.
Fahn, A., "Plant Anatomy Fourth Edition," (1990) pp. 32-39.
Fengel et al., "Chapter 4. Cellulose," Wood Chemistry, Ultrastructure, Reactions, (1983) pp. 66-105.
Fengel, D., "Ideas on the Ultrastructure Organization of the Cell Wall Components," J. Polymer Sci.: Part C, No. 36 (1971) pp. 383-392.
Frey-Wyssling and Mühlethaler, "The Fine Structure of Cellulose." Fortschritte der Chemie Organischer Naturstoffe(1951) pp. 1-27.
Fukui, Yoshitaka, "Microfibrillated Cellulose", vol. 60, No. 24, 1985, pp. 5-12.
GL&V, Pulp and Paper Division, The Atrex System at M-real Hallein Paper Mill in Austria, "Atrex is running well and saving us money!", 4 pages.
Handbook of Pulp, Edited by Herbert Sixta, Wiley-VCH (2006), pp. 41-42—XP007918817.
Henriksson, Marielle, "Cellulose Nanofibril Networks and Composites, Preparation, Structure and Properties," KTH Chemical Science and Engineering, 2008, 60 pages.
Henriksson, et al., "Cellulose Nanopaper Structures of High Toughness," Biomacromolecules, vol. 9 (2008) pp. 1579-1585.
Hentze, Hans-Peter, "From Nanocellulose Science Towards Applications," VTT—Technical Research Center of Finland, Pul Paper 2010, Jun. 2010, Helsinki, pp. 1-24.
Subramanian, Ramjee, "Engineering Fine Paper by Utilizing the Structural Elements of the Raw Materials," TKK Reports in Department of Forest Products Technology, Series A1 Espoo 2008, Abstract 3 pages, retrieved from http://lib.tkk.fi/Diss/2008/isbn9789512295234/. http://puu.tkk.fi/em/research/research_groups/chemical_pupling_and_wood_refinery/seminar_presentations/43 knuts_100609_1aitoksen_sisainen_seminaariesitys.pdf;Knuts, M.SC. Aaro, "Process installation and optimization to D refine and produce NFC materials." pp. 1-9, 2010.
Hubbe et al. "What Happens to Cellulosic Fibers During Papermaking and Recycling? A Review", BioResources, vol. 2, No. 4, 2007, pp. 739-788.
Hubbe et al., "Cellulosic Nanocomposites: A Review," BioResources vol. 3, No. 3 (2008), pp. 929-980.
Hult et al., "Cellulose Fibril Aggregation—An Inherent Property of Kraft Pulps," Polymer 42 (2001) pp. 3309-3314.
Husband et al., "The Influence of Kaolin Shape Factor on the Stiffness of Coated Papers," TAPPI Journal (2009) pp. 12-17.
Husband et al., "The Influence of Pigment Particle Shape on the In-Plane Tensile Strength Properties of Kaolin-Based Coating Layers," TAPPI Journal, vol. 5 No. 12 (2006) pp. 3-8.
Innventia, "Processes for Nano cellulose," http://www.innventia.com/templates/STFIPage_ 9108.aspx, 2011, 1 page.
Iwamoto, et al., "Nano-Fibrillation of Pulp Fibers for the Processing of Transparent Nanocomposites," Applied Physics A, vol. 89 (2007) pp. 461-466.
Iwamoto, et al., "Optically Transparent Composites Reinforced with Plant Fiber-Based Nanofibers," Applied Physics A, vol. 81 (2005) pp. 1109-1112.
Janardhnan and Sain, "Isolation of Cellulose Microfibrils—An Enzymatic Approach," BioResources, vol. 1, No. 2 (2006) pp. 176-188.
Kang, Taegeun, "Role of External Fibrillation in Pulp and Paper Properties," Doctoral Thesis, Helsinki University of Technology, Laboratory of Paper and Printing Technology Reports, Series A28, Espoo 2007, 50 pages.
Klemm, et al., "Nanocelluloses as Innovative Polymers in Research and Application," Adv. Polymer Science, vol. 205 (2006) pp. 49-96.
Klungness, et al. "Fiber-Loading: A Progress Report", TAPPI Proceedings, 1994 Recycling Symposium, pp. 283-290.
"Paper Coating Pigments," TAPPI Mongraph Series No. 30, 1966, pp. 34-35.
Littunen, Kuisma, "Free Radical Graft Copolymerization of Microfibrillated Cellulose," Master's Thesis, Helsinki University of Technology, Sep. 2009, 83 pages.

(56) References Cited

OTHER PUBLICATIONS

Ioelovich and Figovsky, "Structure and Properties of Nanoparticles Used in Paper Compositions," Mechanics of Composite Materials, vol. 46, No. 4, 2010, pp. 435-442.
Ioelovich, Michael, "Cellulose as a Nanostructured Polymer: A Short Review," BioResources, vol. 3, No. 4 (2008) pp. 1403-1418.
Ioelovich, Michael, "Structure and Properties of Nano-Particles Used in Paper Compositions," XXI TECNICELPA Conference and Exhibition/VI CIADICYP 2010, Portugal, 7 pages.
Luukkanen, Lauri, "Reducing of Paper Porosity and Roughness Through Layered Structure", Aalto University School of Science and Technology, Master's thesis for the degree of Master of Science in Technology, Espoo, May 2010, 132 pages.
Mill (grinding) http://en_wikipedia.org/w/index.php?title-File:Hammer_mill_open-_front_full.jgp, 8 pgs.
Mathur, V. "GRI's Fibrous Filler Technology Presentation to TAPPI", Philadelphia, PA (slides only), (2005) pp. 1-10.
McGinnis and Shafizadeh, "Chapter 1 Cellulose and Hemicellulose," Pulp and Paper: Chemistry and Chemical Technology, (1980) pp. 1-38.
McGraw-Hill, "Cell Walls (Plant)," Encyclopedia of Science and Technology, 5th edition, (1982), pp. 737-741.
Mori, et al., "Effect of Cellulose Nano-Fiber on Calcium Carbonate Crystal Form," Polymer Preprints, Japan, vol. 56, No. 2 (2007) 1 page.
Mörseburg and Chinga-Carrasco, "Assessing the Combined Benefits of Clay and Nanofibrillated Cellulose in Layered TMP-Based Sheets," Cellulose, vol. 16, (2009) pp. 795-806.
Nakagaito and Yano, "The Effect of Fiber Content on the Mechanical and Thermal Expansion Properties of Biocomposites Based on Microfibrillated Cellulose," Cellulose, vol. 15 (2008) pp. 555-559.
Optifiner™ DF Deflakers, "Improved quality through effective deflaking." Stock Preparation and Recycled Fiber Systems, Metso Paper, (2006) 4 pages.
Pääkko et al., "Enzymatic Hydrolysis Combined with Mechanical Shearing and High-Pressure Homogenization for Nanoscale Cellulose Fibrils and Strong Gels," Biomacromolecules, vol. 8 (2007) pp. 1934-1941.
Peltola, Maarit, "Preparation of Microfibrillated Cellulose" Master of Science Thesis, Tampere University of Technology, May 2009, 98 pages.
Pöhler, Tiina & Lappalainen, Timo & Tammelin, Tekla & Eronen, Paula & Hiekkataipale, Panu & Vehniäinen, Annikki & M. Koskinen, Timo. (2011). "Influence of fibrillation method on the character of nanofibrillated cellulose (NFC)," 2010 TAPPI International Conference on Nanotechnology for the Forest Product Industry, Dipoli Congress Centre, Espoo, Finland, Sep. 27-29, 2010, 22 pages.
Porubská, et al., "Homo- and Heteroflocculation of Papermaking Fines and Fillers," Colloids and Surfaces A: Physiochem. Eng. Aspects, Elsevier Science, vol. 210 (2002) pp. 223-230.
Preparation and Application of Cellulose Nano Fiber, pp. 14-22.
Roberts, J.C., "Chapter 2, The Material of Paper," The Chemistry of Paper, RSC Paperbacks, 1996, pp. 11-25.
Roberts, J.C., "Chapter 4, The Material of Paper," The Chemistry of Paper, RSC Paperbacks, 1996, pp. 52-68.
Rowland and Roberts, "The Nature of Accessible Surfaces in the Microstructure of Cotton Cellulose," Journal of Polymer Science: Part A-1, vol. 10, (1972) pp. 2447-2461.
Saito et al., "Homogeneous Suspensions of Individualized Microfibrils from TEMPO-Catalyzed Oxidation of Native Cellulose," Biomacromolecules, American Chemical Society, vol. 7, No. 6 (2006) pp. 1687-1691.
Saito et al., "Cellulose Nanofibers Prepared by TEMPO-Mediated Oxidation of Native Cellulose," Biomacromolecules, (2007) 8:2485-2491.
Selder, H.; Mannes, W., and Matzke, W., "Broke systems for LWC, MWC and HWC Papers", Voith Sulzer Paper Technology, 8 pages, Dec. 2011.
Silenius, Petri, "Improving the Combinations of Critical Properties and Process Parameters of Printing and Writing Papers and Paperboards by New Paper-Filling Methods", Helsinki University of Technology Laboratory of Paper Technology Reports, Series A 14, Espoo 2002, 168 pages.
Sinnott et al., "Slurry Flow in a Tower Mill," Seventh International Conference on CFD in the Minerals and Process Industries, CSIRO, Melbourne, Australia, Dec. 9-11, 2009, pp. 1-7.
Siró, István, "Microfibrillated Cellulose and New Nanocomposite Materials: A Review," Cellulose, vol. 17 (2010) pp. 459-494.
Somboon et al., "Grit Segments in TMP Refining. Part 2: Potential for Energy Reduction," Appita Journal, vol. 62, No. 1 (2009) pp. 42-45 and 59.
Somboon et al., "Grit Segments in TMP Refining. Part 1: Operating Parameters and Pulp Quality," Appita Journal, vol. 62, No. 1 (2009) pp. 37-41.
Somboon, Phichit, "On the Application of Grits to Thermomechanical Pulp Refining." TKK Reports on Forest Products Technology, Series A7, Espoo 2009, 61 pages.
Spence et al., "The Effect of Chemical Composition on Microfibrillar Cellulose Films from Wood Pulps: Mechanical Processing and Physical Properties," BioResource Technology, vol. 101 (2010) pp. 5961-5968.
Subramanian et al., "Calcium Carbonate—Cellulose Fibre Composites; The Role of Pulp Refining," Paper Technology (2006) pp. 27-31.
Subramanian, Ramjee, "Engineering Fine Paper by Utilising the Structural Elements of the Raw Materials", Doctoral Thesis, TKK Reports in Department of Forest ProductsTechnology, Series A1, Espoo 2008, 65 pages.
Syverud, et al. "The influence of microfibrillated cellulose, MFC, on paper strength and surface properties", pp. 1-32.
Taniguchi, Takashi, "New Films Produced from Microfibrillated Natural Fibres," Polymer International, vol. 47 (1998) pp. 291-294.
Terao et al., "Pulp-Filler Interaction (3)—The Influence of Wet Pressing and Cellulosic Fines Addition on the Structure and Properties of Filler Loaded Papers," vol. 8 (1989) pp. 65-73.
Thorn et al., "Applications of Wet-End Paper Chemistry, Chapter 6, Fillers," Springer Science+ Business Media B.V. (2009) pp. 113-136.
Torvinen, et al. "Flexible filler-nanocellulose structures", VTT Technical Research Centre of Finland—1 page.
Waterhouse, J .F., "Whither Refining?" Institute of Paper Science and Technology, No. 649 (1997) 40 pages.
Yano, et al., "Production and use of Machine bio-nano-par φ," (2009) pp. 73-80.
Yano, Hiroyuki, "High Performance of Bio Fibers by the Addition of Filler," vol. 55, No. 4 (2009) pp. 63-68.
Product information for the Ultra-fine Friction Grinder "Supermasscolloider," 1 page, retrieved from http:www.masuko.com/English/product/Masscolloder.html (2014).
Yano, Hiroyuki, "Production and Use of Cellulose Nanofibers," Timber Financial Industrial Technology (2009) vol. 27, No. 1, pp. 14-22.
Zhao et al, "Ultrasonic Technique for Extracting Nanofibers from Nature Materials," Applied Physics Letters 90, 073112 (2007) 2 pages.
Zirconium Oxide Data sheet, downloaded online from www.stanfordmaterials.com, downloaded on Jan. 12, 2012, 7 pages.
Zirconium, Silicate Data sheet, downloaded online from www.reade.com, downloaded on Jan. 12, 2012, 2 pages.
Zou and Hsieh, "Review of Microfibrillated Cellulose (MFC) for Papermaking," Pulp and Paper Engineering, School of Chemical and Biomolecular Eng., Georgia Institute of Technology, 10 pages.
Zou, Xuejun, "Production of Nanocrystalline Cellulose and its Potential Applications in Specialty Papers", Pira Specialty Papers Conference, Nov. 2010, pp. 1-30.
Pinkney et al., "Microfibrillated Cellulose—A New Structural Material," Engineering Doctorate Conference (2012), University of Birmingham, 2 pages.
Nakagaito, Antonio Norio, Preparation of Bio Fiber and their Application, pp. 73-80.
International Preliminary Report on Patentability, Applicant's Response and Amended Claims for corresponding International Patent Application No. PCT/IB2017/000545, dated Jul. 10, 2018, 19 pages.

(56) References Cited

OTHER PUBLICATIONS

Mullite, 2001 [downloaded on-line Dec. 6, 2016], Mineral Data Publishing, 1 page.
Smook, Handbook for Pulp and Paper Technologies, 1992, Angus Wilde Publications, 2nd Edition, Chap. 13.
Grant and PPI's National Editors, "Coated-Paper Producers Look Forward to Brighter Times," Pulp and Paper International (1994) 18-31.
European Official Communication dated Feb. 13, 2020 for European Application No. 17726675.6, 5 pages.
The International Search Report and the Written Opinion of the International Searching Authority dated Jul. 26, 2017 from corresponding International Patent Application No. PCT/IB2017/000545 (15 pages).
Korean Notice of Office Action dated Jul. 29, 2019 for Korean Application No. 10-2018-7030436, 21 pages.
Fortunato et al., "Reinforcement of Polymeric Submicrometer-sized Fibers by Microfibrillated Cellulose." Macromolecular Materials and Engineering, vol. 297, No. 6, May 10, 2012, pp. 576-584, XP055029763, ISSN: 1438-7492, DOI: 10.1002/mame.201100408.
Iwamoto et al., "Structure and Mechanical Properties of Wet-Spun Fibers Made from Natural Cellulose Nanofibers." BioMacromolecules, 2011, vol. 12, No. 3, Feb. 8, 2011, pp. 831-836, XP055027095, ISSN: 1525-7797, DOI: 10.1021/bm101510r.
Siro et al., "Microfibrillated cellulose and new nanocomposite materials: a review." Cellulose vol. 17, No. 3, Feb. 21, 2010, pp. 459-494, XP055068118, ISSN: 0969-0239, DOI: 10.1007/s10570-010-9405.y.
Indian Examination Report dated Dec. 1, 2021 for Indian Application No. 201817041461, 6 pages.

COMPOSITIONS COMPRISING MICROFIBRILLATED CELLULOSE AND POLYMERS AND METHODS OF MANUFACTURING FIBRES AND NONWOVEN MATERIALS THEREFROM

CROSS REFERENCE TO RELATED APPLICATIONS

This application is a continuation of U.S. application Ser. No. 15/494,005, filed Apr. 21, 2017, which claims the benefit of U.S. Provisional Application No. 63/326,180 filed Apr. 22, 2016, the entire contents of which is incorporated herein by reference.

TECHNICAL FIELD

The present invention relates generally to compositions of, processes for manufacturing, and uses of microfibrillated cellulose in forming fibres and non-woven materials comprising such microfibrillated cellulose-containing fibres. The fibres may additionally comprise at least one inorganic particulate material that may optionally be used in the processing of the microfibrillated cellulose. The compositions of microfibrillated cellulose or microfibrillated cellulose and at least one inorganic particulate material may additionally comprise a water soluble or dispersible polymer, which compositions may also be used in forming fibres and non-woven materials comprising such fibres.

BACKGROUND OF THE INVENTION

Microfibrillated cellulose may be added to various compositions and products in order to reduce the use of another component of the composition and consequently reduce cost, which must be balanced with the physical, mechanical and/or optical requirements of the end-product. It is desirable to utilize compositions of microfibrillated cellulose and compositions comprising microfibrillated cellulose and a water soluble or dispersible polymer for use in the manufacture of fibres and non-woven materials comprising those fibres. Advantages associated with the use of microfibrillated cellulose, and, optionally inorganic particulate material, in the manufacture of fibres and nonwoven products made therefrom include higher mineral loading, higher microfibrillated cellulose loading, no substantial deterioration in elastic modulus and/or tensile strength of the fibre; improvement in elastic modulus and/or tensile strength of the fibre; improved temperature resistance, biodegradable and/or flushable and biodegradable compositions; and water-based (not solvent-based) compositions. Additional advantages associated with the use of microfibrillated cellulose, and, optionally inorganic particulate material, in the manufacture of fibres and nonwoven products made therefrom include the ability of such fibres and nonwoven materials to be composted and that the fibres and nonwoven materials come from a sustainable source.

SUMMARY OF THE INVENTION

The present invention relates generally to compositions comprising, consisting essentially of, or consisting of microfibrillated cellulose, and methods utilizing such microfibrillated cellulose compositions to manufacture fibres and nonwoven materials made from and comprising such fibres.

Microfibrillated cellulose suitable for the compositions and methods of the present invention may, for example, have a fibre steepness ranging from about 20 to about 50. The microfibrillated cellulose may, for example, be processed with a grinding material of a size greater than 0.5 mm in a grinding vessel followed by a second stage processing in a refiner, homogenizer or by sonification with an ultrasonic device resulting in microfibrillated cellulose having a median diameter ($d_{50}$) less than 100 μm, an increased percentage of material finer than 25 μm and a lower percentage of material coarser than 300 μm, by the methods of the present invention. The microfibrillated cellulose obtained or obtainable by the foregoing two-stage processing may be readily extruded through an extruder, dried by an attenuating gas, such as one or more streams of hot air, and collected as fibres. The collected fibres may be used to make various nonwoven materials, including nonwoven bonded fabrics and articles.

Microfibrillated cellulose suitable for the compositions and methods of the present invention may, for example, have a fibre steepness ranging from about 20 to about 50. The microfibrillated cellulose may, for example, be processed with a grinding material of a size greater than 0.5 mm in a grinding vessel followed by a second stage processing in a refiner, homogenizer or by sonification with an ultrasonic device resulting in microfibrillated cellulose having a median diameter ($d_{50}$) less than 100 μm, an increased percentage of material finer than 25 μm and a lower percentage of material coarser than 300 μm, by the methods of the present invention. The microfibrillated obtained or obtainable by the foregoing two-stage processing may be mixed with a water soluble or dispersible polymer and may be readily extruded through an extruder, dried by an attenuating gas, such as one or more streams of hot air, and collected as fibres. The collected fibres may be used to make various nonwoven materials, including nonwoven bonded fabrics and articles.

Similarly, the microfibrillated cellulose of the present invention may be ground (co-processed) with at least one inorganic particulate material in the presence or the absence of grinding material of a size greater than 0.5 mm in a grinding vessel followed by a second stage processing in a refiner, homogenizer or by sonification with an ultrasonic device resulting in microfibrillated cellulose having a median diameter ($d_{50}$) less than 100 μm, an increased percentage of material finer than 25 μm and a lower percentage of material coarser than 300 μm, by the methods of the present invention. The microfibrillated cellulose may exhibit higher tensile strength performance, thereby permitting such microfibrillated cellulose compositions to be readily extruded through an extruder, dried by an attenuating gas, such as one or more streams of hot air, and collected as fibres. The collected fibres may be used to make various nonwoven materials, including nonwoven bonded fabrics and articles.

The microfibrillated cellulose of the present invention may be ground (co-processed) with at least one inorganic particulate material in the presence or the absence of grinding material of a size greater than 0.5 mm in a grinding vessel followed by a second stage processing in a refiner, homogenizer or by sonification with an ultrasonic device resulting in microfibrillated cellulose having a median diameter ($d_{50}$) less than 100 μm, an increased percentage of material finer than 25 μm and a lower percentage of material coarser than 300 μm, by the methods of the present invention. The microfibrillated cellulose may exhibit higher tensile strength performance, thereby permitting such microfibrillated cellulose compositions to be readily extruded through an extruder, dried by an attenuating gas, such as one or more streams of hot air, and collected as fibres. The microfibrillated obtained or obtainable by the foregoing two-stage processing may optionally be mixed with a water soluble or dispersible polymer and may be readily extruded through a extruder, dried by an attenuating gas, such as one or more streams of hot air, and collected as fibres. The collected fibres may be used to make various nonwoven materials, including nonwoven bonded fabrics and articles.

In accordance with a first aspect of the present invention, there is provided a fibre comprising, consisting essentially of, or consisting of microfibrillated cellulose, wherein the microfibrillated cellulose has a fibre steepness ranging from about 20 to about 50; wherein the microfibrillated cellulose is obtainable by a two-stage process of (i) grinding a fibrous substrate comprising cellulose in a grinding vessel and (ii) refining in a refiner, or homogenizing in a homogenizer, or sonicating with an ultrasonic device the ground fibrous substrate comprising microfibrillated cellulose; wherein the grinding is carried out in an aqueous environment in the presence of a grinding medium; wherein the term "grinding medium" means a medium other than inorganic particulate material and wherein the grinding medium is 0.5 mm or greater in size.

In certain embodiments, the microfibrillated cellulose has a median diameter (d50) less than 100 μm.

In certain embodiments of the first aspect, the grinding vessel may be a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the first aspect, the refiner may be a single disc, conical, twin disc or plate refiner.

In certain embodiments of the first aspect, the ultrasonic device may be an ultrasonic probe, an ultrasonic water bath, an ultrasonic homogenizer, an ultrasonic foil and an ultrasonic horn.

In accordance with a second aspect of the present invention, there is provided a fibre comprising (a) a microfibrillated cellulose, wherein the microfibrillated cellulose has a fibre steepness ranging from about 20 to about 50; wherein the microfibrillated cellulose is obtainable by a two-stage process of (i) grinding a fibrous substrate comprising cellulose in a grinding vessel and (ii) refining in a refiner, or homogenizing in a homogenizer, or sonicating with an ultrasonic device the fibrous substrate comprising cellulose; wherein the grinding is carried out in an aqueous environment in the presence of a grinding medium; wherein the term "grinding medium" means a medium other than inorganic particulate material and wherein the grinding medium is 0.5 mm or greater in size; and (b) a water-soluble or dispersible polymer.

In certain embodiments, the microfibrillated cellulose has a median diameter (d50) less than 100 μm.

In certain embodiments of the second aspect, the grinding vessel may be a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the second aspect, the refiner may be a single disc, conical, twin disc or plate refiner.

In certain embodiments of the second aspect, the ultrasonic device may be an ultrasonic probe, an ultrasonic water bath, an ultrasonic homogenizer, an ultrasonic foil and an ultrasonic horn.

In certain embodiments of the second aspect, the water soluble or dispersible polymers include water soluble polymers, natural and synthetic latex, colloidal dispersions of polymer particles, emulsions, mini-emulsion, micro-emulsions or dispersion polymerization.

In accordance with a third aspect of the present invention, there is provided a fibre comprising, consisting essentially of, or consisting of microfibrillated cellulose, wherein the microfibrillated cellulose has a fibre steepness ranging from about 20 to about 50; wherein the microfibrillated cellulose is obtainable by a two-stage process of (i) grinding a fibrous substrate comprising cellulose in a grinding vessel, wherein the grinding of the fibrous substrate comprising cellulose is in the presence of at least one inorganic particulate material and (ii) refining in a refiner, or homogenizing in a homogenizer, or sonicating with an ultrasonic device the fibrous substrate comprising cellulose and at least one inorganic particulate material; wherein the grinding is carried out in an aqueous environment in the presence of a grinding medium; wherein the term "grinding medium" means a medium other than inorganic particulate material and wherein the grinding medium is 0.5 mm or greater in size.

In certain embodiments, the microfibrillated cellulose has a median diameter (d50) less than 100 μm.

In certain embodiments of the third aspect, the refiner may be a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the third aspect, the grinding vessel may be a Stirred media detritor, screened grinder, tower mill, SAM or IsaMill.

In certain embodiments of the third aspect, the ultrasonic device may be an ultrasonic probe, an ultrasonic water bath, an ultrasonic homogenizer, an ultrasonic foil and an ultrasonic horn.

In accordance with a fourth aspect of the present invention, there is provided a fibre comprising, consisting essentially of, or consisting of microfibrillated cellulose, wherein the microfibrillated cellulose has a fibre steepness ranging from about 20 to about 50; wherein the microfibrillated cellulose is obtainable by a two-stage process of (i) grinding a fibrous substrate comprising cellulose in a grinding vessel, wherein the grinding of the fibrous substrate comprising cellulose is in the presence of at least one inorganic particulate material and (ii) refining in a refiner, or homogenizing in a homogenizer, or sonicating with an ultrasonic device the fibrous substrate comprising cellulose and at least one inorganic particulate material; wherein the grinding is carried out in an aqueous environment in the absence of a grinding medium; wherein the term "grinding medium" means a medium other than inorganic particulate material and wherein the grinding medium is 0.5 mm or greater in size.

In certain embodiments, the microfibrillated cellulose has a median diameter (d50) less than 100 μm.

In certain embodiments of the fourth aspect, the refiner may be a single disc, conical, twin disc or plate refiner.

In certain embodiments of the fourth aspect, the grinding vessel may be a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the fourth aspect, the ultrasonic device may be an ultrasonic probe, an ultrasonic water bath, an ultrasonic homogenizer, an ultrasonic foil and an ultrasonic horn.

In accordance with a fifth aspect of the present invention, there is provided a fibre comprising, consisting essentially of, or consisting of: (a) microfibrillated cellulose, wherein the microfibrillated cellulose has a fibre steepness ranging from about 20 to about 50; wherein the microfibrillated cellulose is obtainable by a two-stage process of (i) grinding a fibrous substrate comprising cellulose in a grinding vessel, wherein the grinding of the fibrous substrate comprising cellulose is in the presence of at least one inorganic particulate material and (ii) refining in a refiner, or homogenizing in a homogenizer, or sonicating with an ultrasonic device the fibrous substrate comprising cellulose and at least one inorganic particulate material; wherein the grinding is carried out in an aqueous environment in the presence of a grinding medium; wherein the term "grinding medium" means a medium other than inorganic particulate material and wherein the grinding medium is 0.5 mm or greater in size; and (b) a water-soluble or dispersible polymer.

In certain embodiments, the microfibrillated cellulose has a median diameter (d50) less than 100 μm.

In certain embodiments of the fifth aspect, the refiner may be a single disc, conical, twin disc or plate refiner.

In certain embodiments of the fifth aspect, the grinding vessel may be a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the fifth aspect, the ultrasonic device may be an ultrasonic probe, an ultrasonic water bath, an ultrasonic homogenizer, an ultrasonic foil and an ultrasonic horn.

In certain embodiments of the fifth aspect, the water soluble or dispersible polymers include water soluble polymers, natural and synthetic latex, colloidal dispersions of polymer particles, emulsions, mini-emulsion, micro-emulsions or dispersion polymerization.

In accordance with a sixth aspect of the present invention, there is provided a fibre comprising, consisting essentially of, or consisting of: (a) microfibrillated cellulose, wherein the microfibrillated cellulose has a fibre steepness ranging from about 20 to about 50; wherein the microfibrillated cellulose is obtainable by a two-stage process of (i) grinding a fibrous substrate comprising cellulose in a grinding vessel, wherein the grinding of the fibrous substrate comprising cellulose is in the presence of at least one inorganic particulate material and (ii) refining in a refiner, or homogenizing in a homogenizer, or sonicating with an ultrasonic device the fibrous substrate comprising cellulose and at least one inorganic particulate material; wherein the grinding is carried out in an aqueous environment in the absence of a grinding medium; wherein the term "grinding medium" means a medium other than inorganic particulate material and wherein the grinding medium is 0.5 mm or greater in size; and (b) a water-soluble or dispersible polymer.

In certain embodiments, the microfibrillated cellulose has a median diameter (d50) less than 100 μm.

In certain embodiments of the sixth aspect, the refiner may be a single disc, conical, twin disc or plate refiner.

In certain embodiments of the sixth aspect, the grinding vessel may be a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the sixth aspect, the ultrasonic device may be an ultrasonic probe, an ultrasonic water bath, an ultrasonic homogenizer, an ultrasonic foil and an ultrasonic horn.

In certain embodiments of the sixth aspect, the water soluble or dispersible polymers include water soluble polymers, natural and synthetic latex, colloidal dispersions of polymer particles, emulsions, mini-emulsion, micro-emulsions or dispersion polymerization.

In certain embodiments of the first to sixth aspects, the grinding medium other than inorganic particulate material has a minimum size of 0.5 mm or greater. The grinding medium, when present, may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used.

In other embodiments, hardwood grinding media (e.g. woodflour) may be used.

Generally, the type of and particle size of grinding medium to be selected for use in the methods may be dependent on the properties, such as, e.g., the particle size of, and the chemical composition of, the feed suspension of material to be ground. In some embodiments, the particulate grinding medium comprises particles having an average diameter in the range of from about 0.5 mm to about 6.0 mm, or in the range of from about 0.5 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In certain embodiments of the first to sixth aspects, the microfibrillated cellulose has a fibre steepness equal to or greater than about 10, as measured by Malvern (laser light scattering, using a Malvern Mastersizer S machine as supplied by Malvern Instruments Ltd) or by other methods which give essentially the same result.

The fibrous substrate comprising cellulose may be microfibrillated in the presence of an inorganic particulate material to obtain microfibrillated cellulose having a fibre steepness equal to or greater than about 10, as measured by Malvern (laser light scattering, using a Malvern Mastersizer S machine as supplied by Malvern Instruments Ltd) or by other methods which give essentially the same result. Fibre steepness (i.e., the steepness of the particle size distribution of the fibres) is determined by the following formula:

$$\text{Steepness}=100\times(d_{30}/d_{70}).$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

In certain embodiments of the first to the sixth aspects, the microfibrillated cellulose has a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

In certain embodiments of the first to the sixth aspects, the microfibrillated cellulose has a modal fibre particle size ranging from about 0.1-500 μm.

In certain embodiments of the first to the sixth aspects, the microfibrillated cellulose has a modal fibre particle size ranging from about 0.1-500 μm and a modal inorganic particulate material particle size ranging from 0.25-20 μm.

In certain embodiments of the first to the sixth aspects, the microfibrillated cellulose in the first grinding stage is obtained or obtainable with a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the first to the sixth aspects, the microfibrillated in the second refining stage is obtained or obtainable with a single disc, conical, twin disc, or plate refiner, for example, a single disc refiner (manufactured by Sprout) having a 12 in (30 cm) single disc.

In accordance with a seventh aspect of the invention, there is provided a method for preparing a fibre comprising microfibrillated cellulose, the method comprising the steps of:

(1) preparing a composition comprising a microfibrillated cellulose,
  wherein the microfibrillated cellulose has a fibre steepness from about 20 to about 50;
  wherein the microfibrillated cellulose is obtainable by a two-stage process of (i) grinding a fibrous substrate in a grinding vessel and (ii) refining in a refiner, or homogenizing in a homogenizer, or sonicating with an ultrasonic device the ground fibrous substrate comprising cellulose;
  wherein the grinding is carried out in an aqueous environment in the presence of a grinding medium;
  wherein the term "grinding medium" means a medium other than inorganic particulate material and is 0.5 mm or greater in size;
(2) extruding the microfibrillated cellulose from step (1) through an extruder;
(3) attenuating the extruded microfibrillated cellulose with an attenuating gas, for example, hot air; and
(4) collecting the extruded fibres.

In certain embodiments, the microfibrillated cellulose has a median diameter (d50) less than 100 μm.

In accordance with an eight aspect of the invention, there is provided a method for preparing a fibre comprising microfibrillated cellulose, the method comprising the steps of:

(1) preparing a composition comprising a microfibrillated cellulose,
  wherein the microfibrillated cellulose has a fibre steepness ranging from about 20 to about 50;
  wherein the microfibrillated cellulose is obtainable by a two-stage process of (i) grinding a fibrous substrate in a grinding vessel and (ii) refining in a refiner, or homogenizing in a homogenizer, or sonicating with an ultrasonic device the ground fibrous substrate comprising cellulose;
  wherein the grinding is carried out in an aqueous environment in the presence of a grinding medium;
  wherein the term "grinding medium" means a medium other than inorganic particulate material and is 0.5 mm or greater in size;
(2) mixing the composition of microfibrillated cellulose with a polymer to faun a second mixture;
(3) extruding the second mixture through an extruder;
(4) attenuating the extruded second mixture with an attenuating gas, for example, hot air; and
(5) collecting the extruded fibres.

In certain embodiments, the microfibrillated cellulose has a median diameter (d50) less than 100 μm.

In accordance with a ninth aspect of the invention, there is provided a method for preparing a fibre comprising microfibrillated cellulose, the method comprising the steps of:

(1) preparing a composition comprising a microfibrillated cellulose,
  wherein the microfibrillated cellulose has a fibre steepness ranging from about 20 to about 50;
  wherein the microfibrillated cellulose is obtainable by a two-stage process of (i) grinding a fibrous substrate in a grinding vessel in the presence of at least one inorganic particulate material and (ii) refining in a refiner, or homogenizing in a homogenizer, or sonicating with an ultrasonic device the ground fibrous substrate comprising cellulose and at least one inorganic particulate material;
  wherein the grinding is carried out in an aqueous environment in the presence of a grinding medium;
  wherein the term "grinding medium" means a medium other than inorganic particulate material and is 0.5 mm or greater in size;
(2) extruding the microfibrillated cellulose and at least one inorganic particulate material from step (1) through an extruder;
(3) attenuating the extruded microfibrillated cellulose and at least one inorganic particulate material with an attenuating gas, for example, hot air; and
(4) collecting the extruded fibres.

In certain embodiments, the microfibrillated cellulose has a median diameter (d50) less than 100 μm.

In accordance with a tenth aspect of the invention, there is provided a method for preparing a fibre comprising microfibrillated cellulose, the method comprising the steps of:

(1) preparing a composition comprising a microfibrillated cellulose,
  wherein the microfibrillated cellulose has a fibre steepness ranging from about 20 to about 50;
  wherein the microfibrillated cellulose is obtainable by a two-stage process of (i) grinding a fibrous substrate in a grinding vessel in the presence of at least one inorganic particulate material and (ii) refining in a refiner, or homogenizing in a homogenizer, or sonicating with an ultrasonic device the ground fibrous substrate comprising cellulose and at least one inorganic particulate material;
  wherein the grinding is carried out in an aqueous environment in the absence of a grinding medium;
  wherein the term "grinding medium" means a medium other than inorganic particulate material and is 0.5 mm or greater in size;

(2) extruding the microfibrillated cellulose and at least one inorganic particulate material from step (1) through an extruder;

(3) attenuating the extruded microfibrillated cellulose and at least one inorganic particulate material with an attenuating gas, for example, hot air; and (4) collecting the extruded fibres.

In certain embodiments, the microfibrillated cellulose has a median diameter (d50) less than 100 μm.

In accordance with an eleventh aspect of the invention, there is provided a method for preparing a fibre comprising microfibrillated cellulose, the method comprising the steps of:

(1) preparing a composition comprising a microfibrillated cellulose, wherein the microfibrillated cellulose has a fibre steepness ranging from about 20 to about 50;

wherein the microfibrillated cellulose is obtainable by a two-stage process of (i) grinding a fibrous substrate in a grinding vessel is in the presence of at least one inorganic particulate material and (ii) refining in a refiner, or homogenizing in a homogenizer, or sonicating with an ultrasonic device the ground fibrous substrate comprising cellulose and at least one inorganic particulate material;

wherein the grinding is carried out in an aqueous environment in the presence of a grinding medium;

wherein the term "grinding medium" means a medium other than inorganic particulate material and is 0.5 mm or greater in size;

(2) mixing the composition of microfibrillated cellulose and at least one organic particulate material with a polymer to form a second mixture;

(3) extruding the second mixture through an extruder;

(3) attenuating the extruded second mixture with an attenuating gas, for example, hot air; and (4) collecting the extruded fibres.

In certain embodiments, the microfibrillated cellulose has a median diameter (d50) less than 100 μm.

In accordance with a twelfth aspect of the invention, there is provided a method for preparing a fibre comprising microfibrillated cellulose, the method comprising the steps of:

(1) preparing a composition comprising a microfibrillated cellulose, wherein the microfibrillated cellulose has a fibre steepness ranging from about 20 to about 50;

wherein the microfibrillated cellulose is obtainable by a two-stage process of (i) grinding a fibrous substrate in a grinding vessel is in the presence of at least one inorganic particulate material and (ii) refining in a refiner, or homogenizing in a homogenizer, or sonicating with an ultrasonic device the ground fibrous substrate comprising cellulose and at least one inorganic particulate material;

wherein the grinding is carried out in an aqueous environment in the absence of a grinding medium;

wherein the term "grinding medium" means a medium other than inorganic particulate material and is 0.5 mm or greater in size;

(2) mixing the composition of microfibrillated cellulose and at least one inorganic particulate material with a polymer to form a second mixture;

(3) extruding the second mixture through an extruder;

(4) attenuating the extruded second mixture with an attenuating gas, for example, hot air; and (4) collecting the extruded fibres.

In certain embodiments, the microfibrillated cellulose has a median diameter (d50) less than 100 μm.

In certain embodiments of the seventh to the twelfth aspects, the grinding medium other than inorganic particulate material has a minimum size of 0.5 mm or greater. The grinding medium, when present, may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used.

In other embodiments, hardwood grinding media (e.g. woodflour) may be used.

Generally, the type of and particle size of grinding medium to be selected for use in the methods may be dependent on the properties, such as, e.g., the particle size of, and the chemical composition of, the feed suspension of material to be ground. In some embodiments, the particulate grinding medium comprises particles having an average diameter in the range of from about 0.5 mm to about 6.0 mm, or in the range of from about 0.5 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In certain embodiments of the seventh to the twelfth aspects, the microfibrillated cellulose has a fibre steepness equal to or greater than about 10, as measured by Malvern (laser light scattering, using a Malvern Mastersizer S machine as supplied by Malvern Instruments Ltd) or by other methods which give essentially the same result. The fibrous substrate comprising cellulose alternatively may be microfibrillated in the presence of an inorganic particulate material to obtain microfibrillated cellulose having a fibre steepness equal to or greater than about 10, as measured by Malvern (laser light scattering, using a Malvern Mastersizer S machine as supplied by Malvern Instruments Ltd) or by other methods which give essentially the same result. Fibre steepness (i.e., the steepness of the particle size distribution of the fibres) is determined by the following formula:

$$\text{Steepness}=100\times(d_{30}/d_{70}).$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

In certain embodiments of the seventh to the twelfth aspects, the microfibrillated cellulose has a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

In certain embodiments of the seventh to the twelfth aspects, the microfibrillated cellulose has a modal fibre particle size ranging from about 0.1-500 μm.

In certain embodiments of the seventh to the twelfth aspects, the microfibrillated cellulose has a modal fibre particle size ranging from about 0.1-500 μm and a modal inorganic particulate material particle size ranging from 0.25-20 μm.

In certain embodiments of the seventh to the twelfth aspects, the microfibrillated cellulose in the first grinding stage is obtained or obtainable with a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In certain embodiments of the seventh to the twelfth aspects, the microfibrillated in the second refining stage is obtained or obtainable with a single disc, conical, twin disc, or plate refiner, for example, a single disc refiner (manufactured by Sprout) having a 12 in (30 cm) single disc.

In certain embodiments of the first to twelfth aspects, the median diameter ($d_{50}$) is less than 100 μm, and has an increased percentage of material finer than 25 μm and a lower percentage of material coarser than 300 μm, by the methods of the present invention compared to methods not employing a two-stage process of (i) grinding a fibrous substrate in a grinding vessel is in the presence of at least one inorganic particulate material and (ii) refining in a refiner, or homogenizing in a homogenizer, or sonicating with an ultrasonic device the ground fibrous substrate comprising cellulose and at least one inorganic particulate material.

In certain embodiments of the first to twelfth aspects, the median diameter ($d_{50}$) is less than 100 μM, and has an increased percentage of material finer than 25 μm and a lower percentage of material coarser than 300 μm, by the methods of the present invention compared to methods not employing a two-stage process of (i) grinding a fibrous substrate in a grinding vessel is in the presence of at least one inorganic particulate material and (ii) refining in a refiner, or homogenizing in a homogenizer, or sonicating with an ultrasonic device the ground fibrous substrate comprising cellulose and at least one inorganic particulate material; and wherein the grinding is carried out in an aqueous environment in the presence of a grinding medium; wherein the term "grinding medium" means a medium other than inorganic particulate material and is 0.5 mm or greater in size.

In certain embodiments of the seventh to the twelfth aspects, the method comprises extruding the composition comprising, consisting essentially of, or consisting of microfibrillated cellulose, by attenuating or drying extruded fibres with an attenuating gas, preferably, one or more stream of hot air.

In further embodiments of the ninth to the twelfth aspects, the method comprises extruding the composition comprising, consisting essentially of, or consisting of microfibrillated cellulose and at least one inorganic particulate material, by attenuating or drying extruded fibres with an attenuating gas, preferably, one or more stream of hot air.

In still further embodiments of the eleventh to the twelfth aspects, the method comprises extruding the composition comprising, consisting essentially of, or consisting of microfibrillated cellulose and at least one inorganic particulate material and a water soluble or dispersible polymer, by attenuating or drying extruded fibres with an attenuating gas, preferably, one or more stream of hot air.

In certain embodiments of the seventh to the twelfth aspects, the attenuating gas comprises one or more streams of hot air, which dries the extruded fibre comprising microfibrillated cellulose. In other embodiments of the ninth to the twelfth aspects, the attenuating gas comprises one or more streams of hot air, which dries the extruded fibre comprising microfibrillated cellulose and at least one inorganic particulate material.

In certain embodiments of the eleventh and twelfth aspects, the attenuating gas comprises one or more streams of hot air, which dries the extruded fibre comprising microfibrillated cellulose and at least one inorganic particulate material and polymer.

In certain embodiments of seventh to the twelfth aspects, the extrusion rate is about 0.3 g/min to about 2.5 g/min, or in other embodiments the extrusion rate may be about 0.4 g/min to 0.8 g/min.

In certain embodiments seventh to the twelfth aspects, the fibres may be extruded at a temperature at or below 100° C.

In certain embodiments seventh to the twelfth aspects, the fibres have an average diameter of from about 0.1 μm to about 1 mm. In other embodiments, the fibres have an average diameter of from about 0.1 μm to about 180 μm.

In certain embodiments of the first to the twelfth aspects, the fibres have an elastic modulus from about 5 GPa to about 20 GPa. In still further embodiments, the fibres have a fibre strength of about 40 MPa to about 200 MPa. In some embodiments, the fibres may have an increase in elastic modulus over fibres made from compositions lacking microfibrillated manufactured by the two stage process of the method of the second aspect of the present invention.

In certain embodiments, the fibres are spunlaid fibres. In still further embodiments the spunlaid fibres are formed by spunbonding. In further embodiments the spunbonding step may be selected from the group consisting of flash-spinning, needle-punching and water punching.

In certain embodiments of the seventh to the twelfth aspects, the collecting step is deposition of the fibres onto a foraminous surface to form a nonwoven web. In still further embodiments, the foraminous surface is a moving screen or wire.

In certain embodiments of the seventh to the twelfth aspects, the nonwoven web is bonded by hydro-entanglement. In still further embodiments, the nonwoven web is bonded by through-air thermal bonding. In a certain embodiment, the nonwoven web is bonded mechanically.

In certain embodiments of the preceding aspects of the present invention, the inorganic particulate material used to prepare the composition of microfibrillated cellulose is selected from the group consisting of alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, huntite, hydromagnesite, ground glass, perlite or diatomaceous earth, or wollastonite, or titanium dioxide, or magnesium hydroxide, or aluminium trihydrate, lime, graphite, or combinations thereof.

In certain embodiments of the preceding aspects of the present invention, the composition of microfibrillated cellulose further comprises one or more additives selected from the group consisting of starch, carboxymethyl cellulose, guar gum, urea, polyethylene oxide, and amphoteric carboxymethyl cellulose.

In certain embodiments of the preceding aspects of the present invention, the composition of microfibrillated cellulose further comprises one or more additive selected from the group consisting of dispersant, biocide, suspending agent, and oxidising agents.

In a thirteenth aspect of the present invention, the use of fibres according to the method of the seventh to the twelfth aspects to manufacture a nonwoven product is contemplated.

In certain embodiments, the use of the thirteenth aspect of the present invention to prepare nonwoven products selected from the group consisting of: diapers, feminine hygiene products, adult incontinence products, packaging materials, wipes, towels, dust mops, industrial garments, medical drapes, medical gowns, foot covers, sterilization wraps, table cloths, paint brushes, napkins, trash bags, various personal care articles, ground cover, and filtration media, is contemplated. In further embodiments, the nonwoven products prepared by the thirteenth aspect of the present invention are biodegradable.

In accordance with a fourteenth aspect of the present invention, there is provided a method for making a fabric according to any foregoing aspects or further embodiments of the present invention described herein. In certain embodiments, the method comprises dispersing one or more fibres according to any aspect or embodiment of the present invention such that they form a web and bonding the one or more fibres at the points where they intersect. In certain embodiments, the method comprises weaving one or more fibres according to any aspect or embodiment of the present invention.

Certain embodiments of the present invention may provide one or more of the following advantages: higher mineral loading; higher MFC loading; no substantial deterioration in elastic modulus and/or tensile strength of composition; temperature resistance, improvement in elastic modulus and/or tensile strength of composition; biodegradable and/or flushable compositions; and water-based (not solvent-based) compositions.

The details, examples and preferences provided in relation to any particular one or more of the stated aspects of the present invention apply equally to all aspects of the present invention. Any combination of the embodiments, examples and preferences described herein in all possible variations thereof is encompassed by the present invention unless otherwise indicated herein, or otherwise clearly contradicted by context.

DETAILED DESCRIPTION

Figure 1:
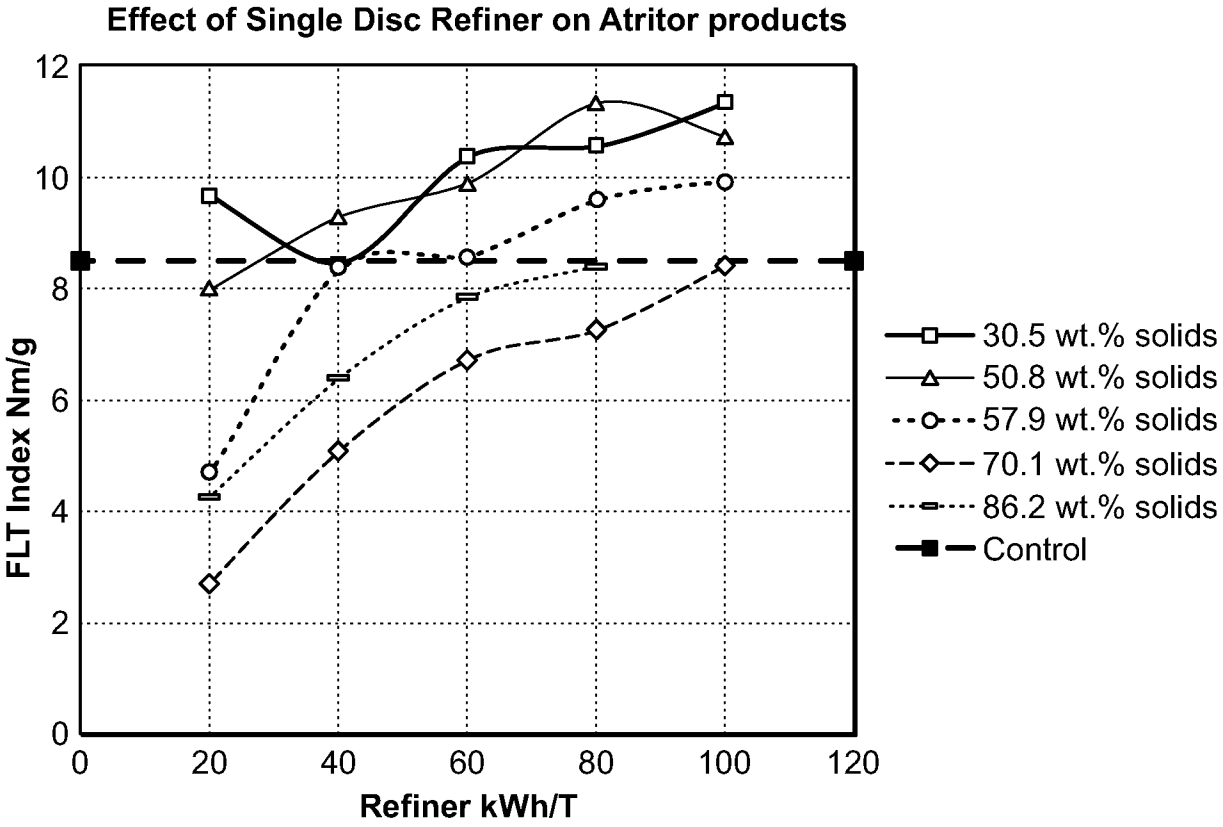
FIG. 1 shows a summary of the effect of the use of a single disc refiner on dried composition comprising microfibrillated cellulose and calcium carbonate materials.

The present invention relates generally to the use of microfibrillated cellulose in various fibres and non-woven products made from such fibres. The present invention also relates generally to the use of microfibrillated cellulose as a filler in various non-woven products made by molding or deposition.

The microfibrillated cellulose may have any one or more of the features of the microfibrillated cellulose described in WO 2010/131016 and WO 2012/066308, which are hereby incorporated by reference. Alternatively or additionally, the microfibrillated cellulose may be made by any one or more of the methods described in these documents.

The microfibrillated cellulose may, for example, be made by grinding a fibrous substrate comprising cellulose in an aqueous environment in the presence of a grinding medium, wherein the term "grinding medium" means a medium other than inorganic particulate material and is 0.5 mm or greater in size. The fibrous substrate comprising cellulose may, for example, be ground in the presence of an inorganic particulate material to form a co-processed microfibrillated cellulose and inorganic particulate material composition.

As used herein, "co-processed microfibrillated cellulose and inorganic particulate material composition" refers to compositions produced by the processes for microfibrillating fibrous substrate comprising cellulose in the present of an inorganic particulate material as described herein.

The fibrous substrate comprising cellulose may, for example, be ground in the absence of a grindable inorganic particulate material.

The fibrous substrate comprising cellulose may, for example, be ground in a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed, preferably in a stirred media detritor.

The microfibrillated cellulose may, for example, have a fibre steepness ranging from about 10 to about 100 or from about 20 to about 50.

Microfibrillated Cellulose and Methods of Making Microfibrillated Cellulose

Microfibrillation in the Presence of Inorganic Particulate Material

In certain embodiments, a cellulose pulp may be beaten in the presence of an inorganic particulate material, such as calcium carbonate.

The microfibrillated cellulose may, for example, be made by a method comprising a step of microfibrillating a fibrous substrate comprising cellulose in the presence of an inorganic particulate material. The microfibrillating step may be conducted in the presence of an inorganic particulate material which acts as a microfibrillating agent. By microfibrillating is meant a process in which microfibrils of cellulose are liberated or partially liberated as individual species or as smaller aggregates as compared to the fibres of the pre-microfibrillated pulp. The microfibrillated cellulose may be obtained by microfibrillating cellulose, including but not limited to the processes described herein. Typical cellulose fibres (i.e., pre-microfibrillated pulp) suitable for use in making fibres and non-woven materials from such fibres, include larger aggregates of hundreds or thousands of individual cellulose microfibrils. By microfibrillating the cellulose, particular characteristics and properties, including but not limited to the characteristic and properties described herein, are imparted to the microfibrillated cellulose and the compositions including the microfibrillated cellulose.

For preparation of microfibrillated cellulose useful for making fibres and nonwoven materials from such fibres, the fibrous substrate comprising cellulose may be preferably treated in a two stage fibrillation process. The fibrous substrate may be added to a grinding vessel in a dry state. The grinding may be accomplished in a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed. Preferably, the grinding is carried out in a screened grinder, such as a stirred media detritor. For example, a fibrous substrate may be added directly to a grinding vessel. The aqueous environment in the grinding vessel will then facilitate the formation of a pulp. The second stage of microfibrillating the fibrous substrate may be carried out in any a refiner, or a homogenizer or by sonication with an ultrasonic device, for example, an ultrasonic probe, an ultrasonic water bath, an ultrasonic homogenizer, an ultrasonic foil and an ultrasonic horn. The refiner may be a single disc, conical, twin disc, or plate refiner, for example, a single disc refiner (manufactured by Sprout) having a 12 in (30 cm) single disc.

In one embodiment, the microfibrillating step is conducted in a grinding vessel under wet-grinding conditions.

Wet-Grinding

The grinding is suitably performed in a conventional manner. The grinding may be an attrition grinding process in the presence of a particulate grinding medium of 0.5 mm or greater size, or may be an autogenous grinding process, i.e., one in the absence of a grinding medium. By grinding medium is meant a medium other than the inorganic particulate material of 0.5 mm or greater in size, which is co-ground with the fibrous substrate comprising cellulose.

The particulate grinding medium, when present, may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used. In other embodiments, hardwood grinding media (e.g. woodflour) may be used.

Generally, the type of and particle size of grinding medium to be selected for use in the methods may be dependent on the properties, such as, e.g., the particle size of, and the chemical composition of, the feed suspension of material to be ground. In some embodiments, the particulate grinding medium comprises particles having an average diameter in the range of from about 0.5 mm to about 6.0 mm, or in the range of from about 0.5 mm to about 4.0 mm. The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The grinding may be carried out in one or more stages. For example, a coarse inorganic particulate material may be ground in the grinder vessel to a predetermined particle size distribution, after which the fibrous material comprising cellulose is added and the grinding continued until the desired level of microfibrillation has been obtained.

The coarse inorganic particulate material initially may have a particle size distribution in which less than about 20% by weight of the particles have an e.s.d of less than 2 μm, for example, less than about 15% by weight, or less than about 10% by weight of the particles have an e.s.d. of less than 2 μm. In another embodiment, the coarse inorganic particulate material initially may have a particle size distribution, as measured using a Malvern Mastersizer S machine, in which less than about 20% by volume of the particles have an e.s.d of less than 2 μm, for example, less than about 15% by volume, or less than about 10% by volume of the particles have an e.s.d. of less than 2 μm.

The coarse inorganic particulate material may be wet or dry ground in the absence or presence of a grinding medium. In the case of a wet grinding stage, the coarse inorganic particulate material may be ground in an aqueous suspension in the presence of a grinding medium. In such a suspension, the coarse inorganic particulate material may preferably be present in an amount of from about 30% to about 70% by weight of the suspension. In some embodiments, the inorganic particulate material may be absent. As described above, the coarse inorganic particulate material may be ground to a particle size distribution such that at least about 10% by weight of the particles have an e.s.d of less than 2 μm, for example, at least about 20% by weight, or at least about 30% by weight, or at least about 40% by weight, or at least about 50% by weight, or at least about 60% by weight, or at least about 70% by weight, or at least about 80% by weight, or at least about 90% by weight, or at least about 95% by weight, or about 100% by weight of the particles, have an e.s.d of less than 2 μm, after which the cellulose pulp is added and the two components are co-ground to microfibrillate the fibres of the cellulose pulp.

In another embodiment, the coarse inorganic particulate material is ground to a particle size distribution, as measured using a Malvern Mastersizer S machine such that at least about 10% by volume of the particles have an e.s.d of less than 2 μm, for example, at least about 20% by volume, or at least about 30% by volume or at least about 40% by volume, or at least about 50% by volume, or at least about 60% by volume, or at least about 70% by volume, or at least about 80% by volume, or at least about 90% by volume, or at least about 95% by volume, or about 100% by volume of the particles, have an e.s.d of less than 2 μm, after which the cellulose pulp is added and the two components are co-ground to microfibrillate the fibres of the cellulose pulp In one embodiment, the mean particle size ($d_{50}$) of the inorganic particulate material is reduced during the co-grinding process. For example, the $d_{50}$ of the inorganic particulate material may be reduced by at least about 10% (as measured by a Malvern Mastersizer S machine), for example, the $d_{50}$ of the inorganic particulate material may be reduced by at least about 20%, or reduced by at least about 30%, or reduced by at least about 50%, or reduced by at least about 50%, or reduced by at least about 60%, or reduced by at least about 70%, or reduced by at least about 80%, or reduced by at least about 90%. For example, an inorganic particulate material having a $d_{50}$ of 2.5 μm prior to co-grinding and a $d_{50}$ of 1.5 μm post co-grinding will have been subject to a 40% reduction in particle size. In embodiments, the mean particle size of the inorganic particulate material is not significantly reduced during the co-grinding process. By 'not significantly reduced' is meant that the $d_{50}$ of the inorganic particulate material is reduced by less than about 10%, for example, the $d_{50}$ of the inorganic particulate material is reduced by less than about 5%.

The fibrous substrate comprising cellulose may be microfibrillated in the presence of an inorganic particulate material to obtain microfibrillated cellulose having a $d_{50}$ ranging from about 5 μm to about 500 μm, as measured by laser light scattering. The fibrous substrate comprising cellulose may be microfibrillated in the presence of an inorganic particulate material to obtain microfibrillated cellulose having a $d_{50}$ of equal to or less than about 400 μm, for example equal to or less than about 300 μm, or equal to or less than about 200 μm, or equal to or less than about 150 μm, or equal to or less than about 125 μm, or equal to or less than about 100 μm, or equal to or less than about 90 μm, or equal to or less than about 80 μm, or equal to or less than about 70 μm, or equal to or less than about 60 μm, or equal to or less than about 50 μM, or equal to or less than about 40 μm, or equal to or less than about 30 μm, or equal to or less than about 20 μm, or equal to or less than about 10 μm. Preferably, the fibrous substrate comprising cellulose may be microfibrillated in the presence of an inorganic particulate material to obtain microfibrillated cellulose having a $d_{50}$ of equal to or less than about 100 μm, more preferably equal to or less than about 90 μm, or equal to or less than about 80 μm, or equal to or less than about 70 μm, or equal to or less than about 60 μm.

The fibrous substrate comprising cellulose may be microfibrillated in the presence of an inorganic particulate material to obtain microfibrillated cellulose having a modal fibre particle size ranging from about 0.1-500 μm and a modal inorganic particulate material particle size ranging from 0.25-20 μm. The fibrous substrate comprising cellulose may be microfibrillated in the presence of an inorganic particulate material to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

The fibrous substrate comprising cellulose may be microfibrillated in the presence of an inorganic particulate material to obtain microfibrillated cellulose having a fibre steepness equal to or greater than about 10, as measured by Malvern (laser light scattering, using a Malvern Mastersizer S machine as supplied by Malvern Instruments Ltd) or by other methods which give essentially the same result. Fibre steepness (i.e., the steepness of the particle size distribution of the fibres) is determined by the following formula:

$$\text{Steepness}=100\times(d_{30}/d_{70}).$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

The grinding is suitably performed in a grinding vessel, such as a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In one embodiment, the grinding vessel is a tower mill. The tower mill may comprise a quiescent zone above one or more grinding zones. A quiescent zone is a region located towards the top of the interior of tower mill in which minimal or no grinding takes place and comprises microfibrillated cellulose and inorganic particulate material. The quiescent zone is a region in which particles of the grinding medium sediment down into the one or more grinding zones of the tower mill.

The tower mill may comprise a classifier above one or more grinding zones. In an embodiment, the classifier is top mounted and located adjacent to a quiescent zone. The classifier may be a hydrocyclone.

The tower mill may comprise a screen above one or more grind zones. In an embodiment, a screen is located adjacent to a quiescent zone and/or a classifier. The screen may be sized to separate grinding media from the product aqueous suspension comprising microfibrillated cellulose and inorganic particulate material and to enhance grinding media sedimentation.

In an embodiment, the grinding is performed under plug flow conditions. Under plug flow conditions the flow through the tower is such that there is limited mixing of the grinding materials through the tower. This means that at different points along the length of the tower mill the viscosity of the aqueous environment will vary as the fineness of the microfibrillated cellulose increases. Thus, in effect, the grinding region in the tower mill can be considered to comprise one or more grinding zones which have a characteristic viscosity. A skilled person in the art will understand that there is no sharp boundary between adjacent grinding zones with respect to viscosity.

In an embodiment, water is added at the top of the mill proximate to the quiescent zone or the classifier or the screen above one or more grinding zones to reduce the viscosity of the aqueous suspension comprising microfibrillated cellulose and inorganic particulate material at those zones in the mill. By diluting the product microfibrillated cellulose and inorganic particulate material at this point in the mill it has been found that the prevention of grinding media carry over to the quiescent zone and/or the classifier and/or the screen is improved. Further, the limited mixing through the tower allows for processing at higher solids lower down the tower and dilute at the top with limited backflow of the dilution water back down the tower into the one or more grinding zones. Any suitable amount of water which is effective to dilute the viscosity of the product aqueous suspension comprising microfibrillated cellulose and inorganic particulate material may be added. The water may be added continuously during the grinding process, or at regular intervals, or at irregular intervals.

In another embodiment, water may be added to one or more grinding zones via one or more water injection points positioned along the length of the tower mill, or each water injection point being located at a position which corresponds to the one or more grinding zones. Advantageously, the ability to add water at various points along the tower allows for further adjustment of the grinding conditions at any or all positions along the mill.

The tower mill may comprise a vertical impeller shaft equipped with a series of impeller rotor disks throughout its length. The action of the impeller rotor disks creates a series of discrete grinding zones throughout the mill.

In another embodiment, the grinding is performed in a screened grinder, for example a stirred media detritor. The screened grinder may comprise one or more screen(s) having a nominal aperture size of at least about 250 μm, for example, the one or more screens may have a nominal aperture size of at least about 300 μm, or at least about 350 μm, or at least about 400 μm, or at least about 450 μm, or at least about 500 μm, or at least about 550 μm, or at least about 600 μm, or at least about 650 μm, or at least about 700 μm, or at least about 750 μm, or at least about 800 μm, or at least about 850 μm, or at or least about 900 μm, or at least about 1000 μm.

The screen sizes noted immediately above are applicable to the tower mill embodiments described above.

As noted above, the grinding may be performed in the presence of a grinding medium. In an embodiment, the grinding medium is a coarse media comprising particles having an average diameter in the range of from about 0.5 mm to about 6 mm, for example about 2 mm, or about 3 mm, or about 4 mm, or about 5 mm.

In another embodiment, the grinding media has a specific gravity of at least about 2.5, for example, at least about 3, or at least about 3.5, or at least about 4.0, or at least about 4.5, or least about 5.0, or at least about 5.5, or at least about 6.0.

In another embodiment, the grinding media comprises particles having an average diameter in the range of from about 1 mm to about 6 mm and has a specific gravity of at least about 2.5.

In another embodiment, the grinding media comprises particles having an average diameter of about 3 mm and specific gravity of about 2.7.

As described above, the grinding medium (or media) may present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

In one embodiment, the grinding medium is present in amount of about 50% by volume of the charge.

By 'charge' is meant the composition which is the feed fed to the grinder vessel. The charge includes of water, grinding media, fibrous substrate comprising cellulose and inorganic particulate material, and any other optional additives as described herein.

The use of a relatively coarse and/or dense media has the advantage of improved (i.e., faster) sediment rates and reduced media carry over through the quiescent zone and/or classifier and/or screen(s).

A further advantage in using relatively coarse grinding media is that the mean particle size ($d_{50}$) of the inorganic particulate material may not be significantly reduced during the grinding process such that the energy imparted to the grinding system is primarily expended in microfibrillating the fibrous substrate comprising cellulose.

A further advantage in using relatively coarse screens is that a relatively coarse or dense grinding media can be used in the microfibrillating step. In addition, the use of relatively coarse screens (i.e., having a nominal aperture of least about 250 μm) allows a relatively high solids product to be processed and removed from the grinder, which allows a relatively high solids feed (comprising fibrous substrate comprising cellulose and inorganic particulate material) to be processed in an economically viable process. It has been found that a feed having a high initial solids content is desirable in terms of energy sufficiency. Further, it has also been found that product produced (at a given energy) at lower solids has a coarser particle size distribution.

In accordance with one embodiment, the fibrous substrate comprising cellulose and inorganic particulate material are present in the aqueous environment at an initial solids content of at least about 4 wt. %, of which at least about 2% by weight is fibrous substrate comprising cellulose. The initial solids content may be at least about 10 wt. %, or at least about 20 wt. %, or at least about 30 wt. %, or at least about at least 40 wt. %. At least about 5% by weight of the initial solids content may be fibrous substrate comprising cellulose, for example, at least about 10%, or at least about 15%, or at least about 20% by weight of the initial solids content may be fibrous substrate comprising cellulose.

In another embodiment, the grinding is performed in a cascade of grinding vessels, one or more of which may comprise one or more grinding zones. For example, the fibrous substrate comprising cellulose and the inorganic particulate material may be ground in a cascade of two or more grinding vessels, for example, a cascade of three or more grinding vessels, or a cascade of four or more grinding vessels, or a cascade of five or more grinding vessels, or a cascade of six or more grinding vessels, or a cascade of seven or more grinding vessels, or a cascade of eight or more grinding vessels, or a cascade of nine or more grinding vessels in series, or a cascade comprising up to ten grinding vessels. The cascade of grinding vessels may be operatively linked in series or parallel or a combination of series and parallel. The output from and/or the input to one or more of the grinding vessels in the cascade may be subjected to one or more screening steps and/or one or more classification steps.

The circuit may comprise a combination of one or more grinding vessels and homogenizer.

The total energy expended in a microfibrillation process may be apportioned equally across each of the grinding vessels in the cascade. Alternatively, the energy input may vary between some or all of the grinding vessels in the cascade.

A person skilled in the art will understand that the energy expended per vessel may vary between vessels in the cascade depending on the amount of fibrous substrate being microfibrillated in each vessel, and optionally the speed of grind in each vessel, the duration of grind in each vessel, the type of grinding media in each vessel and the type and amount of inorganic particulate material. The grinding conditions may be varied in each vessel in the cascade in order to control the particle size distribution of both the microfibrillated cellulose and the inorganic particulate material. For example, the grinding media size may be varied between successive vessels in the cascade in order to reduce grinding of the inorganic particulate material and to target grinding of the fibrous substrate comprising cellulose.

In an embodiment the grinding is performed in a closed circuit. In another embodiment, the grinding is performed in an open circuit. The grinding may be performed in batch mode. The grinding may be performed in a re-circulating batch mode.

The grinding circuit may include a pre-grinding step in which coarse inorganic particulate ground in a grinder vessel to a predetermined particle size distribution, after which fibrous material comprising cellulose is combined with the pre-ground inorganic particulate material and the grinding continued in the same or different grinding vessel until the desired level of microfibrillation has been obtained.

As the suspension of material to be ground may be of a relatively high viscosity, a suitable dispersing agent may be added to the suspension prior to grinding. The dispersing agent may be, for example, a water soluble condensed phosphate, polysilicic acid or a salt thereof, or a polyelectrolyte, for example a water soluble salt of a poly(acrylic acid) or of a poly(methacrylic acid) having a number average molecular weight not greater than 80,000. The amount of the dispersing agent used would generally be in the range of from 0.1 to 2.0% by weight, based on the weight of the dry inorganic particulate solid material. The suspension may suitably be ground at a temperature in the range of from 4° C. to 100° C.

Other additives which may be included during the microfibrillation step include: carboxymethyl cellulose, amphoteric carboxymethyl cellulose, and oxidising agents.

The pH of the suspension of material to be ground may be about 7 or greater than about 7 (i.e., basic), for example, the pH of the suspension may be about 8, or about 9, or about 10, or about 11. The pH of the suspension of material to be ground may be less than about 7 (i.e., acidic), for example, the pH of the suspension may be about 6, or about 5, or about 4, or about 3. The pH of the suspension of material to be ground may be adjusted by addition of an appropriate amount of acid or base. Suitable bases included alkali metal hydroxides, such as, for example NaOH. Other suitable bases are sodium carbonate and ammonia. Suitable acids included inorganic acids, such as hydrochloric and sulphuric acid, or organic acids. An exemplary acid is orthophosphoric acid.

The amount of inorganic particulate material and cellulose pulp in the mixture to be co-ground may vary in a ratio of from about 0:100 to about 30:70, based on the dry weight of inorganic particulate material and the amount of dry fibre in the pulp, or a ratio of from 50:50 based on the dry weight of inorganic particulate material and the amount of dry fibre in the pulp.

The total energy input in a typical grinding process to obtain the desired aqueous suspension composition may typically be between about 100 and 1500 $kWht^{-1}$ based on the total dry weight of the inorganic particulate filler. The total energy input may be less than about 1000 $kWht^{-1}$, for example, less than about 800 $kWht^{-1}$, less than about 600 $kWht^{-1}$, less than about 500 $kWht^{-1}$, less than about 400 $kWht^{-1}$, less than about 300 $kWht^{-1}$, or less than about 200 $kWht^{-1}$. As such, it has surprisingly been found that a cellulose pulp can be microfibrillated at relatively low energy input when it is co-ground in the presence of an inorganic particulate material. As will be apparent, the total energy input per tonne of dry fibre in the fibrous substrate comprising cellulose will be less than about 10,000 $kWht^{-1}$, for example, less than about 9000 $kWht^{-1}$, or less than about 8000 $kWht^{-1}$, or less than about 7000 $kWht^{-1}$, or less than about 6000 $kWht^{-1}$, or less than about 5000 $kWht^{-1}$, for example less than about 4000 $kWht^{-1}$, less than about 3000 $kWht^{-1}$, less than about 2000 $kWht^{-1}$, less than about 1500 $kWht^{-1}$, less than about 1200 $kWht^{-1}$, less than about 1000 $kWht^{-1}$, or less than about 800 $kWht^{-1}$. The total energy input varies depending on the amount of dry fibre in the fibrous substrate being microfibrillated, and optionally the speed of grind and the duration of grind.

The amount of inorganic particulate material, when present, and cellulose pulp in the mixture to be co-ground may be varied in order to produce a slurry which is suitable for use as the top ply slurry, or ply slurry, or which may be further modified, e.g., with additional of further inorganic particulate material, to produce a slurry which is suitable for use as the top ply slurry, or ply slurry.

Homogenizing

Microfibrillation of the fibrous substrate comprising cellulose may be effected under wet conditions in the presence of the inorganic particulate material by a method in which the mixture of cellulose pulp and inorganic particulate material is pressurized (for example, to a pressure of about 500 bar) and then passed to a zone of lower pressure. The rate at which the mixture is passed to the low pressure zone is sufficiently high and the pressure of the low pressure zone is sufficiently low as to cause microfibrillation of the cellulose fibres. For example, the pressure drop may be effected by forcing the mixture through an annular opening that has a narrow entrance orifice with a much larger exit orifice. The drastic decrease in pressure as the mixture accelerates into a larger volume (i.e., a lower pressure zone) induces cavitation which causes microfibrillation. In an embodiment, microfibrillation of the fibrous substrate comprising cellulose may be effected in a homogenizer under wet conditions in the presence of the inorganic particulate material. In the homogenizer, the cellulose pulp-inorganic particulate material mixture is pressurized (for example, to a pressure of about 500 bar), and forced through a small nozzle or orifice. The mixture may be pressurized to a pressure of from about 100 to about 1000 bar, for example to a pressure of equal to or greater than 300 bar, or equal to or greater than about 500, or equal to or greater than about 200 bar, or equal to or greater than about 700 bar. The homogenization subjects the fibres to high shear forces such that as the pressurized cellulose pulp exits the nozzle or orifice, cavitation causes microfibrillation of the cellulose fibres in the pulp. Additional water may be added to improve flowability of the suspension through the homogenizer. The resulting aqueous suspension comprising microfibrillated cellulose and inorganic particulate material may be fed back into the inlet of the homogenizer for multiple passes through the homogenizer. In a preferred embodiment, the inorganic particulate material is a naturally platy mineral, such as kaolin. As such, homogenization not only facilitates microfibrillation of the cellulose pulp, but also facilitates delamination of the platy particulate material. An exemplary homogenizer is a Manton Gaulin (APV) homogenizer. A laboratory scale homogenizer suitable for preparation of the microfibrillated cellulose compositions, optionally including inorganic particulate material, is a GEA ANiro Soavi Technical Datasheet Ariete NS3030 available from GEA Mechanical Equipment, GEA Niro Soavi, Via A. M. Da Erba Edoari, 29-1, 43123 Parma, Italy. Other commercial scale homogenizers are available from GEA Niro Soavi, GEA United Kingdom, Leacroft Road, Birchwood, Warrington, Cheshire UK WA3 6JF. These include the Ariete Series—2006, 3006, 3011, 3015, 3037, 3045, 3055, 3075, 3090, 3110*, 5132, 5180, 5250, 5355 in addition to the 3030 model. Homogenizers are also available from Microfluidics, 90 Glacier Drive Suite 1000, Westwood, Mass. 02090 (US) denominated as Microfluidizer, 700 series and Models—M-7125, M-7250.

A platy particulate material, such as kaolin, is understood to have a shape factor of at least about 10, for example, at least about 15, or at least about 20, or at least about 30, or at least about 40, or at least about 50, or at least about 60, or at least about 70, or at least about 80, or at least about 90, or at least about 100. Shape factor, as used herein, is a measure of the ratio of particle diameter to particle thickness for a population of particles of varying size and shape as measured using the electrical conductivity methods, apparatuses, and equations described in U.S. Pat. No. 5,576,617, which is incorporated herein by reference.

A suspension of a platy inorganic particulate material, such as kaolin, may be treated in the homogenizer to a predetermined particle size distribution in the absence of the fibrous substrate comprising cellulose, after which the fibrous material comprising cellulose is added to the aqueous slurry of inorganic particulate material and the combined suspension is processed in the homogenizer as described above. The homogenization process is continued, including one or more passes through the homogenizer, until the desired level of microfibrillation has been obtained.

Similarly, the platy inorganic particulate material may be treated in a grinder to a predetermined particle size distribution and then combined with the fibrous material comprising cellulose followed by processing in the homogenizer. An exemplary homogenizer is a Manton Gaulin (APV) homogenizer.

After the microfibrillation step has been carried out, the aqueous suspension comprising microfibrillated cellulose and inorganic particulate material may be screened to remove fibre above a certain size and to remove any grinding medium. For example, the suspension can be subjected to screening using a sieve having a selected nominal aperture size in order to remove fibres which do not pass through the sieve. Nominal aperture size means the nominal central separation of opposite sides of a square aperture or the nominal diameter of a round aperture. The sieve may be a BSS sieve (in accordance with BS 1796) having a nominal aperture size of 150 μm, for example, a nominal aperture size 125 μm, or 106 μm, or 90 μm, or 74 μm, or 63 μm, or 53 μm, 45 μm, or 38 μm. In one embodiment, the aqueous suspension is screened using a BSS sieve having a nominal aperture of 75 μm. The aqueous suspension may then be optionally dewatered.

It will be understood therefore that amount (i.e., % by weight) of microfibrillated cellulose in the aqueous suspension after grinding or homogenizing may be less than the amount of dry fibre in the pulp if the ground or homogenized suspension is treated to remove fibres above a selected size. Thus, the relative amounts of pulp and inorganic particulate material fed to the grinder or homogenizer can be adjusted depending on the amount of microfibrillated cellulose that is required in the aqueous suspension after fibres above a selected size are removed.

Microfibrillation in the Absence of Grindable Inorganic Particulate Material

In certain embodiments, the microfibrillated cellulose may be prepared by a method comprising a step of microfibrillating the fibrous substrate comprising cellulose in an aqueous environment by grinding in the presence of a grinding medium (as described herein), wherein the grinding is carried out in the absence of inorganic particulate material. In certain embodiments, the grinding medium is removed after grinding. In other embodiments, the grinding medium is retained after grinding and may serve as the inorganic particulate material, or at least a portion thereof.

A method for preparing an aqueous suspension comprising microfibrillated cellulose may comprise a step of microfibrillating a fibrous substrate comprising cellulose in an aqueous environment by grinding in the presence of a grinding medium of 0.5 mm or greater in size (as described herein) which is to be removed after the completion of grinding, wherein the grinding is performed in a tower mill or a screened grinder, and wherein the grinding is carried out in the absence of grindable inorganic particulate material.

A grindable inorganic particulate material is a material which would be ground in the presence of the grinding medium. The grinding is suitably performed in a conventional manner. The grinding may be an attrition grinding process in the presence of a particulate grinding medium, or may be an autogenous grinding process, i.e., one in the absence of a grinding medium. By grinding medium is meant a medium other than grindable inorganic particulate.

As mentioned previously, the particulate grinding medium may be of a natural or a synthetic material. The grinding medium may, for example, comprise balls, beads or pellets of any hard mineral, ceramic or metallic material. Such materials may include, for example, alumina, zirconia, zirconium silicate, aluminium silicate or the mullite-rich material which is produced by calcining kaolinitic clay at a temperature in the range of from about 1300° C. to about 1800° C. For example, in some embodiments a Carbolite® grinding media is preferred. Alternatively, particles of natural sand of a suitable particle size may be used. In other embodiments, hardwood grinding media (e.g., woodflour) may be used.

Generally, the type of and particle size of grinding medium to be selected for use in the methods disclosed herein may be dependent on the properties, such as, e.g., the particle size of, and the chemical composition of, the feed suspension of material to be ground. In some embodiments, the particulate grinding medium comprises particles having an average diameter in the range of from about 0.5 mm to about 6 mm, for example from about 0.2 mm to about 4 mm. In one embodiment, the particles have an average diameter of at least about 3 mm.

The grinding medium may comprise particles having a specific gravity of at least about 2.5. The grinding medium may comprise particles having a specific gravity of at least about 3, or least about 4, or least about 5, or at least about 6.

The grinding medium (or media) may be present in an amount up to about 70% by volume of the charge. The grinding media may be present in amount of at least about 10% by volume of the charge, for example, at least about 20% by volume of the charge, or at least about 30% by volume of the charge, or at least about 40% by volume of the charge, or at least about 50% by volume of the charge, or at least about 60% by volume of the charge.

The fibrous substrate comprising cellulose may be microfibrillated to obtain microfibrillated cellulose having a $d_{50}$ ranging from about 5 μm about 500 μm, as measured by laser light scattering. equal to or less than about 200 μm, or equal to or less than about 150 μm, or equal to or less than about 125 μm, or preferably, equal to or less than about 100 μm, or equal to or less than about 90 μm, or equal to or less than about 80 μm, or equal to or less than about 70 μm, or, more preferably, equal to or less than about 60 μm, or equal to or less than about 50 μm, or equal to or less than about 40 μm, or equal to or less than about 30 μm.

The fibrous substrate comprising cellulose may be microfibrillated to obtain microfibrillated cellulose having a modal fibre particle size ranging from about 0.1-500 μm. The fibrous substrate comprising cellulose may be microfibrillated to obtain microfibrillated cellulose having a modal fibre particle size of at least about 0.5 μm, for example at least about 10 μm, or at least about 50 μm, or at least about 100 μm, or at least about 150 μm, or at least about 200 μm, or at least about 300 μm, or at least about 400 μm.

The fibrous substrate comprising cellulose may be microfibrillated to obtain microfibrillated cellulose having a fibre steepness equal to or greater than about 10, as measured by Malvern. Fibre steepness (i.e., the steepness of the particle size distribution of the fibres) is determined by the following formula:

$$\text{Steepness}=100\times(d_{30}/d_{70})$$

The microfibrillated cellulose may have a fibre steepness equal to or less than about 100. The microfibrillated cellulose may have a fibre steepness equal to or less than about 75, or equal to or less than about 50, or equal to or less than about 40, or equal to or less than about 30. The microfibrillated cellulose may have a fibre steepness from about 20 to about 50, or from about 25 to about 40, or from about 25 to about 35, or from about 30 to about 40.

The grinding may be performed in a grinding vessel, such as a tumbling mill (e.g., rod, ball and autogenous), a stirred mill (e.g., SAM or IsaMill), a tower mill, a stirred media detritor (SMD), or a grinding vessel comprising rotating parallel grinding plates between which the feed to be ground is fed.

In one embodiment, the grinding vessel is a tower mill, as previously described and under the conditions explained previously.

In another embodiment, the grinding is performed in a screened grinder, for example a stirred media detritor, in the manner and under the conditions specified previously in this specification for grinding fibrous substances comprising cellulose in the presence of inorganic particulate material.

The Fibrous Substrate Comprising Cellulose Used to Prepare the Microfibrillated Cellulose The microfibrillated cellulose is derived from fibrous substrate comprising cellulose. The fibrous substrate comprising cellulose may be derived from any suitable source, such as wood, grasses (e.g., sugarcane, bamboo) or rags (e.g., textile waste, cotton, hemp or flax). The fibrous substrate comprising cellulose may be in the form of a pulp (i.e., a suspension of cellulose fibres in water), which may be prepared by any suitable chemical or mechanical treatment, or combination thereof. For example, the pulp may be a chemical pulp, or a chemithermomechanical pulp, or a mechanical pulp, or a recycled pulp, or a papermill broke, or a papermill waste stream, or waste from a papermill, or a combination thereof. The cellulose pulp may be beaten (for example in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^3$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$. The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids. The pulp may be utilised in an unrefined state that is to say without being beaten or dewatered, or otherwise refined.

The fibrous substrate comprising cellulose may be added to a grinding vessel or homogenizer in a dry state. For example, a dry paper broke may be added directly to the grinder vessel. The aqueous environment in the grinder vessel will then facilitate the formation of a pulp.

The Inorganic Particulate Material which May be Used in the Microfibrillating Process The inorganic particulate material may, for example, be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, huntite, hydromagnesite, ground glass, perlite or diatomaceous earth, or wollastonite, or titanium dioxide, or magnesium hydroxide, or aluminium trihydrate, lime, graphite, or combinations thereof.

In certain embodiments, the inorganic particulate material comprises or is calcium carbonate, magnesium carbonate, dolomite, gypsum, an anhydrous kandite clay, perlite, diatomaceous earth, wollastonite, magnesium hydroxide, or aluminium trihydrate, titanium dioxide or combinations thereof.

In certain embodiments, the inorganic particulate material may be a surface-treated inorganic particulate material. For instance, the inorganic particulate material may be treated with a hydrophobizing agent, such as a fatty acid or salt thereof. For example, the inorganic particulate material may be a stearic acid treated calcium carbonate.

A preferred inorganic particulate material for use in the microfibrillation methods disclosed herein is calcium carbonate. Hereafter, the invention may tend to be discussed in terms of calcium carbonate, and in relation to aspects where the calcium carbonate is processed and/or treated. The invention should not be construed as being limited to such embodiments.

The particulate calcium carbonate used in the present invention may be obtained from a natural source by grinding. Ground calcium carbonate (GCC) is typically obtained by crushing and then grinding a mineral source such as chalk, marble or limestone, which may be followed by a particle size classification step, in order to obtain a product having the desired degree of fineness. Other techniques such as bleaching, flotation and magnetic separation may also be used to obtain a product having the desired degree of fineness and/or colour. The particulate solid material may be ground autogenously, i.e. by attrition between the particles of the solid material themselves, or, alternatively, in the presence of a particulate grinding medium comprising particles of a different material from the calcium carbonate to be ground. These processes may be carried out with or without the presence of a dispersant and biocides, which may be added at any stage of the process.

Precipitated calcium carbonate (PCC) may be used as the source of particulate calcium carbonate in the present invention, and may be produced by any of the known methods available in the art. TAPPI Monograph Series No 30, "Paper Coating Pigments", pages 34-35 describes the three main commercial processes for preparing precipitated calcium carbonate which is suitable for use in preparing products for use in the paper industry, but may also be used in the practice of the present invention. In all three processes, a calcium carbonate feed material, such as limestone, is first calcined to produce quicklime, and the quicklime is then slaked in water to yield calcium hydroxide or milk of lime. In the first process, the milk of lime is directly carbonated with carbon dioxide gas. This process has the advantage that no by-product is formed, and it is relatively easy to control the properties and purity of the calcium carbonate product. In the second process the milk of lime is contacted with soda ash to produce, by double decomposition, a precipitate of calcium carbonate and a solution of sodium hydroxide. The sodium hydroxide may be substantially completely separated from the calcium carbonate if this process is used commercially. In the third main commercial process the milk of lime is first contacted with ammonium chloride to give a calcium chloride solution and ammonia gas. The calcium chloride solution is then contacted with soda ash to produce by double decomposition precipitated calcium carbonate and a solution of sodium chloride. The crystals can be produced in a variety of different shapes and sizes, depending on the specific reaction process that is used. The three main forms of PCC crystals are aragonite, rhombohedral and scalenohedral, all of which are suitable for use in the present invention, including mixtures thereof.

In certain embodiments, the PCC may be formed during the process of producing microfibrillated cellulose.

Wet grinding of calcium carbonate involves the formation of an aqueous suspension of the calcium carbonate which may then be ground, optionally in the presence of a suitable dispersing agent. Reference may be made to, for example, EP-A-614948 (the contents of which are incorporated by reference in their entirety) for more information regarding the wet grinding of calcium carbonate.

In some circumstances, minor additions of other minerals may be included, for example, one or more of kaolin, calcined kaolin, wollastonite, bauxite, talc or mica, could also be present.

When the inorganic particulate material is obtained from naturally occurring sources, it may be that some mineral impurities will contaminate the ground material. For example, naturally occurring calcium carbonate can be present in association with other minerals. Thus, in some embodiments, the inorganic particulate material includes an amount of impurities. In general, however, the inorganic particulate material used in the invention will contain less than about 5% by weight, preferably less than about 1% by weight, of other mineral impurities.

The inorganic particulate material used during the microfibrillating step of the methods disclosed herein will preferably have a particle size distribution in which at least about 10% by weight of the particles have an e.s.d of less than 2 μm, for example, at least about 20% by weight, or at least about 30% by weight, or at least about 40% by weight, or at least about 50% by weight, or at least about 60% by weight, or at least about 70% by weight, or at least about 80% by weight, or at least about 90% by weight, or at least about 95% by weight, or about 100% of the particles have an e.s.d of less than 2 μm.

Unless otherwise stated, particle size properties referred to herein for the inorganic particulate materials are as measured in a well known manner by sedimentation of the particulate material in a fully dispersed condition in an aqueous medium using a Sedigraph 5100 machine as supplied by Micromeritics Instruments Corporation, Norcross, Ga., USA (telephone: +1 770 662 3620; web-site: www.micromeritics.com), referred to herein as a "Micromeritics Sedigraph 5100 unit". Such a machine provides measurements and a plot of the cumulative percentage by weight of particles having a size, referred to in the art as the 'equivalent spherical diameter' (e.s.d), less than given e.s.d values. The mean particle size $d_{50}$ is the value determined in this way of the particle e.s.d at which there are 50% by weight of the particles which have an equivalent spherical diameter less than that $d_{50}$ value.

Alternatively, where stated, the particle size properties referred to herein for the inorganic particulate materials are as measured by the well known conventional method employed in the art of laser light scattering, using a Malvern Mastersizer S machine as supplied by Malvern Instruments Ltd (or by other methods which give essentially the same result). In the laser light scattering technique, the size of particles in powders, suspensions and emulsions may be measured using the diffraction of a laser beam, based on an application of Mie theory. Such a machine provides measurements and a plot of the cumulative percentage by volume of particles having a size, referred to in the art as the 'equivalent spherical diameter' (e.s.d), less than given e.s.d values. The mean particle size $d_{50}$ is the value determined in this way of the particle e.s.d at which there are 50% by volume of the particles which have an equivalent spherical diameter less than that $d_{50}$ value.

In another embodiment, the inorganic particulate material used during the microfibrillating step of the methods disclosed herein will preferably have a particle size distribution, as measured using a Malvern Mastersizer S machine, in which at least about 10% by volume of the particles have an e.s.d of less than 2 μm, for example, at least about 20% by volume, or at least about 30% by volume, or at least about 40% by volume, or at least about 50% by volume, or at least about 60% by volume, or at least about 70% by volume, or at least about 80% by volume, or at least about 90% by volume, or at least about 95% by volume, or about 100% of the particles by volume have an e.s.d of less than 2 μm.

Unless otherwise stated, particle size properties of the microfibrillated cellulose materials are as are as measured by the well known conventional method employed in the art of laser light scattering, using a Malvern Mastersizer S machine as supplied by Malvern Instruments Ltd (or by other methods which give essentially the same result).

Details of the procedure used to characterise the particle size distributions of mixtures of inorganic particle material and microfibrillated cellulose using a Malvern Mastersizer S machine are provided below.

Another preferred inorganic particulate material for use in the microfibrillating methods disclosed herein is kaolin clay. Hereafter, this section of the specification may tend to be discussed in terms of kaolin, and in relation to aspects where the kaolin is processed and/or treated. The invention should not be construed as being limited to such embodiments. Thus, in some embodiments, kaolin is used in an unprocessed form.

Kaolin clay may be a processed material derived from a natural source, namely raw natural kaolin clay mineral. The processed kaolin clay may typically contain at least about 50% by weight kaolinite. For example, most commercially processed kaolin clays contain greater than about 75% by weight kaolinite and may contain greater than about 90%, in some cases greater than about 95% by weight of kaolinite.

Kaolin clay may be prepared from the raw natural kaolin clay mineral by one or more other processes which are well known to those skilled in the art, for example by known refining or beneficiation steps.

For example, the clay mineral may be bleached with a reductive bleaching agent, such as sodium hydrosulfite. If sodium hydrosulfite is used, the bleached clay mineral may optionally be dewatered, and optionally washed and again optionally dewatered, after the sodium hydrosulfite bleaching step.

The clay mineral may be treated to remove impurities, e.g. by flocculation, flotation, or magnetic separation techniques well known in the art. Alternatively the clay mineral may be untreated in the form of a solid or as an aqueous suspension.

The process for preparing the particulate kaolin clay may also include one or more comminution steps, e.g., grinding or milling. Light comminution of coarse kaolin is used to give suitable delamination thereof. The comminution may be carried out by use of beads or granules of a plastic (e. g. nylon), sand or ceramic grinding or milling aid. The coarse kaolin may be refined to remove impurities and improve physical properties using well known procedures. The kaolin clay may be treated by a known particle size classification procedure, e.g., screening and centrifuging (or both), to obtain particles having a desired $d_{50}$ value or particle size distribution.

The Aqueous Suspension

The aqueous suspensions produced in accordance with the methods described herein are suitable for use in various compositions and fibre and methods for making these fibres and nonwoven materials from such fibres.

The aqueous suspension may, for example, comprise, consist of, or consist essentially of microfibrillated cellulose and optional additives. The aqueous suspension may comprise, consist of, or consist essentially of microfibrillated cellulose and an inorganic particulate material and other optional additives. The other optional additives include dispersant, biocide, suspending aids, salt(s) and other additives, for example, starch or carboxy methyl cellulose or polymers, which may facilitate the interaction of mineral particles and fibres during or after grinding.

The inorganic particulate material may have a particle size distribution such that at least about 10% by weight, for example at least about 20% by weight, for example at least about 30% by weight, for example at least about 40% by weight, for example at least about 50% by weight, for example at least about 60% by weight, for example at least about 70% by weight, for example at least about 80% by weight, for example at least about 90% by weight, for example at least about 95% by weight, or for example about 100% of the particles have an e.s.d of less than 2 μm.

In another embodiment, the inorganic particulate material may have a particle size distribution, as measured by a Malvern Mastersizer S machine, such that at least about 10% by volume, for example at least about 20% by volume, for example at least about 30% by volume, for example at least about 40% by volume, for example at least about 50% by volume, for example at least about 60% by volume, for example at least about 70% by volume, for example at least about 80% by volume, for example at least about 90% by volume, for example at least about 95% by volume, or for example about 100% by volume of the particles have an e.s.d of less than 2 μm.

The amount of inorganic particulate material and cellulose pulp in the mixture to be co-ground may vary in a ratio of from about 0:100 to about 30:70, based on the dry weight of inorganic particulate material and the amount of dry fibre in the pulp, or a ratio of from 50:50 based on the dry weight of inorganic particulate material and the amount of dry fibre in the pulp.

In an embodiment, the composition does not include fibres too large to pass through a BSS sieve (in accordance with BS 1796) having a nominal aperture size of 150 μm, for example, a nominal aperture size of 125 μm, 106 μm, or 90 μm, or 74 μm, or 63 μm, or 53 μm, 45 μm, or 38 μm. In one embodiment, the aqueous suspension is screened using a BSS sieve having a nominal aperture of 75 μm.

It will be understood therefore that amount (i.e., % by weight) of microfibrillated cellulose in the aqueous suspension after grinding or homogenizing may be less than the amount of dry fibre in the pulp if the ground or homogenized suspension is treated to remove fibres above a selected size. Thus, the relative amounts of pulp and inorganic particulate material fed to the grinder or homogenizer can be adjusted depending on the amount of microfibrillated cellulose that is required in the aqueous suspension after fibres above a selected size are removed.

In an embodiment, the inorganic particulate material is an alkaline earth metal carbonate, for example, calcium carbonate. The inorganic particulate material may be ground calcium carbonate (GCC) or precipitated calcium carbonate (PCC), or a mixture of GCC and PCC. In another embodiment, the inorganic particulate material is a naturally platy mineral, for example, kaolin. The inorganic particulate material may be a mixture of kaolin and calcium carbonate, for example, a mixture of kaolin and GCC, or a mixture of kaolin and PCC, or a mixture of kaolin, GCC and PCC.

Dry and Semi-Dry Compositions

In another embodiment, the aqueous suspension is treated to remove at least a portion or substantially all of the water to form a partially dried or essentially completely dried product. For example, at least about 10% by volume of water in the aqueous suspension may be removed from the aqueous suspension, for example, at least about 20% by volume, or at least about 30% by volume, or least about 40% by volume, or at least about 50% by volume, or at least about 60% by volume, or at least about 70% by volume or at least about 80% by volume or at least about 90% by volume, or at least about 100% by volume of water in the aqueous suspension may be removed. Any suitable technique can be used to remove water from the aqueous suspension including, for example, by gravity or vacuum-assisted drainage, with or without pressing, or by evaporation, or by filtration, or by a combination of these techniques. The partially dried or essentially completely dried product will comprise microfibrillated cellulose and inorganic particulate material and any other optional additives that may have been added to the aqueous suspension prior to drying. The partially dried or essentially completely dried product may be stored or packaged for sale. The partially dried or essentially completely dried product may be used in any of the compositions or products disclosed herein. The partially dried or essentially completely dried product may be optionally re-hydrated and incorporated in any of the compositions or products disclosed herein.

In certain embodiments, the co-processed microfibrillated cellulose and inorganic particulate material composition may be in the form of a dry or at least partially dry, re-dispersable composition, as produced by the processes described herein or by any other drying process known in the art (e.g., freeze-drying). The dried co-processed microfibrillated cellulose and inorganic particulate material composition may be easily dispersed in aqueous or non-aqueous medium (e.g., polymers).

The dried and at least partially dried microfibrillated cellulose compositions may, for example, be made by mechanical dewatering, optionally followed by drying an (never before dried) aqueous composition comprising microfibrillated cellulose, optionally in the presence of an inorganic particulate and/or other additive as herein described. This may, for example, enhance or improve one or more properties of the microfibrillated cellulose upon re-dispersal. That is to say, compared to the microfibrillated cellulose prior to drying, the one or more properties of the re-dispersed microfibrillated are closer to the one or properties of the microfibrillated cellulose prior to drying than it/they would have been but for the combination of dewatering and drying. Incorporation of inorganic particulate material, or a combination of inorganic particulate materials, and/or other additives as herein described, can enhance the re-dispersibility of the microfibrillated cellulose following initial drying.

Thus, in certain embodiments, the method of forming a dried or at least partially dry microfibrillated cellulose or method of improving the dispersibility of a dried or at least partially dried microfibrillated cellulose comprises drying or at least partially drying an aqueous composition by a method comprising:

(i) dewatering the aqueous composition by one or more of:

(a) dewatering by belt press, for example, high pressure automated belt press, (b) dewatering by centrifuge, (c) dewatering by tube press, (d) dewatering by screw press, and (e) dewatering by rotary press; followed by drying, or (ii) dewatering the aqueous composition, followed by drying by one or more of:

(f) drying in a fluidized bed dryer, (g) drying by microwave and/or radio frequency dryer, (h) drying in a hot air swept mill or dryer, for example, a cell mill or an Atritor® mill, and (i) drying by freeze drying; or (iii) any combination of dewatering according to (i) and drying according to (ii), or (iv) a combination of dewatering and drying the aqueous composition.

In certain embodiments, if drying is by freeze drying, dewatering comprises one or more of (a) to (e).

Upon subsequent re-dispersal, e.g., following transportation to another facility, of the dried or at least partially dried microfibrillated cellulose in a liquid medium, the re-dispersed microfibrillated cellulose has a mechanical and/or physical property which is closer to that of the microfibrillated cellulose prior to drying or at least partial drying than it would have been but for drying according to (i), (ii), (iii) or (iv).

Thus, the microfibrillated cellulose may be re-dispersed, the method comprising re-dispersing dried or at least partially dried microfibrillated cellulose in a liquid medium, wherein the dried or at least partially dried microfibrillated cellulose was prepared by dewatering and drying an aqueous composition comprising microfibrillated cellulose whereby the re-dispersed microfibrillated cellulose has a mechanical and/or physical property which is closer to that of the microfibrillated cellulose prior to drying or at least partial drying than it would have been but for said dewatering and drying, optionally wherein the dried or at least partially dried microfibrillated cellulose comprises: (i) inorganic particulate material, (ii) a combination of inorganic particulate materials, and/or (iii) an additive other than inorganic particulate material, the presence of which during re-dispersing enhances a mechanical and/or physical property of the re-dispersed microfibrillated cellulose; and optionally wherein dewatering is selected from one or more of:

(a) dewatering by belt press, for example, high pressure automated belt press;

(b) dewatering by centrifuge;

(c) dewatering by tube press;

(d) dewatering by screw press; and (e) dewatering by rotary press;

and/or wherein drying is selected from one or more of:

(f) drying in a fluidized bed dryer;

(g) drying by microwave and/or radio frequency dryer (h) drying in a hot air swept mill or dryer, for example, a cell mill or an Atritor® mill; and (i) drying by freeze drying.

In certain embodiments, if drying was by freeze drying, dewatering comprises one or more of (a) to (e).

References to "dried" or "drying" includes "at least partially dried" or "or at least partially drying".

In certain embodiments, the aqueous composition comprising microfibrillated cellulose is dewatered by belt press, for example, high pressure automated belt press, followed by drying, for example, via one or more of (f) to (i) above.

In certain embodiments, the aqueous composition comprising microfibrillated cellulose is dewatered by centrifuge, followed by drying, for example, via one or more of (f) to (i) above.

In certain embodiments, the aqueous composition comprising microfibrillated cellulose is dewatered by tube press, followed by drying, for example, via one or more of (f) to (i) above.

In certain embodiments, the aqueous composition comprising microfibrillated cellulose is dewatered by screw press, followed by drying, for example, via one or more of (f) to (i) above.

In certain embodiments, the aqueous composition comprising microfibrillated cellulose is dewatered by rotary press, followed by drying, for example, via one or more of (f) to (i) above.

In certain embodiments, the aqueous composition is dewatered, for example, via one or more of (a) to (e) above, and then dried in a fluidized bed dryer.

In certain embodiments, the aqueous composition is dewatered, for example, via one or more of (a) to (e) above, and then dried by microwave and/or by radio frequency drying.

In certain embodiments, the aqueous composition is dewatered, for example, via one or more of (a) to (e) above, and then dried in a hot air swept mill or dryer, for example, a cell mil or an Atritor® mill. Suitable mills and dryers are available from Atritor Limited, 12 The Stampings, Blue Ribbon Park, Coventry, West Midlands, England. These mills and dryers include an Atritor Dryer-Pulveriser (any model including the 8A), Atritor Cell Mill, Atritor Extended Classifier Mill, and an Atritor Air Swept Tubular (AST) Dryer, Such mills may be used to prepare the aqueous composition of microfibrillated cellulose which is subsequently dried and then re-dispersed.

In certain embodiments, the aqueous composition is dewatered, for example, via one or more of (a) to (e) above, and then dried by freeze drying. In certain embodiments, dewatering is by one or more of (a)-(e) described above.

Dewatering and drying may be carried out for any suitable period of time, for example, from about 30 minutes to about 12 hours, or from about 30 minutes to about 8 hours, or from about 30 minutes to about 4 hours, or from about 30 minutes to about 2 hours. The period of time will be depend on factors such as for example, the solids content of the aqueous composition comprising microfibrillated cellulose, the bulk amount of the aqueous composition comprising microfibrillated cellulose and the temperature of drying.

In certain embodiments, drying is conducted at a temperature of from about 50° C. to about 120° C., for example, from about 60° C. to about 100° C., or at least about 70° C., or at least about 75° C., or at least about 80° C.

In certain embodiments, the method further comprises re-dispersing the dried or at least partially dried microfibrillated cellulose in a liquid medium, which may be aqueous or non-aqueous liquid. In certain embodiments, the liquid medium is an aqueous liquid, for example, water. In certain embodiments, the water is a waste water or a recycled waste water derived from the manufacturing plant in which the re-dispersed microfibrillated cellulose is being used to manufacture an article, product or composition. For example, in paper/paper board manufacturing plants, the water may be or comprise recycled white water from the paper making process. In certain embodiments, at least portion of any inorganic particulate material and/or additive other than inorganic particulate material be present in the recycle white water.

In certain embodiments the dried or at least partially dried microfibrillated cellulose comprises inorganic particulate material and/or an additive, the presence of which enhances a mechanical and/or physical property of the re-dispersed microfibrillated cellulose. Such inorganic particulate materials and additives are described herein in below.

The aqueous composition comprising microfibrillated cellulose may be dewatered and dried in order to reduce water content by at least 10% by weight, based on the total weight of the aqueous composition comprising microfibrillated cellulose prior to dewatering and drying, for example, by at least 20% by weight, or by at least 30% by weight, or by at least 40% by weight, or by at least about 50% by weight, or by at least 60% by weight, or by at least 70% by weight, or by at least 80% by weight, or by at least 80% by weight, or by at least 90% by weight, or by at least about 95% by weight, or by at least about 99% by weight, or by at least about 99.5% by weight, or by at least 99.9% by weight.

By "dried" or "dry" is meant that the water content of the aqueous composition comprising microfibrillated cellulose is reduced by at least 95% by weight.

By "partially dried" or "partially dry" is meant that the water content of the aqueous composition comprising microfibrillated cellulose is reduced by an amount less than 95% by weight. In certain embodiments, "partially dried" or "partially dry" means that the water content of the aqueous composition comprising microfibrillated cellulose is reduced by at least 50% by weight, for example, by at least 75% by weight or by at least 90% by weight.

The microfibrillated cellulose may, for example, be treated prior to dewatering and/or drying. For example, one or more additives as specified below (e.g. salt, sugar, glycol, urea, glycol, carboxymethyl cellulose, guar gum, or a combination thereof as specified below) may be added to the microfibrillated cellulose. For example, one or more oligomers (e.g. with or without the additives specified above) may be added to the microfibrillated cellulose. For example, one or more inorganic particulate materials may be added to the microfibrillated cellulose to improve dispersibility (e.g. talc or minerals having a hydrophobic surface-treatment such as a stearic acid surface-treatment (e.g. stearic acid treated calcium carbonate). The additives may, for example, be suspended in low dielectric solvents. The microfibrillated cellulose may, for example, be in an emulsion, for example an oil/water emulsion, prior to dewatering and/or drying. The microfibrillated cellulose may, for example, be in a masterbatch composition, for example a polymer masterbatch composition and/or a high solids masterbatch composition, prior to dewatering and/or drying. The microfibrillated cellulose may, for example, be a high solids composition (e.g. solids content equal to or greater than about 60 wt. % or equal to or greater than about 70 wt. % or equal to or greater than about 80 wt. % or equal to or greater than about 90 wt. % or equal to or greater than about 95 wt. % or equal to or greater than about 98 wt. % or equal to or greater than about 99 wt. %) prior to dewatering and/or drying. Any combination of one or more of the treatments may additionally or alternatively be applicable to the microfibrillated cellulose after dewatering and drying but prior to or during re-dispersion.

The re-dispersed microfibrillated cellulose may have a mechanical and/or physical property which is closer to that of the microfibrillated cellulose prior to drying or at least partial drying than it would have been but for drying in accordance with (i), (ii), (iii) or (iv) above.

In certain embodiments, the re-dispersed microfibrillated cellulose has a mechanical and/or physical property which is closer to that of the microfibrillated cellulose prior to drying or at least partial drying than it would have been but for drying in accordance with (i), (ii) or (iii).

The mechanical property may be any determinable mechanical property associated with microfibrillated cellulose. For example, the mechanical property may be a strength property, for example, tensile index. Tensile index may be measured using a tensile tester. Any suitable method and apparatus may be used provided it is controlled in order to compare the tensile index of the microfibrillated cellulose before drying and after re-dispersal. For example, the comparison should be conducted at equal concentrations of microfibrillated cellulose, and any other additive or inorganic particulate material(s) which may be present. Tensile index may be expressed in any suitable units such as, for example, N·m/g or kN·m/kg.

The physical property may be any determinable physical property associated with microfibrillated cellulose. For example, the physical property may be viscosity. Viscosity may be measured using a viscometer. Any suitable method and apparatus may be used provided it is controlled in order to compare the viscosity of the microfibrillated cellulose prior to drying and after re-dispersal. For example, the comparison should be conducted at equal concentrations of microfibrillated cellulose, and any other additive or inorganic particulate material(s) which may be present. In certain embodiments, the viscosity is Brookfield viscosity, with units of mPa·s.

In certain embodiments, the tensile index and/or viscosity of the re-dispersed microfibrillated cellulose is at least about 25% of the tensile index and/or viscosity of the aqueous composition of microfibrillated cellulose prior to drying, for example, at least about 30%, or at least about 35%, or at least about 40%, or at least 45%, or at least about 50%, or at least about 55%, or at least about 60%, or at least about 65%, or at least about 70%, or at least about 75%, or at least about 80% of the tensile index and/or viscosity of the microfibrillated cellulose prior to drying.

For example, if the tensile index of the microfibrillated cellulose prior to drying was 8 N·m/g, then a tensile index of at least 50% of this value would be 4 N·m/g.

In certain embodiments, the tensile index of the re-dispersed microfibrillated cellulose is at least about 25% of the tensile index of the aqueous composition of microfibrillated cellulose prior to drying, for example, at least about 30%, or at least about 35%, or at least about 40%, or at least 45%, or at least about 50%, or at least about 55%, or at least about 60%, or at least about 65%, or at least about 70%, or at least about 75%, or at least about 80% of the tensile index of the microfibrillated cellulose prior to drying.

In certain embodiments, the viscosity of the re-dispersed microfibrillated cellulose is at least about 25% of the viscosity of the aqueous composition of microfibrillated cellulose prior to drying, for example, at least about 30%, or at least about 35%, or at least about 40%, or at least 45%, or at least about 50%, or at least about 55%, or at least about 60%, or at least about 65%, or at least about 70%, or at least about 75%, or at least about 80% of the viscosity of the microfibrillated cellulose prior to drying.

In certain embodiments, inorganic particulate material and/or an additive other than inorganic particulate material is present during the dewatering and drying. The inorganic particulate material and/or additive may be added at any stage prior to dewatering and drying. For example, the inorganic particulate material and/or additive may be added during manufacture of the aqueous composition comprising microfibrillated cellulose, following manufacture of the aqueous composition comprising microfibrillated cellulose, or both. In certain embodiments, the inorganic particulate material is incorporated during manufacture of the microfibrillated cellulose (for example, by co-processing, e.g., co-grinding, as described here) and the additive other than inorganic particulate material is added following manufacture of the aqueous composition comprising microfibrillated cellulose. In certain embodiments, additional inorganic particulate material (which may be the same or different than the inorganic particulate added during manufacture of the microfibrillated cellulose) may be added following manufacture of the microfibrillated cellulose, for example, contemporaneously with the addition of additive other than inorganic particulate material. In certain embodiments, the microfibrillated cellulose of the aqueous composition has a fibre steepness of from 20 to 50. Details of the inorganic particulate material, additives and amounts thereof are described below.

In a further aspect, the method of re-dispersing microfibrillated cellulose comprises re-dispersing dried or at least partially dried microfibrillated cellulose in a liquid medium and in the presence of an additive other than inorganic particulate material which enhances a mechanical and/or physical property of the re-dispersed microfibrillated. The microfibrillated cellulose prior to being to be dried or at least partially dried has a fibre steepness of from 20 to 50.

In yet a further aspect, the method of re-dispersing microfibrillated cellulose comprises re-dispersing dried or at least partially dried microfibrillated cellulose in a liquid medium and in the presence of a combination of inorganic particulate materials, wherein the combination of inorganic particulate materials enhances a mechanical and/or physical property of the re-dispersed microfibrillated. In certain embodiments, the combination of inorganic particulate materials comprises calcium carbonate and a platy mineral, for example, a platy kaolin, or talc.

In certain embodiments, the additive, when present, is a salt, sugar, glycol, urea, glycol, carboxymethyl cellulose, guar gum, or a combination thereof.

In certain embodiments, the additive, when present, is a salt, sugar, glycol, urea, glycol, guar gum, or a combination thereof.

In certain embodiments, sugar is selected from monosaccharides (e.g. glucose, fructose, galactose), disaccharides (e.g. lactose, maltose, sucrose), oligosaccharides (chains of 50 or less units of one or more monosaccharides) polysaccharides and combinations thereof.

In certain embodiments, the salt is an alkali metal or alkaline earth metal chloride, for example, sodium, potassium, magnesium and/or calcium chloride. In certain embodiments, the salt comprises or is sodium chloride.

In certain embodiments, the glycol is and alkylene glycol, for example, selected from ethylene, propylene and butylene glycol, and combinations thereof. In certain embodiments, the glycol comprises or is ethylene glycol.

In certain embodiments, the additive comprises or is urea.

In certain embodiments, the additive comprises or is guar gum.

In certain embodiments, the additive comprises or is carboxymethyl cellulose. In certain embodiments, the additive is not carboxymethyl cellulose.

In certain embodiments, the microfibrillated cellulose prior to drying or at least partially drying is not acetylsed. In certain embodiments, the microfibrillated cellulose prior to drying or at least partially drying is not subjected to acetylation.

The inorganic particulate material may be added at one or more of the following stages: (i) prior to or during manufacture of the aqueous composition comprising microfibrillated cellulose; (ii) following manufacture of the aqueous composition comprising microfibrillated cellulose; (iii) during dewatering of the aqueous composition of microfibrillated cellulose; (iv) during drying of the aqueous composition of microfibrillated cellulose; and (v) prior to or during re-dispersing of the dried or at least partially dried microfibrillated cellulose.

The re-dispersed microfibrillated cellulose has a mechanical and/or physical property which is closer to that of the microfibrillated cellulose prior to drying and re-dispersal than it would have been but for the presence of the inorganic particulate and/or additive. In other words, the presence of the inorganic particulate material and/or additive other than inorganic particulate material enhances a mechanical and/or physical property of the re-dispersed microfibrillated.

In certain embodiments, the re-dispersed microfibrillated cellulose has a mechanical and/or physical property which is closer to that of the microfibrillated cellulose prior to drying or at least partial drying than it would have been but for the presence of the inorganic particulate material and/or additive.

As described above, the mechanical property may be any determinable mechanical property associated with microfibrillated cellulose. For example, the mechanical property may be a strength property, for example, tensile index. Tensile index may be measured using a tensile tester. Any suitable method and apparatus may be used provided it is controlled in order to compare the tensile index of the microfibrillated cellulose before drying and after re-dispersal. For example, the comparison should be conducted at equal concentrations of microfibrillated cellulose, and any other additive or inorganic particulate material(s) which may be present. Tensile index may be expressed in any suitable units such as, for example, N·m/g or kN·m/kg.

The physical property may be any determinable physical property associated with microfibrillated cellulose. For example, the physical property may be viscosity. Viscosity may be measured using a viscometer. Any suitable method and apparatus may be used provided it is controlled in order to compare the viscosity of the microfibrillated cellulose prior to drying and after re-dispersal. For example, the comparison should be conducted at equal concentrations of microfibrillated cellulose, and any other additive or inorganic particulate material(s) which may be present. In certain embodiments, the viscosity is Brookfield viscosity, with units of mPa·s.

In certain embodiments, the tensile index and/or viscosity of the re-dispersed microfibrillated cellulose is at least about 25% of the tensile index and/or viscosity of the aqueous composition of microfibrillated cellulose prior to drying, for example, at least about 30%, or at least about 35%, or at least about 40%, or at least 45%, or at least about 50%, or at least about 55%, or at least about 60%, or at least about 65%, or at least about 70%, or at least about 75%, or at least about 80% of the tensile index and/or viscosity of the microfibrillated cellulose prior to drying.

For example, if the tensile index of the microfibrillated cellulose prior to drying was 8 N·m/g, then a tensile index of at least 50% of this value would be 4 N·m/g.

In certain embodiments, the tensile index of the re-dispersed microfibrillated cellulose is at least about 25% of the tensile index of the aqueous composition of microfibrillated cellulose prior to drying, for example, at least about 30%, or at least about 35%, or at least about 40%, or at least 45%, or at least about 50%, or at least about 55%, or at least about 60%, or at least about 65%, or at least about 70%, or at least about 75%, or at least about 80% of the tensile index of the microfibrillated cellulose prior to drying.

In certain embodiments, the viscosity of the re-dispersed microfibrillated cellulose is at least about 25% of the viscosity of the aqueous composition of microfibrillated cellulose prior to drying, for example, at least about 30%, or at least about 35%, or at least about 40%, or at least 45%, or at least about 50%, or at least about 55%, or at least about 60%, or at least about 65%, or at least about 70%, or at least about 75%, or at least about 80% of the viscosity of the microfibrillated cellulose prior to drying.

The inorganic particulate material and/or additive, when present, are present in sufficient amounts in order to enhance the re-dispersibility of the microfibrillated cellulose, i.e., enhances a mechanical and/or physical property of the re-dispersed microfibrillated.

Based on the total weight of the aqueous composition comprising microfibrillated cellulose (including inorganic particulate when present) prior to drying, the additive may be added in an amount of from about 0.1 wt. % to about 20 wt. %, or from about 0.25 wt. % to about 15 wt. %, or from about 0.5 wt. % to about 10 wt. %, or from about 0.5 wt. % to about 7.5 wt. %, or from about 0.5 wt. % to about 5 wt. %, or from about 0.5 wt. % to about 4 wt. %, or from about 9.5 wt. % to about 4 wt. %, or from about 1 wt. % to about 3 wt. %.

The aqueous composition comprising microfibrillated cellulose and optional inorganic particulate material may have a solids content of up to about 50 wt. % prior to drying, for example, up to about 40 wt. %, or up to about 30 wt. %, or up to about 20 wt. %, or up to about 15 wt. %, or up to about 10 wt. %, or up to about 5 wt. %, or up to about 4 wt. %, or up to about 3 wt. %, or up to about 2 wt. %, or up to about 2 wt. %.

Based on the solids content of the aqueous composition microfibrillated cellulose prior to drying, the inorganic particulate may constitute up to about 99% of the total solids content, for example, up to about 90%, or up to about 80 wt. %, or up to about 70 wt. %, or up to about 60 wt. %, or up to about 50 wt. %, or up to about 40%, or up to about 30%, or up to about 20%, or up to about 10%, or up to about 5% of the total solids content.

In certain embodiments, the weight ratio of inorganic particulate to microfibrillated cellulose in the aqueous composition is from about 10:1 to about 1:2, for example, from about 8:1 to about 1:1, or from about 6:1 to about 3:2, or from about 5:1 to about 2:1, or from about 5:1 to about 3:1, or about 4:1 to about 3:1, or about 4:1.

In certain embodiments, the aqueous composition of microfibrillated cellulose prior to drying or at least partially drying has a solids content of up to about 20 wt. %, optionally wherein up to about 80% of the solids is inorganic particulate material.

In certain embodiments, the aqueous composition is substantially free of inorganic particulate material prior to drying.

The inorganic particulate material may, for example, be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, huntite, hydromagnesite, ground glass, perlite or diatomaceous earth, or wollastonite, or titanium dioxide, or magnesium hydroxide, or aluminium trihydrate, lime, graphite, or combinations thereof.

In certain embodiments, the inorganic particulate material comprises or is calcium carbonate, magnesium carbonate, dolomite, gypsum, an anhydrous kandite clay, perlite, diatomaceous earth, wollastonite, magnesium hydroxide, or aluminium trihydrate, titanium dioxide or combinations thereof.

In certain embodiments, the inorganic particulate material may be a surface-treated inorganic particulate material. For instance, the inorganic particulate material may be treated with a hydrophobizing agent, such as a fatty acid or salt thereof. For example, the inorganic particulate material may be a stearic acid treated calcium carbonate.

In certain embodiments, the inorganic particulate material is or comprises a platy mineral, for example, kaolin and/or talc, optionally in combination with another inorganic particulate material, such as, for example, calcium carbonate.

By 'platy' kaolin is meant kaolin a kaolin product having a high shape factor. A platy kaolin has a shape factor from about 20 to less than about 60. A hyper-platy kaolin has a shape factor from about 60 to 100 or even greater than 100. "Shape factor", as used herein, is a measure of the ratio of particle diameter to particle thickness for a population of particles of varying size and shape as measured using the electrical conductivity methods, apparatuses, and equations described in U.S. Pat. No. 5,576,617, which is incorporated herein by reference. As the technique for determining shape factor is further described in the '617 patent, the electrical conductivity of a composition of an aqueous suspension of orientated particles under test is measured as the composition flows through a vessel. Measurements of the electrical conductivity are taken along one direction of the vessel and along another direction of the vessel transverse to the first direction. Using the difference between the two conductivity measurements, the shape factor of the particulate material under test is determined.

In certain embodiments, the inorganic particulate material is or comprises talc, optionally in combination with another inorganic particulate material, such as, for example, calcium carbonate.

In certain embodiments, the inorganic particulate material is calcium carbonate, which may be surface treated, and the aqueous composition further comprises one or more of the additives other than inorganic particulate material as described herein.

The inorganic particulate material may have a particle size distribution in which at least about 10% by weight of the particles have an e.s.d of less than 2 μm, for example, at least about 20% by weight, or at least about 30% by weight, or at least about 40% by weight, or at least about 50% by weight, or at least about 60% by weight, or at least about 70% by weight, or at least about 80% by weight, or at least about 90% by weight, or at least about 95% by weight, or about 100% of the particles have an e.s.d of less than 2 μm.

In another embodiment, the inorganic particulate material has a particle size distribution, as measured using a Malvern Mastersizer S machine, in which at least about 10% by volume of the particles have an e.s.d of less than 2 μm, for example, at least about 20% by volume, or at least about 30% by volume, or at least about 40% by volume, or at least about 50% by volume, or at least about 60% by volume, or at least about 70% by volume, or at least about 80% by volume, or at least about 90% by volume, or at least about 95% by volume, or about 100% of the particles by volume have an e.s.d of less than 2 μm.

In certain embodiments, the aqueous composition comprising microfibrillated cellulose is free of inorganic particulate material, and the aqueous composition further comprises one or more of the additives other than inorganic particulate material as described herein.

The various methods described herein provide for the manufacture of re-dispersed microfibrillated cellulose having advantageous properties.

Thus, in a further aspect, there is provided a composition comprising re-dispersed microfibrillated cellulose dispersed in a liquid medium and which is obtainable by a method according to any one of method aspects described herein, and having, at a comparable concentration, a tensile index and/or viscosity which is at least 50% of the tensile index and/or viscosity of the aqueous composition of microfibrillated cellulose prior to drying, wherein either (i) the microfibrillated cellulose of the aqueous composition has a fibre steepness of from 20 to 50, and/or (ii) the aqueous composition of microfibrillated cellulose comprises inorganic particulate material, and optionally further comprises an additive other than inorganic particulate material.

The re-dispersed microfibrillated cellulose may be used, in an article, product, or composition, for example, paper, paperboard, polymeric articles, paints, and the like.

Exemplary Procedures to Characterise the Particle Size Distribution of Mixture of Minerals (GCC or Kaolin) and Microfibrillated Cellulose Pulp Fibres Calcium Carbonate A sample of co-ground slurry sufficient to give 3 g dry material is weighed into a beaker, diluted to 60 g with deionised water, and mixed with 5 $cm^3$ of a solution of sodium polyacrylate of 1.5 w/v % active. Further deionised water is added with stirring to a final slurry weight of 80 g.

Kaolin

A sample of co-ground slurry sufficient to give 5 g dry material is weighed into a beaker, diluted to 60 g with deionised water, and mixed with 5 $cm^3$ of a solution of 1.0 wt. % sodium carbonate and 0.5 wt. % sodium hexametaphosphate. Further deionised water is added with stirring to a final slurry weight of 80 g.

The slurry is then added in 1 $cm^3$ aliquots to water in the sample preparation unit attached to the Mastersizer S until the optimum level of obscuration is displayed (normally 10-15%). The light scattering analysis procedure is then carried out. The instrument range selected was 300RF: 0.05-900, and the beam length set to 2.4 mm.

For co-ground samples containing calcium carbonate and fibre the refractive index for calcium carbonate (1.596) is used. For co-ground samples of kaolin and fibre the RI for kaolin (1.5295) is used.

The particle size distribution is calculated from Mie theory and gives the output as a differential volume based distribution. The presence of two distinct peaks is interpreted as arising from the mineral (finer peak) and fibre (coarser peak).

The finer mineral peak is fitted to the measured data points and subtracted mathematically from the distribution to leave the fibre peak, which is converted to a cumulative distribution. Similarly, the fibre peak is subtracted mathematically from the original distribution to leave the mineral peak, which is also converted to a cumulative distribution. Both these cumulative curves may then be used to calculate the mean particle size ($d_{50}$) and the steepness of the distribution ($d_{30}/d_{70}\times100$). The differential curve may be used to find the modal particle size for both the mineral and fibre fractions.

The Ultrasonification Process

In brief, sonication, ultrasonication or ultrasonification (herein used interchangeably unless otherwise noted) is the irradiation of a liquid sample with ultrasonic (>20 kHz) sound waves which results in agitation of the liquid. The sound waves propagate into a liquid media resulting in alternating high-pressure (compression) and low-pressure (rarefaction) cycles. During rarefaction, high-intensity sonic waves create small vacuum bubbles or voids in the liquid, which then collapse violently (cavitation) during compression, creating very high local temperatures, and agitation. The combination of these events results in high shear forces capable of breaking down or reducing materials into smaller constituents essentially emulsifying the material. This process may change physical properties of the material depending on the operation parameters chosen. Ultrasonication also aids in mixing of materials through the agitation of the material. Although the present invention is not limited to the use of any sonication particular device, ultrasonication is most typically performed by use of an ultrasonic bath or an ultrasonic probe (or transducer). Suitable devices know in the art also include, and are not limited to an ultrasonic homogenizer, an ultrasonic foil and an ultrasonic horn.

Any effects of ultrasonication-induced cavitation on a material are controlled through a combination of parameters including different frequencies, displacement or vibration amplitudes, time of exposure to the process and mode of administration of the process (e.g., pulsed or continuous administration). Frequencies used typically range from about 25 to 55 kHz. Amplitudes used typically range from about 22 to 50 μm. The choice of using an ultrasonic bath, ultrasonic probe or other device can also influence the end result of the process.

With regard to the present invention, it has been found that ultrasonication of the aqueous suspension comprising the microfibrillated cellulose or microfibrillated cellulose and an inorganic particulate material of the present invention (collectively referred to as the "aqueous suspension") enhances physical properties of the material. For example, ultrasonication of an aqueous suspension comprising microfibrillated cellulose or comprising microfibrillated cellulose and an inorganic particulate material surprisingly and unexpectedly results in enhanced viscosity and/or tensile strength of the material, as demonstrated in the Examples section of this specification. The enhancement of the physical properties of the material of the present invention and the degree of enhancement is dependent upon the operating parameters used. In view of the teachings of this specification, one of ordinary skill in the art will be able to discern the parameters appropriate to achieve a desired result without undue experimentation.

In one aspect, the ultrasonication of the aqueous suspension of the present invention comprises producing an sonicated suspension comprising microfibrillated cellulose and inorganic particulate material with enhanced viscosity and/or tensile strength properties, the method comprising a step of microfibrillating a fibrous substrate comprising cellulose in an aqueous environment in the presence of an inorganic particulate material to produce an aqueous suspension comprising microfibrillated cellulose and inorganic particulate material, and further comprising subjecting the aqueous suspension comprising microfibrillated cellulose and inorganic particulate material to sonication to produce the aqueous suspension comprising microfibrillated cellulose and inorganic particulate material with enhanced viscosity and tensile strength properties. The microfibrillating step may comprise grinding the fibrous substrate comprising cellulose in the presence of the inorganic particulate material and may further comprise an initial step of grinding the inorganic particulate material in the absence of the fibrous substrate comprising cellulose to obtain an inorganic particulate material having a desired particle size.

In one embodiment, a grinding media, as discussed above, may also be used to produce the aqueous suspension comprising microfibrillated cellulose and inorganic particulate material with enhanced viscosity and tensile strength properties.

Ultrasonication of the aqueous suspension comprising microfibrillated cellulose and inorganic particulate material may be conducted with an ultrasonic probe or ultrasonic water bath, an ultrasonic homogenizer, an ultrasonic foil or an ultrasonic horn. The use of such devices is known to one of ordinary skill in the art.

In an embodiment of the present invention, the methods of the present invention may further comprise one or more of high shear mixing, homogenisation or refining either before or after the sonication step, all of which are known by one of ordinary skill in the art and may be incorporated into the methods of the present invention without undue experimentation in view of the teachings of this specification.

In an embodiment of the present invention, the tensile strength of the aqueous suspension comprising microfibrillated cellulose and inorganic particulate material with enhanced viscosity and tensile strength properties is increased by at least 5%, at least 10%, at least 20%, at least 50%, at least 100% or at least 200% over the aqueous suspension comprising microfibrillated cellulose and inorganic particulate material not subject to sonication.

In an embodiment of the present invention, the viscosity of the aqueous suspension comprising microfibrillated cellulose and inorganic particulate material with enhanced viscosity and tensile strength properties is increased by at least 5%, at least by 10% or at least by 20%, by at least 50%, by at least 100% over the aqueous suspension comprising microfibrillated cellulose and inorganic particulate material not subject to sonication.

In an embodiment of the present invention, the aqueous suspension comprising microfibrillated cellulose and inorganic particulate material is subject to sonication for at least 30 seconds, at least 1 minute, at least 2 minutes, at least 5 minutes, at least 10 minutes and at least 20 minutes or longer. The length of time may be determined by one of ordinary skill in the art based on the teachings of this specification.

In an embodiment of the present invention, the aqueous suspension comprising microfibrillated cellulose and inorganic particulate material is subject to sonication at an energy compensation rate of up to 1000 kwh per tonne of dried fibrils, 2500 kwh per tonne of dried fibrils, up to 5000 kwh per tonne of dried fibrils and up to 10000 kwh per tonne of dried fibrils.

The aqueous suspension comprising microfibrillated cellulose and inorganic particulate material may be sonicated by running the sonicator in continuous mode or in pulse mode or a combination of both. That is, where alternating long pulses and short pulses are performed as desired patterns or at random.

The aqueous suspension comprising microfibrillated cellulose and inorganic particulate material may be formed into a semi-dry product prior to sonication. A belt pressed cake is one example of a semi-dried product suitable for use in the present invention. Often converting the product to a semi-dry product is done, for example, for ease of handling and/or transport. In the event of using a semi-dried product as a starting material, sonication not only provides enhanced physical properties to the material but also aids in disbursement of the material into solution in a process referred to as rewetting.

The sonication of the aqueous suspension comprising microfibrillated cellulose and inorganic particulate material is not limited to any particular or specific sonication parameters as a change on one parameter may compensate for a change in another parameter, within physical and practical limits of the equipment and material being sonicated. For example, lengthening sonication time may compensate at least partly for using a reduced amplitude.

In preferred embodiments, the sonication is performed at an amplitude of up to 60%, up to 80%, up to 100% and up to 200% or more, to the physical limitations of the sonicator used. Said upper physical limits of amplitude of a particular device used are known to one of ordinary skill in the art.

The fibrous substrate comprising cellulose may be in the form of a pulp, for example, a chemical pulp, or a chemi-thermomechanical pulp, or a mechanical pulp, or a recycled pulp, or a paper broke pulp, or a papermill waste stream, or waste from a papermill, or combinations thereof.

The inorganic particulate material may be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, perlite or diatomaceous earth, or combinations thereof. In a preferred embodiment, the inorganic particulate material is an alkaline earth metal carbonate, for example, calcium carbonate or kaolin or a combination thereof.

The grinding vessel may be a tower mill.

In an embodiment, the aqueous suspension comprising microfibrillated cellulose and inorganic particulate material with enhanced viscosity and tensile strength properties obtained by the method of the present invention is suitable for use in a method of making paper or coating paper and is suitable for other use in other processes and materials where MFC is typically used, examples of which are detailed below in the section entitled "Other Uses."

In another aspect of the invention, the cellulose suspension may be produced without the use of an inorganic particulate material. In these instances, a grinding media, as discussed above and below, may be used in place of the inorganic particulate material. In this regard, the ultrasonication of the cellulose suspension of the present invention comprises producing an aqueous suspension comprising microfibrillated cellulose with enhanced viscosity and tensile strength properties, the method comprising a step of microfibrillating a fibrous substrate comprising cellulose in an aqueous environment to produce an aqueous suspension comprising microfibrillated cellulose, and further comprising subjecting the aqueous suspension comprising microfibrillated cellulose to sonication to produce the aqueous suspension comprising microfibrillated cellulose with enhanced viscosity and tensile strength properties. The microfibrillating step may comprise grinding the fibrous substrate comprising cellulose in the presence of a grinding media, the grinding media having a desired particle size. The grinding media may be partially or completely removed after the microfibrillating step.

Ultrasonication of the aqueous suspension comprising microfibrillated cellulose may be conducted with an ultrasonic probe or ultrasonic water bath, an ultrasonic homogenizer, an ultrasonic foil or an ultrasonic horn. The use of such devices is known to one of ordinary skill in the art.

Such probes are known to one of ordinary skill in the art. In view of the teachings of this specification, one of ordinary skill in the art will be able to discern the appropriate parameters without undue experimentation.

In an embodiment of the present invention, the methods of the present invention may further comprise one or more of high shear mixing, homogenisation or refining either before or after the sonication step, all of which are known by one of ordinary skill in the art and may be incorporated into the methods of the present invention without undue experimentation in view of the teachings of this specification.

In an embodiment of the present invention, the tensile strength of the aqueous suspension comprising microfibrillated cellulose with enhanced viscosity and tensile strength properties is increased by at least 5%, at least 10%, at least 20%, at least 50%, at least 100% or at least 200% over the aqueous suspension comprising microfibrillated cellulose and inorganic particulate material not subject to sonication.

In an embodiment of the present invention, the viscosity of the aqueous suspension comprising microfibrillated cellulose with enhanced viscosity and tensile strength properties is increased by at least 5%, at least by 10% or at least by 20%, by at least 50%, by at least 100% over the aqueous suspension comprising microfibrillated cellulose and inorganic particulate material not subject to sonication.

In an embodiment of the present invention, the aqueous suspension comprising microfibrillated cellulose is subject to sonication for at least 30 seconds, at least 1 minute, at least 2 minutes, at least 5 minutes, at least 10 minutes and at least 20 minutes or longer. The length of time may be determined by one of ordinary skill in the art based on the teachings of this specification.

In an embodiment of the present invention, the aqueous suspension comprising microfibrillated cellulose is subject to sonication at an energy compensation rate of up to 1000 kwh per tonne of dried fibrils, 2500 kwh per tonne of dried fibrils, up to 5000 kwh per tonne of dried fibrils and up to 10000 kwh per tonne of dried fibrils.

The aqueous suspension comprising microfibrillated cellulose may be sonicated by running the sonicator in continuous mode or in pulse mode or a combination of both. That is, where alternating long pulses and short pulses are performed as desired patterns or at random.

The aqueous suspension comprising microfibrillated cellulose may be formed into a semi-dry product prior to sonication. A belt pressed cake is one example of a semi-dried product suitable for use in the present invention. Often converting the product to a semi-dry product is done, for example, for ease of handling and/or transport. In the event of using a semi-dried product as a starting material, sonication not only provides enhanced physical properties to the material but also aids in disbursement of the material into solution.

The sonication of the aqueous suspension comprising microfibrillated cellulose is not limited to any particular or specific sonication parameters as a change on one parameter may compensate for a change in another parameter, within physical and practical limits. For example, lengthening sonication time may compensate at least partly for a reduced amplitude.

In preferred embodiments, the sonication is performed at an amplitude of up to 60%, up to 80%, up to 100% and up to 200% or more, to the physical limitations of the sonicator used. Said upper physical limits of amplitude of a particular device used are known to one of ordinary skill in the art.

The fibrous substrate comprising cellulose may be in the form of a pulp, for example, a chemical pulp, or a chemi-thermomechanical pulp, or a mechanical pulp, or a recycled pulp, or a paper broke pulp, or a papermill waste stream, or waste from a papermill, or combinations thereof.

In an embodiment, the aqueous suspension comprising microfibrillated cellulose and inorganic particulate material with enhanced viscosity and tensile strength properties obtained by the method of the present invention is suitable for use in a method of making paper or coating paper and is suitable for other use in other processes and materials where MFC is typically used and is suitable for other use in other processes and materials where MFC is typically used, examples of which are detailed below in the section entitled "Other Uses."

Uses of the Microfibrillated Cellulose and Compositions and Products Comprising the Microfibrillated Cellulose The microfibrillated cellulose disclosed herein and made by the methods disclosed herein may be used in various compositions, articles and products. Including fibres produced from such compositions.

Fibres and Fabrics

Microfibrillated cellulose as disclosed herein or microfibrillated cellulose made by any of the methods disclosed herein, including all embodiments thereof, may be used to make fibres. These fibres may, for example, be used to make a fabric, for example a woven or nonwoven fabric.

The microfibrillated cellulose may optionally be utilized as a composition comprising one or more inorganic particulate materials.

The inorganic particulate material may be added at one or more of the following stages: (i) prior to or during manufacture of the aqueous composition comprising microfibrillated cellulose; (ii) following manufacture of the aqueous composition comprising microfibrillated cellulose; (iii) during dewatering of the aqueous composition of microfibrillated cellulose; (iv) during drying of the aqueous composition of microfibrillated cellulose; and (v) prior to or during re-dispersing of the dried or at least partially dried microfibrillated cellulose The amount of inorganic particulate material and cellulose pulp in the mixture to be co-ground may vary in a ratio of from about 0:100 to about 30:70, based on the dry weight of inorganic particulate material and the amount of dry fibre in the pulp, or a ratio of from 50:50 based on the dry weight of inorganic particulate material and the amount of dry fibre in the pulp.

The inorganic particulate material may, for example, be an alkaline earth metal carbonate or sulphate, such as calcium carbonate, magnesium carbonate, dolomite, gypsum, a hydrous kandite clay such as kaolin, halloysite or ball clay, an anhydrous (calcined) kandite clay such as metakaolin or fully calcined kaolin, talc, mica, huntite, hydromagnesite, ground glass, perlite or diatomaceous earth, or wollastonite, or titanium dioxide, or magnesium hydroxide, or aluminium trihydrate, lime, graphite, or combinations thereof.

In certain embodiments, the inorganic particulate material comprises or is calcium carbonate, magnesium carbonate, dolomite, gypsum, an anhydrous kandite clay, perlite, diatomaceous earth, wollastonite, magnesium hydroxide, or aluminium trihydrate, titanium dioxide or combinations thereof.

In certain embodiments, the inorganic particulate material may be a surface-treated inorganic particulate material. For instance, the inorganic particulate material may be treated with a hydrophobizing agent, such as a fatty acid or salt thereof. For example, the inorganic particulate material may be a stearic acid treated calcium carbonate.

In certain embodiments, the inorganic particulate material is or comprises a platy mineral, for example, kaolin and/or talc, optionally in combination with another inorganic particulate material, such as, for example, calcium carbonate.

The microfibrillated cellulose is derived from fibrous substrate comprising cellulose. The fibrous substrate comprising cellulose may be derived from any suitable source, such as wood, grasses (e.g., sugarcane, bamboo) or rags (e.g., textile waste, cotton, hemp or flax). The fibrous substrate comprising cellulose may be in the form of a pulp (i.e., a suspension of cellulose fibres in water), which may be prepared by any suitable chemical or mechanical treatment, or combination thereof. For example, the pulp may be a chemical pulp, or a chemithermomechanical pulp, or a mechanical pulp, or a recycled pulp, or a papermill broke, or a papermill waste stream, or waste from a papermill, or a combination thereof. The cellulose pulp may be beaten (for example in a Valley beater) and/or otherwise refined (for example, processing in a conical or plate refiner) to any predetermined freeness, reported in the art as Canadian standard freeness (CSF) in $cm^3$. CSF means a value for the freeness or drainage rate of pulp measured by the rate that a suspension of pulp may be drained. For example, the cellulose pulp may have a Canadian standard freeness of about 10 $cm^3$ or greater prior to being microfibrillated. The cellulose pulp may have a CSF of about 700 $cm^3$ or less, for example, equal to or less than about 650 $cm^3$, or equal to or less than about 600 $cm^3$, or equal to or less than about 550 $cm^3$, or equal to or less than about 500 $cm^3$, or equal to or less than about 450 $cm^3$, or equal to or less than about 400 $cm^3$, or equal to or less than about 350 $cm^3$, or equal to or less than about 300 $cm^3$, or equal to or less than about 250 $cm^3$, or equal to or less than about 200 $cm^3$, or equal to or less than about 150 $cm^3$, or equal to or less than about 100 $cm^3$, or equal to or less than about 50 $cm^3$. The cellulose pulp may then be dewatered by methods well known in the art, for example, the pulp may be filtered through a screen in order to obtain a wet sheet comprising at least about 10% solids, for example at least about 15% solids, or at least about 20% solids, or at least about 30% solids, or at least about 40% solids. The pulp may be utilised in an unrefined state that is to say without being beaten or dewatered, or otherwise refined.

It will be understood by the skilled person that the microfibrillated cellulose, with or without the addition of inorganic particulate material, and whether processed as an aqueous suspension as described previously in this specification or whether dried or partially dried and used as such or reconstituted with a liquid prior to use, may be used as a microfibrillated cellulose composition (with or without inorganic particulate materials and with or without additional additives, in the manufacture of fibres, the manufacture of non-woven materials manufactured with such fibres comprising microfibrillated cellulose and optionally inorganic particulate material.

Therefore, also disclosed herein are fibres comprising, consisting essentially of or consisting of microfibrillated cellulose as disclosed herein or microfibrillated cellulose made by any of the methods disclosed herein, including all embodiments thereof. The fibres may, for example, be monofilament fibres. Also disclosed herein are fibres comprising, consisting essentially of or consisting of microfibrillated cellulose and one or more inorganic particulate material, as disclosed herein or microfibrillated cellulose and inorganic particulate material made by any of the methods disclosed herein, including all embodiments thereof. The fibres may, for example, be monofilament fibres.

The at least one polymer resin may be chosen from conventional polymer resins that provide the properties desired for any particular fibre and/or nonwoven product or application. The at least one polymer resin may be chosen from thermoplastic polymers, including but not limited to: polyolefins, such as polypropylene and polyethylene homopolymers and copolymers, including copolymers with 1-butene, 4-methyl-1-pentene, and 1-hexane; polyamides, such as nylon; polyesters; copolymers of any of the above-mentioned polymers; and blends thereof.

Examples of commercial products suitable as the at least one polymer resin include, but are not limited to: Exxon 3155, a polypropylene homopolymer having a melt flow rate of about 30 g/10 min, available from Exxon Mobil Corporation; PF305, a polypropylene homopolymer having a melt flow rate of about 38 g/10 min, available from Montell USA; ESD47, a polypropylene homopolymer having a melt flow rate of about 38 g/10 min, available from Union Carbide; 6D43, a polypropylene-polyethylene copolymer having a melt flow rate of about 35 g/10 min, available from Union Carbide; PPH 9099 a polypropylene homopolymer having a melt flow rate of about 25 g/10 mm, available from Total Petrochemicals; PPH 10099 a polypropylene homopolymer having a melt flow rate of about 35 g/10 min, available from Total Petrochemicals; Moplen HP 561R a polypropylene homopolymer having a melt flow rate of about 25 g/10 min, available from Lyondell Basell.

The polymer may, for example, be a biopolymer (a biodegradable polymer). The polymer may, for example, be water-soluble.

Examples of biocompatible polymers that are biodegradable in the biomedical arts include biodegradable hydrophilic polymers. These include such substances as: polysaccharides, proteinaceous polymers, soluble derivatives of polysaccharides, soluble derivatives of proteinaceous polymers, polypeptides, polyesters, polyorthoesters, and the like. The polysaccharides may be poly-1,4-glucans, e.g., starch glycogen, amylose and amylopectin, and the like. Biodegradable hydrophilic polymers may be water-soluble derivatives of poly-1,4-glucan, including hydrolyzed amylopectin, hydroxyalkyl derivatives of hydrolyzed amylopectin such as hydroxyethyl starch (HES), hydroxyethyl amylase, dialdehyde starch, and the like. Proteinaceous polymers and their soluble derivatives include gelation biodegradable synthetic polypeptides, elastin, alkylated collagen, alkylated elastin, and the like. Biodegradable synthetic polypeptides include poly-(N-hydroxyalkyl)-L-asparagine, poly-(N-hydroxyalkyl)-L-glutamine, copolymers of N-hydroxyalkyl-L-asparagine and N-hydroxyalkyl-L-glutamine with other amino acids. Suggested amino acids include L-alanine, L-lysine, L-phenylalanine, L-leucine, L-valine, L-tyrosine, and the like.

The fibres may, for example, comprise up to about 1 wt. %, up to about 2 wt. %, up to about 3 wt. %, up to about 4 wt. %, up to about 5 wt. %, up to about 6 wt. %, up to about 7 wt. %, up to about 8 wt. %, up to about 9 wt. %, or up to about 10 wt. % The fibres may, for example, comprise 0 wt. % polymer.

The fibres may, for example, comprise up to about 100 wt. % microfibrillated cellulose. For example, the fibres may comprise up to about 99 wt. % microfibrillated cellulose or up to about 98 wt. %, or up to about 97 wt. %, or up to about 96 wt. %, or up to about 95 wt. %, or up to about 94 wt. %, or up to about 93 wt. %, or up to about 92 wt. %, or up to about 91 wt. %, or up to about 90 wt. %, or up to about 80 wt. %, or up to about 70 wt. %, or up to about 60 wt. %, or up to about 50 wt. % or up to about 40 wt. % microfibrillated cellulose.

The fibres may, for example, comprise up to about 60 wt. % inorganic particulate material. For example, the fibres may comprise from about 0.1 wt. % to about 50 wt. % or from about 0.5 wt. % to about 45 wt. % or from about 1 wt. % to about 40 wt. % or from about 5 wt. % to about 35 wt. % or from about 10 wt. % to about 30 wt. % inorganic particulate material.

The particle size of the inorganic particulate material may affect the maximum amount of inorganic particulate material that can be effectively incorporated into the polymer fibers disclosed herein, as well as the aesthetic properties and strength of the resulting products. The particle size distribution of the filler may be small enough so as to not significantly weaken the individual fibers and/or make the surface of the fibers abrasive, but large enough so as to create an aesthetically pleasing surface texture.

In addition to the microfibrillated cellulose and optional polymer, the fibers may further comprise at least one additive. The at least one additive may be chosen from additional mineral fillers, for example talc, gypsum, diatomaceous earth, kaolin, attapulgite, bentonite, montmorillonite, and other natural or synthetic clays. The at least one additive may be chosen from inorganic compounds, for example silica, alumina, magnesium oxide, zinc oxide, calcium oxide, and barium sulfate. The at least one additive may be chosen from one of the group consisting of: optical brighteners; heat stabilizers; antioxidants; antistatic agents; antiblocking agents; dyestuffs; pigments, for example titanium dioxide; luster improving agents; surfactants; natural oils; and synthetic oils.

The fibres may, for example, be made by extrusion, molding or deposition. For example, the fibres may be extruded fibres. For example, the fibres may be extruded fibres, which may be made, by attenuating or drying extruded fibres with an attenuating gas, preferably, one or more stream of hot air.

The microfibrillated cellulose and optional additives (e.g. inorganic particulate material) may be incorporated into the polymer using the methods described in this specification. For example, the microfibrillated cellulose and optionally inorganic particulate materials, may be added to the polymer resin during any step prior to extrusion, for example, during or prior to the heating step.

In another embodiment, a "masterbatch" of at least one polymer and the microfibrillated cellulose, and optionally an inorganic particulate material, may be premixed, optionally formed into granulates or pellets, and mixed with at least one additional virgin polymer resin before extrusion of the fibers. The additional virgin polymer resin may be the same or different from the polymer resin used to make the masterbatch. In certain embodiments, the masterbatch comprises a higher concentration of the microfibrillated cellulose, for instance, a concentration ranging from about 20 to about 75 wt. %, than is desired in the final product, and may be mixed with the polymer in an amount suitable to obtain the desired concentration of filler in the final fiber product. For example, a masterbatch comprising about 50 wt. % microfibrillated cellulose, and optionally inorganic particulate material, may be mixed with an equal amount of the virgin polymer resin to produce a final product comprising about 25 wt. % microfibrillated cellulose. The microfibrillated cellulose and optional polymer may, for example, be mixed and pelletized using suitable apparatus. For example, a ZSK 30 Twin Extruder may be used to mix and extrude the masterbatch, and a Cumberland pelletizer may be used to optionally form the masterbatch into pellets.

Once the microfibrillated cellulose, and optionally inorganic particulate material, is formed and mixed with any additional optional additives, the mixture may be extruded continuously through at least one spinneret to produce long filaments. The extrusion rate may vary according to the desired application. In one embodiment, the extrusion rate ranges from about 0.3 g/min to about 2.5 g/min. In another embodiment, the extrusion rate ranges from about 0.4 g/min to about 0.8 g/min.

The extrusion temperature may also vary depending on the desired application. For example, the extrusion temperature may range up to about 100° C. The extrusion apparatus may be chosen from those conventionally used in the art, for example, the Reicofil 4 apparatus produced by Reifenhauser. The spinneret of the Reicofil 4, for example, contains 6800 holes per metre length approximately 0.6 mm in diameter.

The fibres may, for example, have an average diameter ranging from about 0.1 μm to about 1 mm. For example, the fibres may have an average diameter ranging from about 0.5 μm to about 0.9 mm or from about 0.5 μm to about 0.8 mm or from about 0.5 μm to about 0.7 mm or from about 0.5 μm to about 0.6 mm or from about 0.5 μm to about 0.5 mm or from about 0.5 μm to about 0.4 mm or from about 0.5 μm to about 0.3 mm or from about 0.5 μm to about 0.2 mm or from about 0.5 μm to about 0.1 mm. The fibres may, for example, have an average diameter ranging from about 0.1 μm to about 200 μm or from about 0.1 μm to about 190 μm or from about 0.1 μm to about 180 μm or from about 0.1 μm to about 170 μm or from about 0.1 μm to about 160 μm or from about 0.1 μm to about 150 μm. For example, the fibres may have an average diameter ranging from about 150 μm to about 200 μm or from about 150 μm to about 180 μM.

The fibers may, for example, have an average diameter ranging from about 0.5 μm to about 50 μm or more. For example, the fibers may have a diameter ranging from about Sum microns to about 50 μm or from about 10 μm to about 50 μM or from about 20 μm to about 50 μm.

After extrusion, the filaments may be attenuated. Fibers may, for example, be attenuated by convergent streams of hot air to form fibers of fine diameter.

After attenuation, the fibers may be directed onto a foraminous surface, such as a moving screen or wire, to form a non-woven fabric. The fibers may then be randomly deposited on the surface with some fibers lying in a cross direction, so as to form a loosely bonded web or sheet. In certain embodiments, the web is held onto the foraminous surface by means of a vacuum force. At this point, the web may be characterized by its basis weight, which is the weight of a particular area of the web, expressed in grams per square meter (gsm or $g/m^2$). The basis weight of the web may range from about 10 to about 55 gsm. The basis weight of the web may range from about 12 to about 30 gsm.

Once a web is formed, it may be bonded according to conventional methods, for example, melting and/or entanglement methods, such as hydro-entanglement, and through-air bonding. The fibers may, for example be bonded mechanically (e.g. by interlocking them with serrated needles). The fibers may, for example, be bonded with an adhesive.

The fibres may, for example, be spunlaid fibres. Spunlaid fibres are generally made by a continuous process, in which the fibres are spun and dispersed in a nonwoven web. Two examples of spunlaid processes are spunbonding or melt-blowing. In particular, spunbonded fibres may be produced by spinning a polymer resin into the shape of a fibre, for example, by heating the resin at least to its softening temperature, extruding the resin through a spinneret to form fibres, and transferring the fibres to a fibre draw unit to be collected in the form of spunlaid webs. Meltblown fibres may be produced by extruding the resin and attenuating the streams of resin by hot air to form fibres with a fine diameter and collecting the fibres to form spunlaid webs.

A spunlaid process may begin with heating the at least one polymer resin at least to its softening point, or to any temperature suitable for the extrusion of the microfibrillated polymer resin. The microfibrillated cellulose and polymer resin may be heated to a temperature ranging up to about 100° C., preferably from 80° C. to 100° C.

Spunbonded fibers may be produced by any of the known techniques including but not limited to general spun-bonding, flash-spinning, needle-punching, and water-punching processes. Exemplary spun-bonding processes are described in *Spunbond Technology Today* 2—*Onstream in the* 90's (Miller Freeman (1992)), U.S. Pat. No. 3,692,618 to Dorschner et al., U.S. Pat. No. 3,802,817 to Matuski et al., and U.S. Pat. No. 4,340,563 to Appel et al., each of which is incorporated herein by reference in its entirety.

The fibres may, for example, be staple fibres. Staple fibres are made by spinning and may be cut to a desired length and put into bales. To form a nonwoven fabric, the staple fibres may be dispersed on a conveyer belt and spread in a uniform or non-uniform web (e.g. by air laying, wet laying or carding/cross-lapping process).

The fibres may, for example, be flashspun.

Nonwoven Fabrics

Nonwoven fabrics comprise products made of parallel laid, cross laid or randomly laid webs bonded with application of adhesives or thermoplastic fibres under the application of heat or pressure. In other words, a nonwoven fabric is a fabric produced by other than weaving or knitting. The non-woven fabric can be manufactured to range from coarse to soft and extremely difficult to tear to weak.

The fibres of the present invention comprising microfibrillated cellulose and optionally inorganic particulate material and/or other additives and a polymer can be used to produce a web that may be bound by a variety of techniques such as felting, adhesive bonding, thermal bonding, stitch bonding, needle punching, hydro-entanglement and spin laying. The polymer combined with microfibrillated cellulose and optionally an inorganic particulate material and/or other additives can be used to produce a fibre that may form a web capable of bonding to yield a nonwoven fabric.

The physical properties of fibres suitable for manufacture of nonwoven materials are known in the art. These include, for example, crimp, denier, length, and finish. The amount and physical nature of the fibre crimp will determine the requirements for the nonwoven fabric to be produced from a given fibre. This is true also for the denier of the filament. Finer fibres result in higher density, strength and softness of the nonwoven fabric. Heavier denier fibres aid in manufacture of a uniform web at higher production speeds. Adjustment of these properties allows the skilled person to produce nonwoven materials with desired physical attributes.

The length of the fibre may depend upon the type of web forming equipment utilized to produce the nonwoven fabric. Thus, the skilled person may adjust the length of the fibres to suit the web forming equipment to manage fibre breakage and the quality of the nonwoven fabric and production rates.

Nonwoven fabrics produced with the fibres of the present invention may control such properties as recovery, heat resistant, compostable and biodegradable.

Nonwoven fabrics produced from the fibres of the present invention may be bonded by a variety of means know in the art. The bonding agents act as a glue to bind the fibres into a nonwoven fabric. Such fabrics are typically referred to as nonwoven bonded fabric. Bonding agents therefore control important properties of the final nonwoven bonded fabric. These properties include: strength, elasticity, handling and draping, fastness, and resistance to chemicals, oxygen, light, heat, flame resistance and solvents, as exemplified, for example, by the hydrophilicity or hydrophobicity of the bonded fibres in the nonwoven bonded fabric.

Bonding agents for nonwoven bonded fabrics are known in the art, and may be used to bond the fibres of the present invention, made by the processes described in this specification. The skilled person may choose among, butadiene polymers, frequently referred to as synthetic latex, acrylic acid polymers, sometimes referred to as unsaturated polymers, and vinyl polymers, such as vinyl acetate, vinyl ether, vinyl ester and vinyl chloride.

Polymers combined with microfibrillated cellulose, and optionally inorganic particulate material and/or other optional additives may preferably be thermoplastic polymers such as polyvinyl alcohol (PVA), co-polyamides, polyolefins, polyesters and polyvinyl chlorides. In some embodiments, polyethylene and ethylene vinyl acetates may be used.

The skilled person will select the bonding agent to be utilized based on the desired properties in the nonwoven fabric, including softness or firmness, adhesion, strength, durability, stiffness, fire retardance, hydrophilicity/hydrophobicity, compatibility with chemicals, surface tension, dimensional stability and resistance to solvents.

After bonding, the resulting sheet may optionally undergo various post-treatment processes, such as direction orientation, creping, hydroentanglement, and/or embossing processes. The optionally post-treated sheet may then be used to manufacture various nonwoven products. Methods for manufacturing nonwoven products are generally described in the art, for example, in *The Nonwovens Handbook*, The Association of the Nonwoven Industry (1988) and the *Encyclopedia of Polymer Science and Engineering*, vol. 10, John Wiley and Sons (1987).

A number of manufacturing processes are known in the art for the preparation of nonwoven fabrics from fibres. These include dry bonded fabrics, spun bonded fabrics and wet bonded fabrics. The fabric webs formed of fibres may be divided into wet laid webs and dry laid webs with the latter including parallel laid, cross laid and randomly laid webs. When the fibre is extruded continuously, spun laid webs and melt blown webs may be formed. Wet laid webs are similar in many respects to papermaking processes.

The microfibrillated cellulose fibres, optionally with inorganic particulate material and/or other additives and a polymer, may be dispersed in an aqueous medium such as water and then laid on a wire mesh. This allows the liquid to filter and to form a wet web on the wire. The wet web is transferred to a drying stage such as a felt before being cured. Such processes are continuous in nature. The web is typically a web comprising randomly laid fibres of microfibrillated cellulose fibres, optionally with inorganic particulate material and/or other additives and a polymer. Multiple wet laid webs may be superimposed to produce wet laid parallel laid webs. Such multiple wet laid webs can be produced on papermaking machinery.

Dry laid webs are typically produced by preparing a fibre in filament form and then opening, cleaning, and mixing the fibres. This is typically followed by a carding step performed on a card (or cards), to disentangle the fibres for further processing. The card may be roller or a clearer card. The fibres are then typically laid in either a parallel alignment, cross laid alignment or a randomly laid alignment.

Continuous filament webs may be formed from spun laid webs and melt blown webs as is known in the art. Spun laid webs involve extruding fibres from the composition of microfibrillated cellulose, and optionally inorganic particulate material and/or other optional additives, admixed with a polymer, as previously described. The composition is extruded through spinnerets by a gas, preferably air, at a high velocity. The fibres are deposited on a one of a variety of supports, including, for example, a scrim or a screen drum to form a web. The web is then bonded to form the nonwoven bonded fabric.

Alternatively, the fibres extruding fibres from the composition of microfibrillated cellulose, and optionally inorganic particulate material and/or other optional additives, admixed with a polymer, as previously described, in the manner described for spun laid fibres, except at a significantly higher velocity of gas flow.

Nonwoven fabrics are bonded in numerous manners as is know in the art. These include mechanical bonding, chemical/adhesive bonding, thermal bonding and bonding of spun laid webs. The mechanical bonding may be accomplished using needle punching, stitch bonding, and hydro-entanglement. Chemical bonding may employ techniques described as saturation, spray adhesive, foam bonding or by the application of powders and print bonding.

Non-woven fabrics may be used to make diapers, feminine hygiene products, adult incontinence products, packaging materials, wipes, towels, dust mops, industrial garments, medical drapes, medical gowns, foot covers, sterilization wraps, table cloths, paint brushes, napkins, trash bags, various personal care articles, ground cover, and filtration media.

The fibres may, for example, have an elastic modulus ranging from about 5 GPa to about 20 GPa. For example, the fibres may have an elastic modulus ranging from about 6 GPa to about 19 GPa or from about 7 GPa to about 18 GPa or from about 8 GPa to about 17 GPa or from about 9 GPa to about 16 GPa or from about 10 GPa to about 15 GPa. Fibres comprising a polymer may, for example, have a higher elastic modulus than a corresponding fibre that is identical except that it does not comprise polymer.

The fibres may, for example, have a fibre strength ranging from about 40 MPa to about 200 MPa. For example, the fibres may have a fibre strength ranging from about 50 MPa to about 180 MPa or from about 60 MPa to about 160 MPa or from about 50 MPa to about 150 MPa or from about 70 MPa to about 140 MPa or from about 80 MPa to about 120 MPa or from about 80 MPa to about 100 MPa. Fibres comprising a polymer may, for example, have higher fibre strength than a corresponding fibre that is identical except that it does not comprise polymer. Fibre modulus and fibre strength may be determined using a tensiometer.

EXAMPLES

Example 1 (Comparative)

A composition consisting of 85% microfibrillated cellulose and 15% kaolin mineral was made in accordance with the methods described herein by grinding haft pulp with mineral at low solids content in a stirred media mill. The composition had the following particle size distribution measured by laser diffraction (Table 1).

TABLE 1

| d10/μm | d30/μm | d50/μm | d70/μm | d90/μm | Steepness | % <25 μm | % >25 μm & <300 μm | >300 μm |
|---|---|---|---|---|---|---|---|---|
| 19.6 | 62.1 | 124.9 | 215.7 | 397.9 | 29 | 12.5 | 66.7 | 20.8 |

The mixture was thickened to paste consistency by pressure filtration and then water was added to adjust the solids content of microfibrillated cellulose to 8%. Several attempts were made to extrude the material through a 0.5 mm internal diameter syringe needle but the needle rapidly became blocked on each occasion.

Example 2

A composition consisting of 85% microfibrillated cellulose and 15% kaolin mineral was made in accordance with the methods described herein by grinding kraft pulp with mineral at low solids content in a stirred media mill. The resultant product was passed once through a homogenizer operating at a pressure of 1000 bar.

The composition had the following particle size distribution measured by laser diffraction (Table 2).

TABLE 2

| d10/μm | d30/μm | d50/μm | d70/μm | d90/μm | Steepness | % <25 μm | % >25 μm & <300 μm | >300 μm |
|---|---|---|---|---|---|---|---|---|
| 15.92 | 39.9 | 72.5 | 109.7 | 175.3 | 36 | 17.4 | 80.9 | 1.6 |

The mixture was thickened to paste consistency and then water was added to adjust the solids content of microfibrillated cellulose within the range of 5% to 8%. The resultant mixtures were then extruded through a 0.5 mm internal diameter syringe needle to form fibres that were approximately 30 cm long. The fibres were laid down on a silicone release paper and dried in air. Shrinkage of the fibres on drying occurred predominantly radially, although some axial shrinkage (reduction in length) was observed. The diameter of each fibre was measured at multiple points and an average value was taken. Their tensile properties were tested using a Tinius Olsen tensiometer. The properties of the fibre are shown in Table 3 below.

TABLE 3

| Wt % mfc in suspension | Wt % mineral in suspension | Fibre diameter/ μm | Fibre modulus/ GPa | Fibre Strength/ MPa |
|---|---|---|---|---|
| 8 | 1.2 | 151 | 7.7 | 87 |
| 7 | 1.05 | 121 | 11.2 | 116 |
| 6 | 0.9 | 100 | 12.3 | 152 |
| 5 | 0.75 | 81 | 19.7 | 233 |

Example 3

The paste of microfibrillated cellulose of Example 1 was diluted with solutions of various water-soluble polymers to a range of solids contents of microfibrillated cellulose and polymer as shown in Table 5. The water soluble polymers used are shown in Table 4.

TABLE 4

| Polymer type | Product name |
|---|---|
| Polyacrylamide | Percol E24 (BASF) |
| Carboxymethyl cellulose | Finnfix 700 (CP Kelco) |
| Carboxymethyl guar | Meyproid 840 D (Meyhall Chemical AG) |

The mixtures were then extruded through a 0.5 mm internal diameter syringe needle to form fibres that were approximately 30 cm long. After drying, the average diameter of the fibres was measured and they were mounted into the tensiometer and their tensile modulus and strength were determined. The results are shown in Table 5.

TABLE 5

| Polymer type | Wt. % mfc | Wt. % mineral | Wt. % polymer | Fibre diameter/ μm | Fibre modulus/ GPa | Fibre Strength/ MPa |
|---|---|---|---|---|---|---|
| Polyacrylamide | 8 | 1.2 | 1 | 166 | 10.0 | 97 |
| Polyacrylamide | 7 | 1.05 | 1 | 158 | 9.4 | 94 |
| Polyacrylamide | 6 | 0.9 | 1 | 141 | 10.6 | 96 |
| Polyacrylamide | 5 | 0.75 | 1 | 109 | 15.1 | 150 |
| Carboxymethyl cellulose | 8 | 1.2 | 1 | 171 | 5.6 | 89 |
| Carboxymethyl cellulose | 7 | 1.05 | 1 | 155 | 7.7 | 120 |
| Carboxymethyl cellulose | 6 | 0.9 | 1 | 135 | 11.9 | 128 |
| Carboxymethyl cellulose | 5 | 0.75 | 1 | 117 | 13.3 | 152 |
| Carboxymethyl guar | 8 | 1.2 | 1 | 172 | 7.0 | 66 |
| Carboxymethyl guar | 7 | 1.05 | 1 | 168 | 5.8 | 52 |
| Carboxymethyl guar | 6 | 0.9 | 1 | 146 | 6.4 | 68 |
| Carboxymethyl guar | 5 | 0.75 | 1 | 125 | 8.3 | 102 |

Example 4 (Reduction of Size of Extrusion Orifice)

The paste of microfibrillated cellulose of Example 1 was diluted either with water or with solutions of various water-soluble polymers to a range of solids contents of microfibrillated cellulose and polymer as shown in Table 6. The mixtures were then extruded through a 0.34 mm internal diameter syringe needle to form fibres that were approximately 30 cm long. After drying, the average diameter of the fibres was measured and they were mounted into the tensiometer and their tensile modulus and strength were determined. The results are shown in Table 6.

TABLE 6

| Polymer type | Wt. % mfc | Wt. % mineral | Wt. % polymer | Fibre diameter/ μm | Fibre modulus/ GPa | Fibre Strength/ MPa |
|---|---|---|---|---|---|---|
| None | 8 | 1.2 | 0 | 93 | 11.9 | 107 |
| None | 7 | 1.05 | 0 | 68 | 17.2 | 187 |
| None | 6 | 0.9 | 0 | 61 | 20.8 | 232 |
| None | 5 | 0.75 | 0 | 49 | 25.7 | 306 |
| Polyacrylamide | 8 | 1.2 | 1 | 115 | 9.3 | 80 |
| Polyacrylamide | 7 | 1.05 | 1 | 102 | 9 | 109 |
| Polyacrylamide | 6 | 0.9 | 1 | 98 | 10.5 | 124 |

TABLE 6-continued

| Polymer type | Wt. % mfc | Wt. % mineral | Wt. % polymer | Fibre diameter/ μm | Fibre modulus/ GPa | Fibre Strength/ MPa |
|---|---|---|---|---|---|---|
| Polyacrylamide | 5 | 0.75 | 1 | 90 | 12.2 | 110 |
| Carboxymethyl cellulose | 8 | 1.2 | 1 | 169 | 9.1 | 79 |
| Carboxymethyl cellulose | 7 | 1.05 | 1 | 108 | 10 | 108 |
| Carboxymethyl cellulose | 6 | 0.9 | 1 | 97 | 11.4 | 120 |
| Carboxymethyl cellulose | 5 | 0.75 | 1 | 78 | 14.2 | 184 |
| Carboxymethyl guar | 8 | 1.2 | 1 | 107 | 7 | 77 |
| Carboxymethyl guar | 7 | 1.05 | 1 | 107 | 8.2 | 93 |
| Carboxymethyl guar | 6 | 0.9 | 1 | 104 | 6.1 | 68 |
| Carboxymethyl guar | 5 | 0.75 | 1 | 85 | 9.3 | 109 |

Example 5 (Further Reduction of Size of Extrusion Orifice)

The paste of microfibrillated cellulose of Example 1 was diluted either with water or with solutions of various water-soluble polymers to a range of solids contents of microfibrillated cellulose and polymer as shown in Table 7. The mixtures were then extruded through a 0.16 mm internal diameter syringe needle to form fibres that were approximately 30 cm long. After drying, the average diameter of the fibres was measured and they were mounted into the tensiometer and their tensile modulus and strength were determined. The results are shown in Table 7.

TABLE 7

| Polymer type | Wt. % mfc | Wt. % mineral | Wt. % polymer | Fibre diameter/ μm | Fibre modulus/ GPa | Fibre Strength/ MPa |
|---|---|---|---|---|---|---|
| None | 8 | 1.2 | 0 | 63 | 15 | 150 |
| None | 7 | 1.05 | 0 | 49 | 21.5 | 208 |
| None | 6 | 0.9 | 0 | 42 | 24.5 | 270 |
| None | 5 | 0.75 | 0 | 38 | 29.3 | 337 |
| Polyacrylamide | 8 | 1.2 | 1 | 84 | 9.6 | 88 |
| Polyacrylamide | 7 | 1.05 | 1 | 74 | 12 | 134 |
| Polyacrylamide | 6 | 0.9 | 1 | 63 | 14.5 | 125 |
| Polyacrylamide | 5 | 0.75 | 1 | 61 | 13.1 | 149 |
| Carboxymethyl cellulose | 8 | 1.2 | 1 | 75 | 12.3 | 131 |
| Carboxymethyl cellulose | 7 | 1.05 | 1 | 74 | 11.6 | 141 |
| Carboxymethyl cellulose | 6 | 0.9 | 1 | 67 | 15.1 | 193 |
| Carboxymethyl cellulose | 5 | 0.75 | 1 | 61 | 11.9 | 141 |
| Carboxymethyl guar | 8 | 1.2 | 1 | 88 | 6.5 | 63 |
| Carboxymethyl guar | 7 | 1.05 | 1 | 76 | 6.9 | 78 |
| Carboxymethyl guar | 6 | 0.9 | 1 | 74 | 7.5 | 95 |
| Carboxymethyl guar | 5 | 0.75 | 1 | 62 | 7.9 | 123 |

Example 6 (Addition of Further Mineral)

The paste of microfibrillated cellulose of Example 1 was diluted either with water or with solutions of various water-soluble polymers to a range of solids contents of microfibrillated cellulose and polymer as shown in Table 8. Fine ground calcium carbonate mineral (Intracarb 60, Imerys) was also added to the mixtures to increase the mineral content to the values shown. The mixtures were then extruded through a 0.5 mm syringe needle to form fibres that were approximately 30 cm long. After drying, the average diameter of the fibres was measured and they were mounted into the tensiometer and their tensile modulus and strength were determined. The results are shown in Table 8.

TABLE 8

| Polymer type | Wt. % mfc | Wt. % mineral | Wt. % polymer | Fibre diameter/ μm | Fibre modulus/ GPa | Fibre Strength/ MPa |
|---|---|---|---|---|---|---|
| None | 8 | 2.67 | 0 | 193 | 3.8 | 35 |
| None | 7 | 2.33 | 0 | 168 | 5.3 | 43 |
| None | 6 | 2.0 | 0 | 153 | 5.6 | 48 |
| None | 5 | 1.67 | 0 | 145 | 6.8 | 55 |
| Polyacrylamide | 8 | 2.67 | 1 | 185 | 8.3 | 81 |
| Polyacrylamide | 7 | 2.33 | 1 | 168 | 8.1 | 98 |
| Polyacrylamide | 6 | 2.0 | 1 | 148 | 11 | 96 |
| Polyacrylamide | 5 | 1.67 | 1 | 132 | 10.9 | 112 |
| Carboxymethyl cellulose | 8 | 2.67 | 1 | 185 | 6 | 66 |
| Carboxymethyl cellulose | 7 | 2.33 | 1 | 167 | 7.7 | 83 |
| Carboxymethyl cellulose | 6 | 2.0 | 1 | 137 | 9.8 | 113 |
| Carboxymethyl cellulose | 5 | 1.67 | 1 | 129 | 9.4 | 121 |

Example 7 (Addition of Further Mineral and Reduction of Orifice Size)

A composition consisting of 85% microfibrillated cellulose and 15% kaolin mineral was made in accordance with the methods described herein by grinding kraft pulp with mineral at low solids content in a stirred media mill. The resultant product was passed once through a homogenizer operating at a pressure of 1100 bar.

The composition had the following particle size distribution measured by laser diffraction (Table 9).

TABLE 9

| d10/μm | d30/μm | d50/μm | d70/μm | d90/μm | Steepness | % <25 μm | % >25 μm & <300 μm | >300 μm |
|---|---|---|---|---|---|---|---|---|
| 16.25 | 35.4 | 64.6 | 99.6 | 160.2 | 36 | 18.2 | 80.8 | 1.0 |

The composition was dewatered to a paste by pressure filtration and then diluted either with water or with a water-soluble polymer to a range of solids contents of microfibrillated cellulose and polymer as shown in Table 10. Fine ground calcium carbonate mineral (Intracarb 60, Imerys) was also added to the mixtures to increase the mineral content to the values shown. The mixtures were then extruded through either a 0.34 mm internal diameter or a 0.16 mm internal diameter syringe needle to form fibres that were approximately 30 cm long. After drying, the average diameter of the fibres was measured and they were mounted into the tensiometer and their tensile modulus and strength were determined. The results are shown in Table 10.

TABLE 10

| Needle internal diameter/ mm | Wt. % mfc | Wt. % mineral | Fibre diameter/ μm | Fibre modulus/ GPa | Fibre Strength/ MPa |
|---|---|---|---|---|---|
| 0.34 | 8 | 2.67 | 108 | 6.7 | 67 |
| 0.34 | 7 | 2.33 | 97 | 8 | 64 |
| 0.34 | 6 | 2.0 | 76 | 10.1 | 105 |
| 0.34 | 5 | 1.67 | 66 | 11.9 | 125 |
| 0.34 | 8 | 8 | 150 | 4.5 | 30 |
| 0.34 | 7 | 7 | 131 | 5.1 | 37 |
| 0.34 | 6 | 6 | 113 | 5.9 | 46 |
| 0.34 | 5 | 5 | 91 | 9.1 | 67 |

TABLE 10-continued

| Needle internal diameter/ mm | Wt. % mfc | Wt. % mineral | Fibre diameter/ μm | Fibre modulus/ GPa | Fibre Strength/ MPa |
|---|---|---|---|---|---|
| 0.16 | 8 | 2.67 | 75 | 8.7 | 83 |
| 0.16 | 7 | 2.33 | 75 | 7.1 | 83 |
| 0.16 | 6 | 2.0 | 64 | 10.2 | 99 |
| 0.16 | 5 | 1.67 | 53 | 13.4 | 98 |
| 0.16 | 8 | 8 | 92 | 5.2 | 40 |

TABLE 10-continued

| Needle internal diameter/ mm | Wt. % mfc | Wt. % mineral | Fibre diameter/ μm | Fibre modulus/ GPa | Fibre Strength/ MPa |
|---|---|---|---|---|---|
| 0.16 | 7 | 7 | 84 | 6.1 | 44 |
| 0.16 | 6 | 6 | 75 | 6.8 | 50 |
| 0.16 | 5 | 5 | 74 | 7.7 | 51 |

Example 8 (Micro Fibrillated Cellulose without Mineral)

A composition consisting of 100% microfibrillated cellulose was made in accordance with the methods described herein by grinding kraft pulp with mineral at low solids content in a stirred media mill. The resultant product was passed once through a homogenizer operating at a pressure of 1000 bar.

The composition had the following particle size distribution measured by laser diffraction (Table 11).

TABLE 11

| d10/μm | d30/μm | d50/μm | d70/μm | d90/μm | Steepness | % <25 μm | % >25 μm & <300 μm | >300 μm |
|---|---|---|---|---|---|---|---|---|
| 11.4 | 26.9 | 49.4 | 89.9 | 223.4 | 30.0 | 27.5 | 66 | 6.5 |

The composition was dewatered to a paste by pressure filtration and then diluted either with a solution of water-soluble polymer to a range of solids contents of microfibrillated cellulose and polymer as shown in Table 12. The mixtures were then extruded through a 0.5 mm internal diameter syringe needle to form fibres that were approximately 30 cm long. After drying, the average diameter of the fibres was measured and they were mounted into the tensiometer and their tensile modulus and strength were determined. The results are shown in Table 12.

TABLE 12

| Polymer type | Wt. % mfc | Wt. % polymer | Needle internal diameter/ mm | Fibre diameter/ μm | Fibre modulus/ GPa | Fibre Strength/ MPa |
|---|---|---|---|---|---|---|
| Carboxymethyl cellulose | 8 | 1 | 0.5 | 161 | 7.4 | 49 |
| Carboxymethyl cellulose | 7 | 1 | 0.5 | 157 | 5.2 | 70 |
| Carboxymethyl cellulose | 6 | 1 | 0.5 | 156 | 6.1 | 54 |
| Carboxymethyl cellulose | 5 | 1 | 0.5 | 163 | 6.2 | 53 |
| Carboxymethyl cellulose | 8 | 1 | 0.16 | 82 | 6.9 | 69 |
| Carboxymethyl cellulose | 7 | 1 | 0.16 | 83 | 8.3 | 72 |
| Carboxymethyl cellulose | 6 | 1 | 0.16 | 85 | 7.4 | 63 |
| Carboxymethyl cellulose | 5 | 1 | 0.16 | 77 | 7.9 | 79 |

Example 9

A number of aqueous compositions comprising microfibrillated cellulose and inorganic particulate material were prepared by co-grinding Botnia pulp in the presence of the inorganic particulate materials, as described in detail elsewhere in this specification. Properties of each composition are summarized in Table 13. POP refers to the "percentage of pulp" wherein the POP is the percentage of the dry weight of the sample that is pulp or fibrils rather than inorganic particulate material.

TABLE 13

| Composition | Total solids (wt %) | POP (wt %) | Tensile index (nm/g) | Brookfield Viscosity (mPas) |
|---|---|---|---|---|
| 50 POP Botnia/Calcium Carbonate | 2.5 | 47.4 | 8.5 | 1280 |
| 50 POP Botnia/Kaolin | 2.2 | 49.5 | 7.1 | 2780 |
| 20 POP Botnia/Kaolin | 4.9 | 21.8 | 8.0 | 3540 |
| 50 POP Botnia/Talc | 1.9 | 51.0 | 9.4 | 1600 |

Example 10

An additive was added to each slurry and mixed for 1 minute. The mixture was allowed to stand for 60 minutes and then was filtered. The resultant filter cake was placed in a laboratory oven at 80° C. until dry (<1 wt. % moisture).

The dried composition was then re-dispersed on a laboratory Silverson mixer. (Diluted to 20 POP, 1 minute Silverson mixing)

Each of compositions 1 through 4 was additized with different additives (sodium chloride, glycol, urea, carboxymethyl cellulose, sugar and guar gum) at varying concentrations and tensile index determined. Averaged results are summarized in Table 14.

TABLE 14

| Composition | Reduction in tensile index upon drying (%) | Reduction in tensile index upon drying with additive (%) |
|---|---|---|
| 50 POP Calcium Carbonate/Botnia | 53 | 25 |
| 50 POP Kaolin/Botnia | 25 | 0 |
| 20 POP Kaolin/Botnia | 34 | 28 |
| 50 POP Talc/Botnia | 37 | 32 |

Example 11

The purpose of these trials was to evaluate the effectiveness of re-dispersing a 50 wt. % POP (percentage of pulp) calcium carbonate/Botnia pulp high solids microfibrillated cellulose and calcium carbonate composition (i.e., a 1:1 wt. ratio of microfibriallated cellulose to calcium carbonate) using a single disc refiner available at a pilot plant facility. An example of a single disc refiner suitable for use in the present invention was manufactured by Sprout Waldron. The refiner was a 12 in (30 cm) single disc refiner. Disc rotational speed was 1320 rpm. Disc peripheral velocity was 21.07 m/s. Refiner Disc Design Bar width 1.5 mm; groove width 1.5 mm; bar cutting edge length 1.111 Km/rev bar CEL @ 1320 rpm 24.44 Km/sec. Other suitable refiners with equivalent specifications are known to those of ordinary skill in the art.

Feed Materials.

Transported to the pilot plant facility was 100 kg of belt press cake of microfibrillated cellulose and calcium carbonate (1:1 weight ratio) and 100 kg of four different feed materials made utilizing an Atritor dryer-pulverizer (available from Atritor Limited, 12 The Stampings, Blue Ribbon Park, Coventry, West Midlands, England), which is an air-swept mill or dryer having the capability to introduce a stream of hot air for drying and milling materials, in order to process and dry the microfibrillated cellulose and calcium carbonate composition utilized in the trials. Other equivalent mills are known to one of ordinary skill in the art. The properties of the calcium carbonate (IC60L)/Botnia high solids microfibrillated cellulose products utilized in the trials are shown in Table 15. These microfibrillated cellulose and calcium carbonate compositions (1:1 wt. ratio) were produced using an Atritor dryer with the rejector arms in place and fed at 20 Hz (slow feed rate).

TABLE 15

Properties of the feed materials used for the single disc refined trial.

| Feed Bag | Total solids wt. % | POP wt.% | FLT Index* Nm/g | gsm | Viscosity mPas |
|---|---|---|---|---|---|
| 50 POP IC60/Botnia Beltpress cake | 30.8 | 49.2 | 8.5 | 223 | 1440 |
| Atritor product bag 6 50 POP IC60/Botnia | 51.4 | 50.6 | 8.1 | 226 | 1340 |
| Atritor product bag 3 50 POP IC60/Botnia | 58.1 | 47.6 | 7.1 | 223 | 940 |
| Atritor product bag 2 50 POP IC60/Botnia | 69.5 | 47.3 | 4.9 | 225 | 640 |
| Atritor product bag 1 50 POP IC60/Botnia | 87.5 | 46.7 | 3.6 | 221 | 480 |

*After 1 minute of re-dispersion (between 1000-2000 kWh/t) using a laboratory scale Silverson mixer.

Trial Outline

Each material was "wetted" in a large pulper to replicate typical times/actions in a paper mill operation.

The pulped samples passed through the single disc refiner with samples taken at refining energy inputs ranging between 0-20-40-60-80-100 kWh/t of total dry solids.

Results.

1. 50 wt. % POP Calcium Carbonate (IC60)/Botnia Pulp (31 wt. % Solids) Belt Press Cake This 30.5 wt. % solids belt pressed cake of a composition comprising microfibrillated cellulose and calcium carbonate (1:1 wt. ratio) was initially re-dispersed in the pulper for 15 minutes at 7 wt. % solids. This consistency was too viscous to pump so the material was diluted with water by 1 wt. % to 6 wt. % solids. This material was then passed through the refiner and samples were taken at various work inputs.

Table 16 below shows the effect of the single disc refiner on the properties of the belt pressed cake comprising microfibrillated cellulose and calcium carbonate. The values quoted for the as received material have been subjected to 1 minute of mixing in a Silverson mixer (Silverson Machines, Inc., 55 Chestnut St. East Longmeadow, Mass. 01028) which equates to 1000-2000 kWh/t.

TABLE 16

Properties of the single disc refined belt pressed cake

| Feed Bag | Feed Bag total solids wt. % | Refiner solids wt. % | Energy kWh/T | Total solids | POP wt. % | FLT Index Nm/g | gsm | Viscosity mPas | Total Nib Surface Area per gram $mm^2/g$ |
|---|---|---|---|---|---|---|---|---|---|
| 50 POP IC60 | 30.5 | 7 | as rec'd | 30.8 | 49.2 | [8.5] | [223] | [1440] | [0] |
| Beltpress cake | | | 0 | 6.4 | 49.0 | 5.5 | 222 | 980 | 5 |
| 50 POP IC60/Botnia | 30.5 | 6 | as rec'd | 30.8 | 49.2 | [8.5] | [223] | [1440] | [0] |
| Beltpress cake | | | 0 | 5.3 | 49.0 | 6.7 | 227 | 1220 | 2 |
| | | | 20 | 5.9 | 49.0 | 9.7 | 227 | 1960 | 1 |
| | | | 40 | 5.7 | 49.1 | 8.5 | 220 | 1460 | 1 |
| | | | 60 | 5.9 | 49.0 | 10.4 | 228 | 1940 | 1 |
| | | | 80 | 6.0 | 49.2 | 10.6 | 231 | 1840 | 1 |
| | | | 100 | 6.0 | 49.2 | 11.3 | 224 | 1860 | 0 |

It can be seen that the belt press cake can be refined at 6 wt. % solids and after an input of 20 kWh/t the FLT Index has been restored. The FLT index is a tensile test developed to assess the quality of microfibrillated cellulose and re-dispersed microfibrillated cellulose. The POP of the test material is adjusted to 20% by adding whichever inorganic particulate was used in the production of the microfibrillated cellulose/inorganic material composite (in the case of inorganic particulate free microfibrillated cellulose then 60 wt. %<2 μm GCC calcium carbonate is used). A 220 gsm ($g/m^2$) sheet is formed from this material using a bespoke Buchner filtration apparatus The resultant sheet is conditioned and its tensile strength measured using an industry standard tensile tester. Energy inputs up to 100 kWh/t can improve both the FLT Index and viscosity of the microfibrillated cellulose and calcium carbonate composition. The "nib count" of 1 and below is acceptable and suggests good formation of a paper sheet. As is known to one of ordinary skill in the art, the nib count is a dirt count test (see for example the TAPPI dirt count test) and is an indication that the microfibrillated cellulose has been fully redispersed. In this case the sheets formed to measure the FLT index are subjected to nib counting using a light box prior to the destructive tensile testing. A low nib count is indicative of good redispersion in any aqueous application.

Table 17 shows the effect the single disc refiner has had upon the particle size of the microfibrillated cellulose and calcium carbonate composition. The particle size distribution ("PSD") has been measured on a Malvern Insitec (Malvern Instruments Ltd, Enigma Business Park, Grovewood Road, Malvern, WR14 1XZ, United Kingdom) located at the quality control laboratory facility.

TABLE 17

PSD properties of the single disc refined pressed cake

| Trial ID | Refiner solids wt. % | Energy kWh/T | Total solids wt. % | Malvern Insitec D10 | D30 | D50 | D70 | D90 | Fractionation −25 um | +25-150 um | +150-300 um | +300 um |
|---|---|---|---|---|---|---|---|---|---|---|---|---|
| 50 POP IC60 | 7 | as rec'd | 30.8 | 11.7 | 44.4 | 102.6 | 210.5 | 508.2 | 20.3 | 40.3 | 18.4 | 21.0 |
| Beltpress cake | | 0 | 6.4 | 13.8 | 53.9 | 119.4 | 228.7 | 492.6 | 17.5 | 39.3 | 21.2 | 22.0 |
| 50 POP IC60/Botnia | 6 | as rec'd | 30.8 | 11.7 | 44.4 | 102.6 | 210.5 | 508.2 | 20.3 | 40.3 | 18.4 | 21.0 |
| Beltpress cake | | 0 | 5.3 | 13.4 | 51.6 | 114.9 | 223.9 | 508.5 | 18.1 | 39.9 | 20.2 | 21.9 |
| | | 20 | 5.9 | 11.6 | 38.9 | 86.3 | 170.4 | 399.9 | 21.6 | 44.8 | 18.0 | 15.8 |
| | | 40 | 5.7 | 10.1 | 34.5 | 78.5 | 152.9 | 342.0 | 23.3 | 45.7 | 17.9 | 12.6 |
| | | 60 | 5.9 | 10.1 | 31.5 | 68.8 | 131.5 | 286.0 | 25.0 | 48.9 | 16.9 | 9.2 |
| | | 80 | 6.0 | 9.9 | 30.8 | 67.6 | 128.9 | 280.2 | 25.5 | 49.1 | 16.6 | 8.9 |
| | | 100 | 6.0 | 9.7 | 29.1 | 62.4 | 118.0 | 252.8 | 26.5 | 50.7 | 15.7 | 7.1 |

It can be seen from the PSD values that the single disc refiner is very efficient in reducing the coarse particles of the microfibrillated cellulose and calcium carbonate composition.

2. 50 wt. % POP Calcium Carbonate (IC60)/Botnia Pulp Microfribrillated Cellulose and Calcium Carbonate (1:1 wt. Ratio) Dried in an Atritor Dryer (51.4 wt. % Solids).

This 51.4 wt. % 1:1 wt. ratio of microfibrillated cellulose and calcium carbonate product dried utilizing an Atritor dryer was re-dispersed within the pulper at 7 wt. % solids. This material's low viscosity enabled it to pump easily. This material was then passed through the refiner and samples were taken at various work inputs.

Table 17 below shows the effect of the single disc refiner on the properties of the 51.4 wt. % microfibrillated cellulose and calcium carbonate composition. The values quoted for the as rec'd material have been subjected to 1 minute of mixing with a Silverson mixer which equates to 1000-2000 kWh/t.

TABLE 17

Properties of the single disc refmined 51.4 wt. % composition comprising microfibrillated cellulose and calcium carbonate (1:1 wt. ratio) dried in an Atritior dryer.

| Feed Bag | Feed Bag total | Refiner solids | Energy kWh/T | Total solids | POP wt. % | FLT Index Nm/g | gsm | Viscosity mPas | Total Nib Surface |
|---|---|---|---|---|---|---|---|---|---|
| Atritor product bag | 50.8 | 7 | as rec'd | 51.4 | 50.6 | [8.1] | [226] | [1340] | [2] |
| 6 50 POP | | | 0 | 6.9 | 50.5 | 5.6 | 198 | 660 | — |
| IC60/Botnia | | | 20 | 6.5 | 49.7 | 8.0 | 234 | 1480 | 3 |
| | | | 40 | 6.5 | 49.9 | 9.3 | 228 | 1540 | 2 |
| | | | 60 | 6.7 | 49.9 | 9.9 | 220 | 1480 | 1 |
| | | | 80 | 6.3 | 49.9 | 11.3 | 228 | 1680 | 0 |
| | | | 100 | 6.9 | 50.2 | 10.7 | 218 | 1420 | 0 |

This 51.4 wt. % dried composition dried in the Atritor dryer can be totally re-dispersed using 60 kWh/t and the properties improve even further with increased energy input. This material regains viscosity and FLT Index as well as having a relatively low nib count similar to the belt pressed cake.

Table 18 shows the effect the single disc refiner has had upon the particle size of the composition comprising microfibrillated cellulose and calcium carbonate (1:1 wt. ratio).

TABLE 18

PSD properties of the single disc refined 51.4 wt. % composition comprising microfibrillated cellulose and calcium carbonate (1:1 wt. ratio) dried in the Atritor dryer.

| | | | | Malvern Insitec | | | | | Fractionation | | | |
|---|---|---|---|---|---|---|---|---|---|---|---|---|
| Trial ID | Refiner solids wt. % | Energy kWh/T | Total solids wt. % | D10 | D30 | D50 | D70 | D90 | −25 um | +25-150 um | +150-300 um | +300 um |
| Atritor product bag | 7 | as rec'd | 51.4 | 10.0 | 37.9 | 90.1 | 184.3 | 416.6 | 22.8 | 41.5 | 18.6 | 17.2 |
| 6 50 POP | | 0 | 6.9 | 8.6 | 32.2 | 80.4 | 165.5 | 368.4 | 25.4 | 41.8 | 18.2 | 14.6 |
| IC6O/Botnia | | 20 | 6.5 | 10.6 | 35.6 | 83.0 | 170.6 | 397.3 | 23.2 | 43.3 | 17.7 | 15.9 |
| | | 40 | 6.5 | 10.1 | 32.1 | 72.7 | 144.6 | 329.2 | 24.7 | 46.3 | 17.1 | 11.9 |
| | | 60 | 6.7 | 9.1 | 28.3 | 62.8 | 122.6 | 271.9 | 27.2 | 48.5 | 16.0 | 8.3 |
| | | 80 | 6.3 | 9.0 | 26.7 | 57.4 | 110.3 | 242.1 | 28.4 | 50.6 | 14.6 | 6.5 |
| | | 100 | 6.9 | 8.3 | 24.2 | 50.7 | 97.8 | 214.3 | 30.8 | 51.2 | 13.1 | 4.8 |

It can be seen from the PSD values that the single disc refiner is very efficient in reducing the coarse particles of the microfibrillated cellulose and calcium carbonate 1:1 wt. ratio composition.

3. 50 wt. % POP Calcium Carbonate (IC60)/Botnia Pulp Microfibrillated Cellulose and Calcium Carbonate 1:1 wt. Ratio Composition Dried in an Atritor Dryer (58.1 wt. % Solids).

This 58.1 wt. % solids composition comprising microfibrillated cellulose and calcium carbonate (1:1 wt. ratio) was evaluated at 7, 8 and 9 wt % solids. The reason for this was that the higher energy inputs could not be achieved because the composition comprising microfibrillated cellulose and calcium carbonate became too "thin" in consistency and the metal disc of the refiner was rubbing on itself. Table 19 below shows the properties of all the products at the three different solids contents. The values quoted for the as rec'd material and 0 kWh/t have been subjected to 1 minute of mixing in a Silverson mixer, which equates to 1000-2000 kWh/t.

TABLE 19

Properties of the single disc refined 58.1 wt. % Atritor product

| Feed Bag | Feed Bag total | Refiner solids | Energy kWh/T | Total solids | POP wt. % | FLT Index Nm/g | gsm | Viscosity mPas | Total Nib Surface |
|---|---|---|---|---|---|---|---|---|---|
| Atritor product bag | 57.9 | 7 | as rec'd | 58.1 | 47.6 | [7.1] | [223] | [940] | [2] |
| 3 50 POP | | | 0 | 6.0 | 47.1 | [5.9] | [209] | [640] | — |
| IC60/Botnia | | | 20 | 6.4 | 47.0 | 3.9 | 223 | 540 | — |
| | | | 40 | 7.1 | 46.9 | 6.7 | 224 | 940 | — |
| | | | 60 | 6.8 | 47.0 | 8.4 | 225 | 1140 | 2 |
| | 57.9 | 8 | 0 | 7.7 | 47.0 | [5.8] | [199] | [560] | — |
| | | | 20 | 7.9 | 46.9 | 4.7 | 223 | 640 | — |
| | | | 40 | 8.0 | 46.9 | 7.3 | 224 | 960 | — |
| | | | 60 | 7.8 | 47.1 | 8.8 | 222 | 1120 | 1 |
| | | | 80 | 8.6 | 47.0 | 9.1 | 214 | 1040 | 1 |
| | 57.9 | 9 | 0 | 8.0 | 47.2 | [6.0] | [211] | [680] | — |
| | | | 20 | 7.1 | 47.0 | 4.7 | 216 | 640 | — |
| | | | 40 | 7.8 | 47.0 | 8.4 | 225 | 1080 | 2 |
| | | | 60 | 8.4 | 47.2 | 8.6 | 220 | 1120 | 1 |
| | | | 80 | 8.5 | 47.0 | 9.6 | 222 | 1160 | 1 |
| | | | 100 | 9.1 | 47.0 | 9.9 | 215 | 1160 | 1 |

The 58.1 wt. % composition comprising microfibrillated cellulose and calcium carbonate (1:1 wt. ratio) can be totally re-dispersed at 7, 8 and 9 wt. % solids. At each consistency the control FLT has been exceeded as well as the viscosity and nib count. At 9 wt. % solids the greatest enhancement is achieved.

Table 20 shows the effect the single disc refiner has had upon the particle size of the composition comprising microfibrillated cellulose and calcium carbonate (1:1 wt. ratio) at all three solids content levels.

Once again the PSD data show the efficiency of the single disc refiner on altering size of the coarse pulp at all three consistencies.

TABLE 20

PSD properties of the Single Disc Refined 58.1 wt. % of microfibrillated cellulose (1:1 wt. ratio) composition dried in an Atritor dryer.

| | | | | Malvern Insitec | | | | | Fractionation | | | |
|---|---|---|---|---|---|---|---|---|---|---|---|---|
| Trial ID | Refiner solids wt. % | Energy kWh/T | Total solids wt. % | D10 | D30 | D50 | D70 | D90 | −25 um | +25-150 um | +150-300 um | +300 um |
| Atritor product bag | 7 | as rec'd | 58.1 | 9.9 | 32.4 | 77.2 | 155.3 | 341.6 | 24.8 | 44.2 | 18.3 | 12.7 |
| 3 50 POP | | 0 | 6.0 | 9.2 | 28.1 | 67.1 | 137.5 | 302.0 | 27.4 | 45.1 | 17.4 | 10.1 |
| IC60/Botnia | | 20 | 6.4 | 9.7 | 31.3 | 76.6 | 166.5 | 397.9 | 25.4 | 41.8 | 17.1 | 15.7 |
| | | 40 | 7.1 | 9.1 | 26.7 | 59.8 | 121.9 | 275.6 | 28.4 | 47.3 | 15.7 | 8.6 |
| | | 60 | 6.8 | 8.5 | 24.5 | 52.3 | 103.3 | 224.1 | 30.5 | 50.1 | 14.0 | 5.4 |
| | 8 | 0 | 7.7 | 9.2 | 29.6 | 71.4 | 146.1 | 322.6 | 26.5 | 44.2 | 17.7 | 12.1 |
| | | 20 | 7.9 | 9.4 | 28.7 | 67.6 | 146.3 | 363.7 | 26.9 | 43.7 | 15.8 | 13.6 |
| | | 40 | 8.0 | 8.5 | 24.3 | 52.1 | 104.3 | 232.5 | 30.7 | 49.3 | 14.1 | 6.0 |
| | | 60 | 7.8 | 8.1 | 23.1 | 48.4 | 95.4 | 206.0 | 32.1 | 50.7 | 12.8 | 4.4 |
| | | 80 | 8.6 | 7.5 | 21.3 | 42.9 | 83.6 | 176.7 | 34.7 | 51.7 | 10.7 | 2.8 |
| | 9 | 0 | 8.0 | 9.4 | 29.9 | 72.6 | 148.5 | 332.0 | 26.3 | 44.0 | 17.7 | 12.1 |
| | | 20 | 7.1 | 9.4 | 29.2 | 69.5 | 147.5 | 351.1 | 26.7 | 43.8 | 16.6 | 12.9 |
| | | 40 | 7.8 | 8.9 | 24.8 | 52.6 | 105.2 | 233.7 | 30.2 | 49.6 | 14.1 | 6.1 |

TABLE 20-continued

PSD properties of the Single Disc Refined 58.1 wt. % of microfibrillated cellulose (1:1 wt. ratio) composition dried in an Atritor dryer.

| | | | | Malvern Insitec | | | | | Fractionation | | | |
|---|---|---|---|---|---|---|---|---|---|---|---|---|
| Trial ID | Refiner solids wt. % | Energy kWh/T | Total solids wt. % | D10 | D30 | D50 | D70 | D90 | −25 um | +25-150 um | +150-300 um | +300 um |
| | | 60 | 8.4 | 7.9 | 22.5 | 46.8 | 90.7 | 190.5 | 32.9 | 51.7 | 11.9 | 3.5 |
| | | 80 | 8.5 | 7.4 | 20.9 | 42.0 | 81.7 | 168.4 | 35.3 | 52.1 | 10.1 | 2.5 |
| | | 100 | 9.1 | 6.9 | 19.6 | 38.5 | 74.6 | 153.9 | 37.4 | 52.1 | 8.8 | 1.8 |

4. 50 wt. % POP Calcium Carbonate (IC60)/Botnia Pulp Microfibrillated Cellulose and Calcium Carbonate Composition Dried in an Atritor Dryer (70.1 wt. % Solids).

This 70.1 wt. % solids microfibrillated cellulose and calcium carbonate (1:1 wt. ratio) composition at each work input are shown in Table 21. The values quoted for the as rec'd material and 0 kWh/t have been subjected to 1 minute of mixing in a Silverson mixer, which equates to 1000-2000 kWh/t.

TABLE 21

Properties of the single disc refined 70.1 wt. % microfibrillated cellulose and calcium carbonate (1:1 wt. ratio) composition dried in an Atritor dryer.

| Feed Bag | Feed Bag total | Refiner solids | Energy kWh/T | Total solids | POP wt. % | FLT Index Nm/g | gsm | Viscosity mPas | Total Nib Surface |
|---|---|---|---|---|---|---|---|---|---|
| Atritor product bag | 70.1 | 9 | as rec'd | 69.5 | 47.3 | [4.9] | [225] | [640] | [2] |
| 2 50 POP | | | 0 | 7.6 | 47.2 | [3.5] | [193] | [340] | — |
| IC60/Botnia | | | 20 | 7.6 | 46.9 | 2.7 | 219 | 400 | — |
| | | | 40 | 9.1 | 46.9 | 5.1 | 218 | 620 | — |
| | | | 60 | 10.0 | 47.1 | 6.7 | 216 | 720 | — |
| | | | 80 | 9.7 | 47.1 | 7.3 | 219 | 760 | 1 |
| | | | 100 | 9.5 | 47.0 | 8.4 | 218 | 920 | 0 |

Once again it can be seen that the single disc refiner is much more efficient in re-dispersing the dried composition comprising microfibrillated cellulose and calcium carbonate (1:1 wt. ratio) compared to using a Silverson mixer. An energy input of 100 kWh/t re-disperses the composition comprising microfibrillated cellulose and calcium carbonate (1:1 wt. ratio) to a degree where the properties are similar to the belt pressed cake.

Table 22 shows the effect the single disc refiner has had upon the particle size of the composition comprising microfibrillated cellulose and calcium carbonate (1:1 wt. ratio) and once again the refiner is shown to be very efficient.

TABLE 22

PSD properties of the single disc refined 70.1 wt. % composition comprising microfibrillated cellulose and calcium carbonate (1:1 wt. ratio) dried in an Atritor dryer.

| | | | | Malvern Insitec | | | | | Fractionation | | | |
|---|---|---|---|---|---|---|---|---|---|---|---|---|
| Trial ID | Refiner solids wt. % | Energy kWh/T | Total solids wt. % | D10 | D30 | D50 | D70 | D90 | −25 um | +25-150 um | +150-300 um | +300 um |
| Atritor product bag | 9 | as rec'd | 69.5 | 10.8 | 38.9 | 96.7 | 200.0 | 436.5 | 22.3 | 39.6 | 19.4 | 18.8 |
| 2 50 POP | | 0 | 7.6 | 9.2 | 30.7 | 77.5 | 161.8 | 352.9 | 26.0 | 41.9 | 18.6 | 13.5 |
| IC60/Botnia | | 20 | 7.6 | 10.4 | 35.5 | 89.0 | 193.6 | 451.3 | 23.5 | 39.8 | 17.8 | 18.9 |
| | | 40 | 9.1 | 8.7 | 26.0 | 58.5 | 119.3 | 268.4 | 29.0 | 47.2 | 15.7 | 8.1 |
| | | 60 | 10.0 | 7.9 | 22.8 | 48.3 | 95.4 | 202.6 | 32.4 | 50.6 | 12.8 | 4.2 |
| | | 80 | 9.7 | 7.5 | 21.2 | 42.9 | 83.7 | 174.7 | 34.8 | 51.9 | 10.6 | 2.8 |
| | | 100 | 9.5 | 7.4 | 20.4 | 39.4 | 75.1 | 156.3 | 36.3 | 52.8 | 9.0 | 1.9 |

5. 50 wt. % POP Calcium Carbonate (IC60)/Botnia Pulp Composition Comprising Microfibrillated Cellulose and Calcium Carbonate (1:1 wt. Ratio) Dried in an Atritor Dryer (86.2 wt. % Solids).

This material at 86.2 wt. % solids composition comprising microfibrillated cellulose and calcium carbonate (1:1 wt. ratio) was deemed to be very dry so the composition was refined under the same conditions as the rest of the materials (intensity of 0.2 J/m) but also at an intensity of 0.1 J/m. 0.1 J/m is less intense so it takes longer to achieve the desired work input. See, Table 23.

The values quoted for the as received material and 0 kWh/t have been subjected to 1 minute of mixing in a Silverson mixer, which equates to 1000-2000 kWh/t.

TABLE 23

Properties of the single disc refined 86.2 wt. % composition comprising microfibrillated cellulose and calcium carbonate (1:1 wt. ratio) dried in an Atritor dryer.

| Feed Bag | Feed Bag total | Refiner solids | Energy kWh/T | Total solids | POP wt. % | FLT Index Nm/g | gsm | Viscosity mPas | Total Nib Surface |
|---|---|---|---|---|---|---|---|---|---|
| Atritor product bag | 86.2 | 9 | as rec'd | 87.5 | 46.7 | [3.6] | [221] | [480] | [2] |
| 1 50 POP | | Intensity | 0 | 4.8 | 46.6 | [4.2] | [253] | [740] | — |
| IC60/Botnia | | 0.2 | 20 | 7.3 | 46 | 2.3 | 217 | 320 | — |
| | | | 40 | 9.5 | 47.4 | 4.2 | 220 | 500 | — |
| | | | 60 | 9.4 | 46.1 | 5.7 | 218 | 640 | — |
| | | | 80 | 9.8 | 46.1 | 7.0 | 219 | 740 | 1 |
| | | | 100 | 9.4 | 46.2 | 7.9 | 221 | 880 | 1 |
| Atritor product bag | 86.2 | 9 | as rec'd | 87.5 | 46.7 | [3.6] | [221] | [480] | [2] |
| 1 50 POP | | Intensity | 0 | 6.0 | 46.5 | [2.2] | [196] | [240] | — |
| IC60/Botnia | | 0.1 | 20 | 8.7 | 45.9 | 4.3 | 219 | 480 | — |
| | | | 40 | 9.7 | 46.1 | 6.4 | 215 | 680 | — |
| | | | 60 | 9.3 | 45.9 | 7.9 | 225 | 940 | 0 |
| | | | 80 | 10.2 | 45.9 | 8.4 | 215 | 840 | 0 |

These results show that this very high solids composition comprising microfibrillated cellulose and calcium carbonate (1:1 wt. ratio) can be re-dispersed back to the same properties as the belt pressed cake using 100 kWh/t. If the intensity is changed then the properties can be restored using less energy of 80 kWh/t.

Table 24 shows the effect the single disc refiner has had upon the particle size of the composition comprising microfibrillated cellulose and calcium carbonate (1:1 wt. ratio) at both intensities.

TABLE 24

PSD properties of the single disc refined 86.2 wt. % composition comprising microfibrillated cellulose and calcium carbonate (1:1 wt. ratio) dried in an Atritor dryer.

| | | | | Malvern Insitec | | | | | Fractionation | | | |
|---|---|---|---|---|---|---|---|---|---|---|---|---|
| Trial ID | Refiner solids wt. % | Energy kWh/T | Total solids wt. % | D10 | D30 | D50 | D70 | D90 | −25 um | +25-150 um | +150-300 um | +300 um |
| Atritor product bag | 9 | as rec'd | 87.5 | 10.2 | 37.4 | 97.7 | 212.0 | 450.9 | 23.1 | 37.6 | 19.0 | 20.3 |
| 1 50 POP | Intensity | 0 | 4.8 | 11.2 | 37.3 | 95.4 | 206.1 | 442.5 | 22.7 | 38.8 | 19.0 | 19.6 |
| IC50/Botnia | 0.2 | 20 | 7.3 | 9.6 | 34.0 | 88.5 | 197.0 | 468.4 | 24.4 | 38.5 | 17.7 | 19.4 |
| | | 40 | 9.5 | 8.3 | 24.9 | 56.5 | 117.1 | 266.7 | 30.1 | 46.6 | 15.4 | 8.0 |
| | | 60 | 9.4 | 7.8 | 22.1 | 46.1 | 92.0 | 198.3 | 33.5 | 50.2 | 12.4 | 4.0 |
| | | 80 | 9.8 | 7.3 | 20.5 | 41.2 | 81.1 | 176.8 | 35.9 | 50.8 | 10.1 | 3.3 |
| | | 100 | 9.4 | 6.9 | 19.2 | 36.7 | 70.4 | 145.5 | 38.3 | 52.2 | 7.9 | 1.6 |
| Atritor product bag | 9 | as rec'd | 87.5 | 10.2 | 37.4 | 97.7 | 212.0 | 450.9 | 23.1 | 37.6 | 19.0 | 20.3 |
| 1 50 POP | Intensity | 0 | 6.0 | 9.1 | 32.6 | 88.6 | 190.8 | 394.7 | 25.3 | 38.0 | 19.7 | 17.0 |
| IC6O/Botnia | 0.1 | 20 | 8.7 | 8.6 | 26.9 | 63.4 | 132.1 | 298.8 | 28.3 | 45.2 | 16.6 | 9.9 |
| | | 40 | 9.7 | 7.6 | 21.7 | 45.1 | 90.1 | 195.7 | 34.0 | 50.1 | 11.8 | 4.1 |
| | | 60 | 9.3 | 7.1 | 20.2 | 40.7 | 80.3 | 167.8 | 36.2 | 51.3 | 9.8 | 2.7 |
| | | 80 | 10.2 | 6.5 | 18.6 | 35.5 | 69.1 | 142.2 | 39.4 | 51.6 | 7.6 | 1.4 |

FIG. 1. summarises the FLT data from the above studies. The data show that the control FLT can be achieved in all the samples tested and that the control FLT can be exceeded in the intermediate solid products.

6. Further Processing of Refined Products

On a number of the products produced at pilot plant facility extra energy was put into the samples via the Silverson mixer. These experiments were to investigate whether the physical properties of the composition comprising microfibrillated cellulose and calcium carbonate (1:1 wt. ratio) would be improved with extra energy. The following table shows the findings, (Table 25).

It can be seen that the results are mixed. On some occasions there is an increase in FLT Index and on others there is not.

TABLE 25

The effect of extra energy input

| Feed Bag | Feed Bag total solids wt. % | Refiner solids wt. % | Energy kWh/T | Total solids | POP wt. % | NO Silverson FLT Index Nm/g | 0.5 minute FLT Index Nm/g | 1 minute FLT Index Nm/g | 2 minutes FLT Index Nm/g | 3 minutes FLT Index Nm/g |
|---|---|---|---|---|---|---|---|---|---|---|
| 50 POP IC60 | 30.5 | 7 | as rec'd | 30.8 | 49.2 | — | 7.5 | 8.5 | 8.8 | 9.2 |
| Beltpress cake | | | 0 | 6.4 | 49.0 | 5.5 | — | 8.8 | — | — |
| 50 POP IC60/Botnia | 30.5 | 6 | as rec'd | 30.8 | 49.2 | — | 7.5 | 8.5 | 8.8 | 9.2 |
| Beltpress cake | | | 0 | 5.3 | 49.0 | — | — | 9.2 | — | — |
| | | | 20 | 5.9 | 49.0 | 9.7 | 10.2 | 11.2 | — | — |
| | | | 40 | 5.7 | 49.1 | 8.5 | 10.0 | 9.0 | — | — |
| | | | 60 | 5.9 | 49.0 | 10.4 | 10.6 | 11.1 | — | — |
| | | | 80 | 6.0 | 49.2 | 10.6 | 10.8 | 11.0 | — | — |
| | | | 100 | 6.0 | 49.2 | 11.3 | 11.4 | 11.1 | 11.0 | 11.3 |
| Atritor product bag & | 50.8 | 7 | as rec'd | 51.4 | 50.6 | — | 7.2 | 8.1 | 8.5 | 9.0 |
| 50 POP | | | 0 | 6.9 | 50.5 | — | — | 5.6 | — | — |
| IC6O/Botnia | | | 20 | 6.5 | 49.7 | 8.0 | — | — | — | — |
| | | | 40 | 6.5 | 49.9 | 9.3 | — | — | — | — |
| | | | 60 | 6.7 | 49.9 | 9.9 | — | — | — | — |
| | | | 80 | 6.3 | 49.9 | 11.3 | — | — | 12.2 | 11.9 |
| | | | 100 | 6.9 | 50.2 | 10.7 | — | — | — | — |
| Atritor product bag 3 | 57.9 | 7 | as rec'd | 58.1 | 47.6 | — | 5.3 | 7.1 | 7.3 | 8.4 |
| 50 POP IC60/Botnia | | | 0 | 6.0 | 47.1 | — | — | 5.9 | — | — |
| | | | 20 | 6.4 | 47.0 | 3.9 | — | — | — | — |
| | | | 40 | 7.1 | 46.9 | 6.7 | — | — | — | — |
| | | | 60 | 6.8 | 47.0 | 8.4 | — | — | — | — |
| | 57.9 | 8 | 0 | 7.7 | 47.0 | — | — | 5.8 | — | — |
| | | | 20 | 7.9 | 46.9 | 4.7 | — | — | — | — |
| | | | 40 | 8.0 | 46.9 | 7.3 | — | — | — | — |
| | | | 60 | 7.8 | 47.1 | 8.8 | — | — | — | — |
| | | | 80 | 6.6 | 47.0 | 9.1 | — | — | — | — |
| | 57.9 | 9 | 0 | 8.0 | 47.2 | — | — | 6 | — | — |
| | | | 20 | 7.1 | 47.0 | 4.7 | — | — | — | — |
| | | | 40 | 7.8 | 47.0 | 8.4 | — | — | — | — |
| | | | 60 | 8.4 | 47.2 | 8.6 | — | — | — | — |
| | | | 80 | 8.5 | 47.0 | 9.6 | — | — | — | — |
| | | | 100 | 9.1 | 47.0 | 9.9 | — | — | — | — |
| Atritor product bag 2 | 70.1 | 9 | as rec'd | 69.5 | 47.3 | — | 3.3 | 4.9 | 5.9 | 6.6 |
| 50 POP IC60/Botnia | | | 0 | 7.6 | 47.2 | — | — | 3.5 | — | — |
| | | | 20 | 7.6 | 46.9 | 2.7 | — | — | — | — |
| | | | 40 | 9.1 | 46.9 | 5.1 | — | — | — | — |
| | | | 60 | 10.0 | 47.1 | 6.7 | — | — | — | — |
| | | | 80 | 9.7 | 47.1 | 7.3 | — | — | — | — |
| | | | 100 | 9.5 | 47.0 | 8.4 | 8.2 | 8.4 | 8.7 | 8.7 |
| Atritor product bag 1 | 86.2 | 9 | as rec'd | 87.5 | 46.7 | — | 2.2 | 3.6 | 4.6 | 5 |
| 50 POP IC60/Botnia | | Intensity | 0 | 4.8 | 46.6 | — | — | 4.2 | — | — |
| | | 0.2 | 20 | 7.3 | 46 | 2.3 | 4.6 | 5.6 | — | — |
| | | | 40 | 9.5 | 47.4 | 4.2 | 5.5 | 6.3 | — | — |
| | | | 60 | 9.4 | 46.1 | 5.7 | 6.9 | 7.2 | — | — |
| | | | 80 | 9.8 | 46.1 | 7.0 | 7.7 | 8.3 | — | — |
| | | | 100 | 9.4 | 46.2 | 7.9 | 8.7 | 9 | — | — |
| Atrftor product bag 1 | 86.2 | 9 | as rec'd | 87.5 | 46.7 | — | 2.2 | 3.6 | — | — |
| 50 POP IC60/Botnia | | intensity | 0 | 6.0 | 46.5 | — | — | 2.2 | — | — |
| | | 0.1 | 20 | 8.7 | 45.9 | 4.3 | 5.8 | 6.3 | — | — |
| | | | 40 | 9.7 | 46.1 | 6.4 | 7.0 | 7.4 | — | — |
| | | | 60 | 9.3 | 45.9 | 7.9 | 9.0 | 8.9 | — | — |
| | | | 80 | 10.2 | 45.9 | 8.4 | 8.7 | 8.8 | 8.4 | 8.2 |

Results.

The results show:

The single disc refiner at pilot plant facility is a very efficient way of re-dispersing a composition comprising microfibrillated cellulose and calcium carbonate (1:1 wt. ratio)

A composition comprising microfibrillated cellulose and calcium carbonate (1:1 wt. ratio) dried up to 86 wt. % solids can be re-dispersed to achieve its original strength characteristics.

An enhancement on strength can be achieved.

The single disc refiner achieves re-dispersion using low energy inputs than other evaluated methods.

The solids content is very important when refining and should be optimised for all samples.

Lowering the intensity of the refiner achieves improved results.

The single disc refiner is very efficient in altering the PSD of a composition comprising microfibrillated cellulose and calcium carbonate (1:1 wt. ratio).

Ultrasonic Treatment of MFC

Example 12

The Effect of an Ultrasonic Bath on Various FiberLean® MFC Product Forms

The first study was to investigate the effect of using a laboratory Fisher brand FB11005 ultrasonic water bath on various FiberLean® MFC product forms. The FiberLean® MFC was a 50 POP IC60/Botnia mix in the form of a slurry, belt pressed cake and a High solids dried 50 wt. % solids product. The samples were diluted to make a 20% POP (Percentage Of Pulp—The POP or Percentage of Pulp is the percentage of the dry weight of the sample that is pulp or fibrils rather than inorganic particulate material) suspension at 6.25 wt. % solids. Each sample was subjected to various times within the ultrasonic bath and then subjected to 1 minute on the laboratory Silverson mixer at 7500 rpm; subsequent FLT (Nm/g: measurement of tensile strength) and viscosity measurements were made.

The FLT index is a tensile test developed to assess the quality of microfibrillated cellulose and re-dispersed microfibrillated cellulose. The POP of the test material is adjusted to 20% by adding whichever inorganic particulate was used in the production of the microfibrillated cellulose/inorganic material composite (in the case of inorganic particulate free microfibrillated cellulose then 60 wt. %<2 μm GCC calcium carbonate is used). A 220 gsm sheet is formed from this material using a bespoke Buchner filtration apparatus The resultant sheet is conditioned and its tensile strength measured using an industry standard tensile tester.

Figure 2:
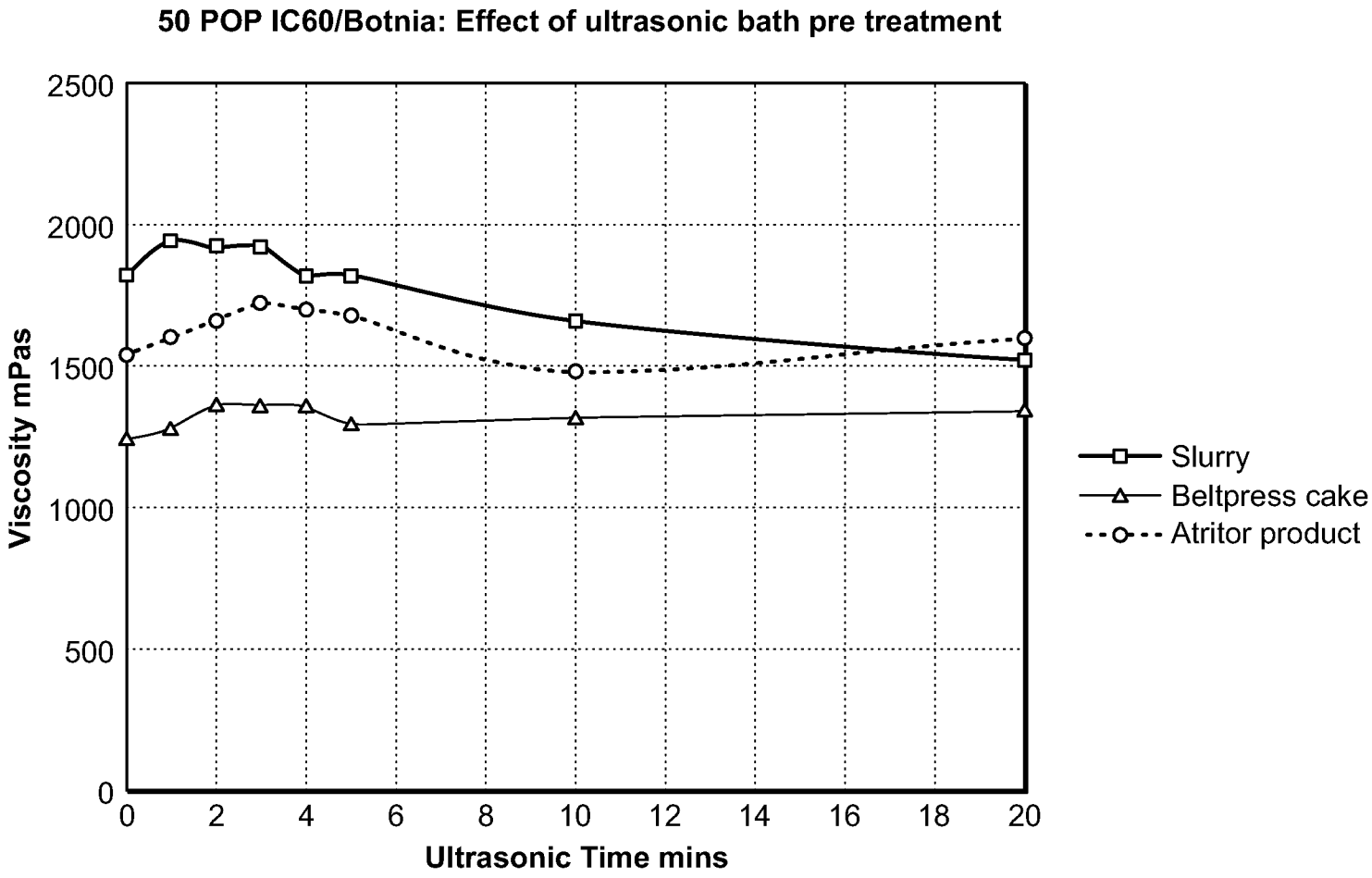
FIG. 2 shows the effect of exposure to an ultrasonic bath on MFC viscosity.

FIG. 2 shows the effect upon the viscosity of the FiberLean® MFC slurries. It can be seen that within the first 5 minutes a small increase in the viscosity was observed. Tables 26-29 show strength properties of the FiberLean® MFC after ultrasonic bath treatment. It can be seen that the strength of the materials as measured by the FLT Index method have not changed dramatically. The use of the ultrasonic bath for the re-dispersion of the FiberLean® MFC or improvements in quality is not recommended. The low power input does not affect the strength properties but does influence the viscosity slightly.

TABLE 26

Slurry properties

| Sample | Time in US bath mins | Viscosity mPas | FLT Index Nm/g |
|---|---|---|---|
| 50 POP IC60/ Botnia slurry | 0 | 1820 | 9.4 |
| | 1 | 1940 | 8.7 |
| | 2 | 1920 | 8.6 |
| | 3 | 1920 | 8.7 |
| | 4 | 1820 | 8.5 |
| | 5 | 1820 | 8.8 |
| | 10 | 1660 | 8.9 |
| | 20 | 1520 | 9.0 |

TABLE 27

Belt pressed cake properties

| Sample | Time in US bath mins | Viscosity mPas | FLT Index Nm/g |
|---|---|---|---|
| 50 POP IC60/ Botnia belt press cake | 0 | 1240 | 7.7 |
| | 1 | 1280 | 8.2 |
| | 2 | 1360 | 8.2 |
| | 3 | 1360 | 8.1 |
| | 4 | 1360 | 8.5 |
| | 5 | 1300 | 8.0 |
| | 10 | 1320 | 7.4 |
| | 20 | 1340 | 7.5 |

TABLE 28

High solids dried 50 wt % properties

| Sample | Time in US bath | Viscosity mPas | FLT Index Nm/g |
|---|---|---|---|
| 50 POP IC60/Botnia product @ 50% solids | 0 | 1540 | 5.0 |
| | 1 | 1600 | 8.2 |
| | 2 | 1660 | 9.1 |
| | 3 | 1720 | 8.5 |
| | 4 | 1700 | 9.1 |
| | 5 | 1680 | 9.2 |
| | 10 | 1480 | 9.0 |
| | 20 | 1600 | 5.3 |

TABLE 29

High solids dried 60 wt % properties

| Sample | Time in US bath | Viscosity mPas | FLT Index Nm/g |
|---|---|---|---|
| 50 POP IC60/Botnia product @ 60% solids | 0 | 1100 | 6.8 |
| | 1 | 1220 | 7.3 |
| | 2 | 1020 | 7.2 |
| | 3 | 1100 | 6.7 |
| | 4 | 1100 | 6.8 |
| | 5 | 1180 | 6.7 |
| | 10 | 1120 | 7.0 |
| | 20 | 1100 | 6.9 |

Example 13

The Effect of an Ultrasonic Probe on FiberLean® MFC Slurry

This experiment was to explore the effect that an ultrasonic probe has upon a FiberLean® MFC slurry. The ultrasonic probes used within Imerys Par Moor Centre are "Sonics Vibracell VCX500 500 Watt model" with a "Probe horn CV33" and are used for the dispersion of mineral slurries prior to particle size measurement. The probe (Horn) is specifically designed to operate at an Amplitude of 40% but for this and further experiment it has been operated up to 100%.

The 50% POP IC60/Botnia slurry at a total solids content of 1.7 wt. % was diluted to 20% POP with an IC60 carbonate (70 wt. % solids) slurry. This made the total solids of the samples 4.24 wt. %.

Figure 3:
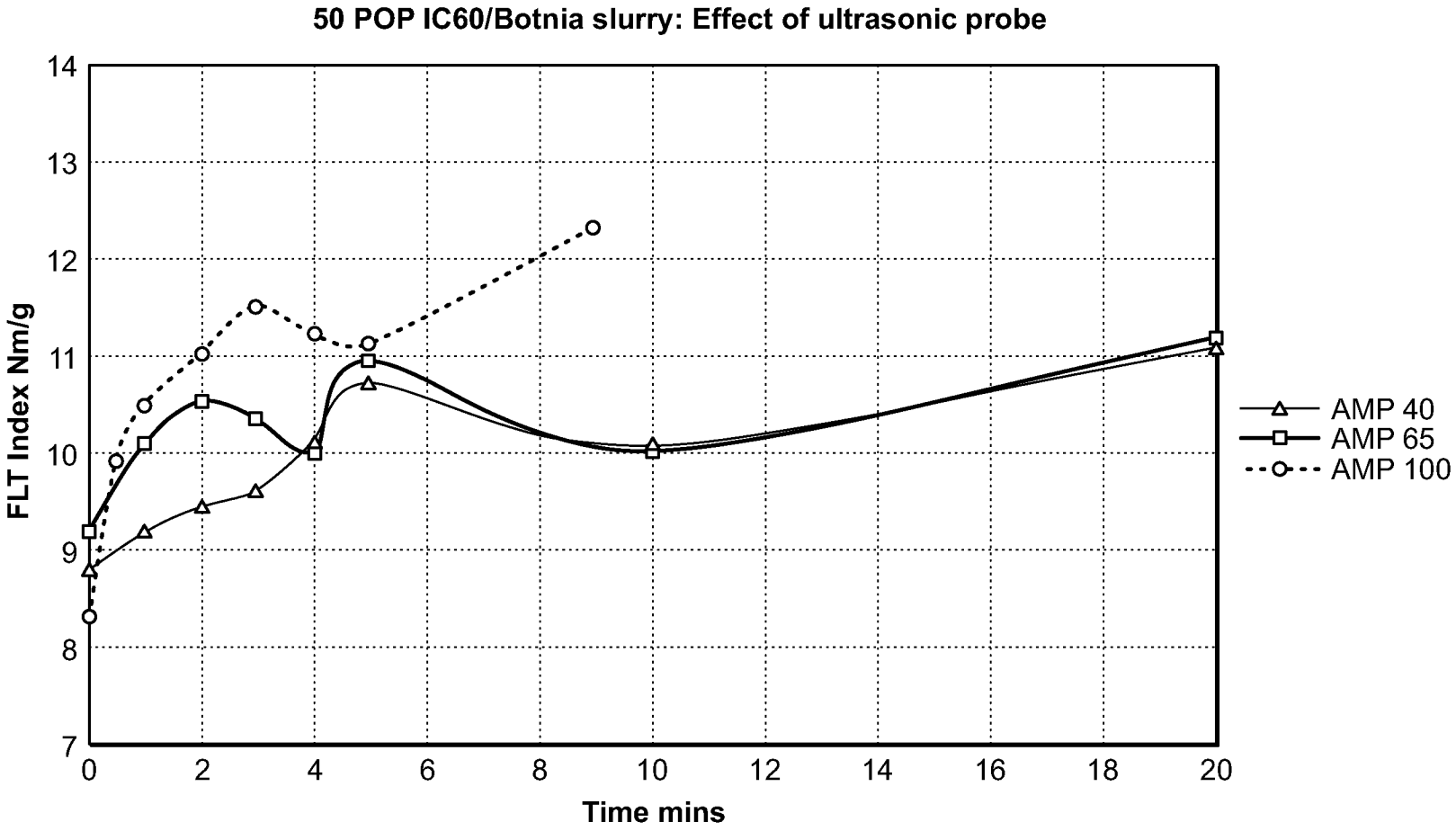
FIG. 3 shows the effect of exposure to an ultrasonic probe on FLT index (Nm/g).
Figure 4:
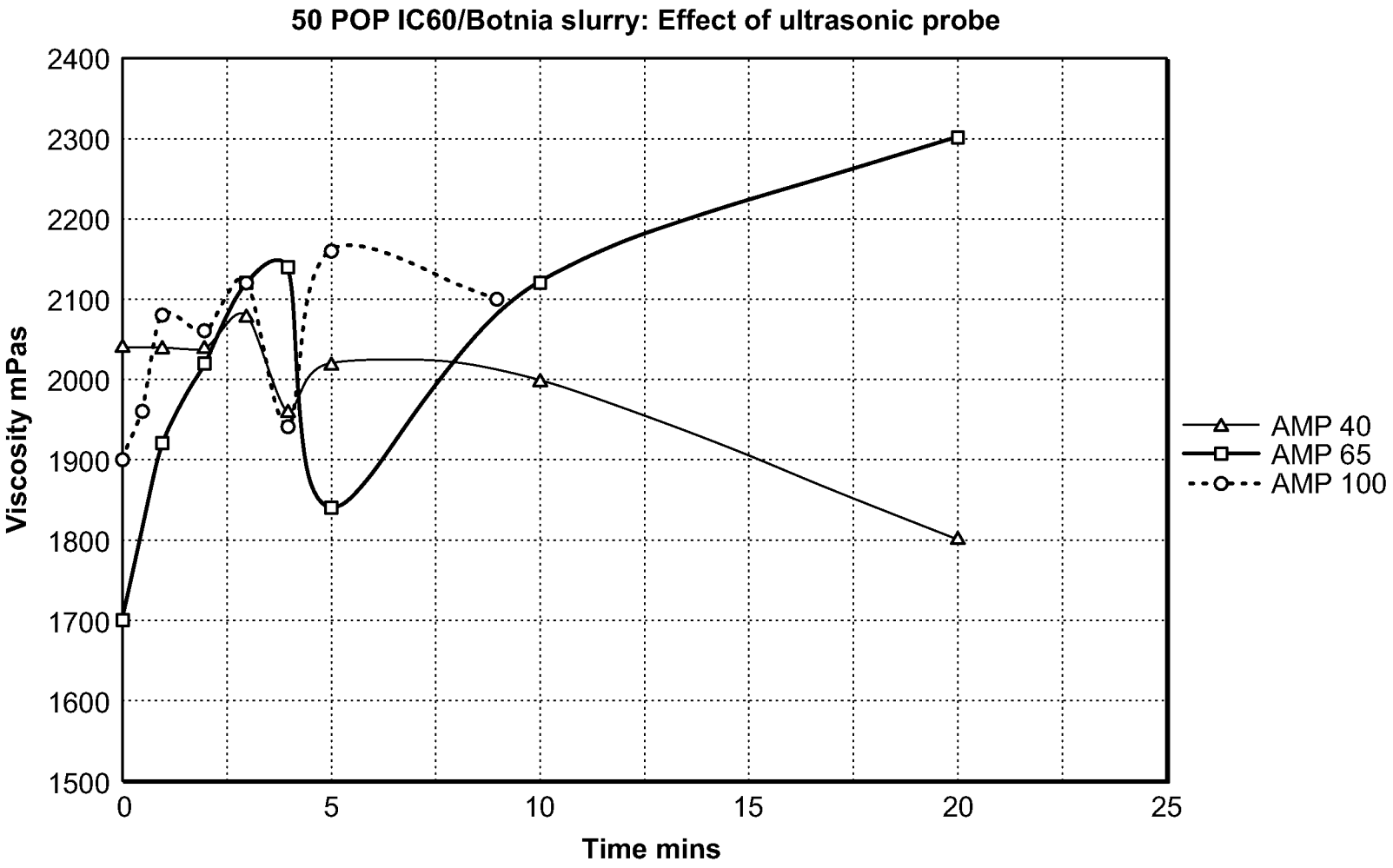
FIG. 4 shows the effect of exposure to an ultrasonic probe on MFC viscosity.

The ultrasonic probe was immersed into the slurry and was subjected to various times of ultrasound at various Amplitudes. FIGS. 3 and 4 highlight the increase in FLT Index (Nm/g: measurement of tensile strength) and viscosity. It can be seen in the figures that the higher the Amplitude the greater the increase in tensile strength. At 100% Amplitude a 20% increase in FLT Index can be achieved within 30 seconds compared to the original slurry. Compared to the original slurry a 33% increase within 2 minutes of applied ultrasound can be achieved. At the reduced Amplitude of 65%, the increase in FLT Index was 14% after 2 minutes of ultrasound compared to the feed slurry.

Example 14

The Effect of Pulsed Ultrasound on FiberLean® MFC Slurry

Figure 5:
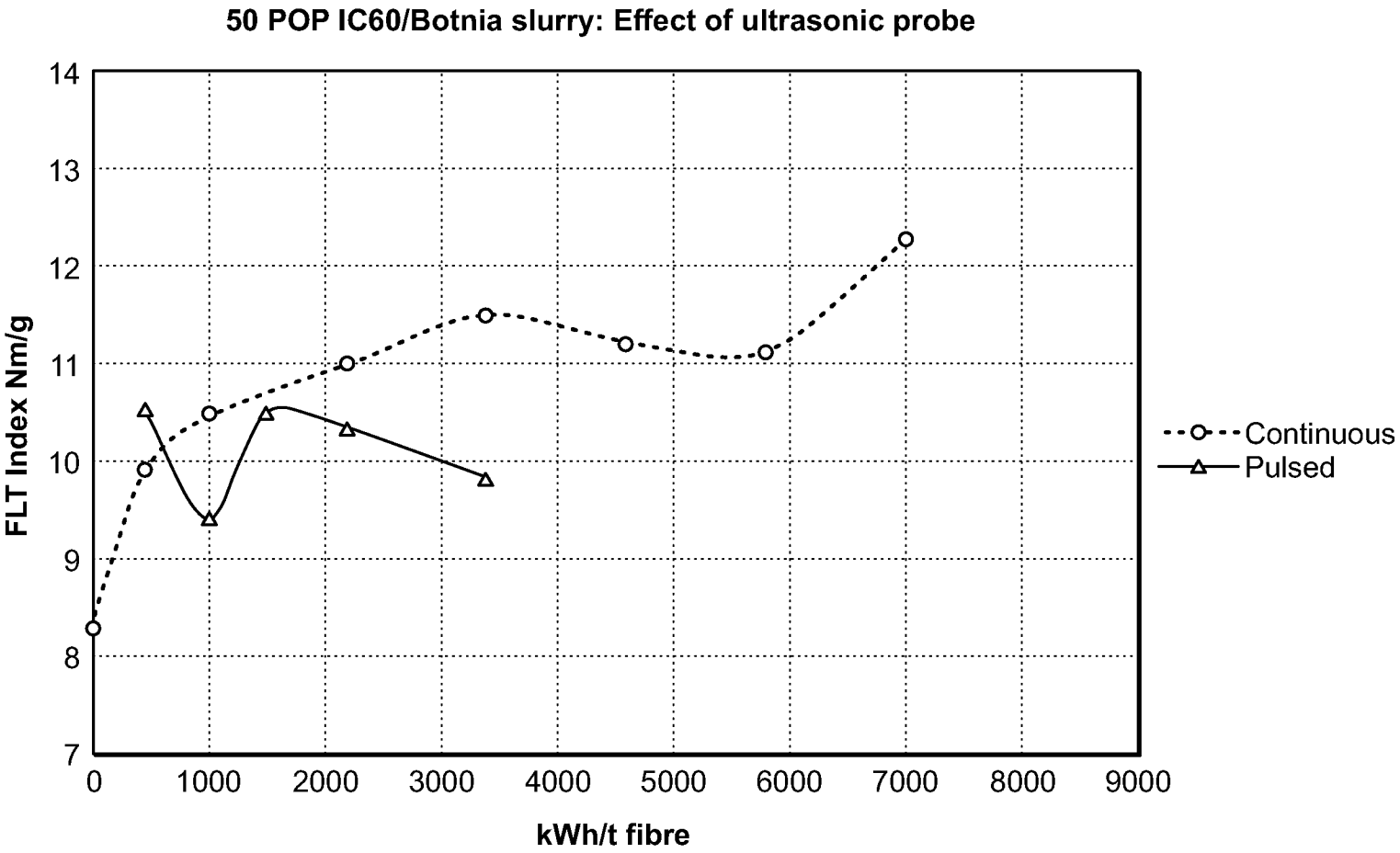
FIG. 5 shows the effect of exposure to pulsed ultrasound on MFC.

The ultrasonic probe can be operated in a continuous mode or pulsed mode. This experiment was to look at this effect. The FiberLean® MFC slurries were prepared as in Example 13, above and subjected to pulsed ultrasound. FIG. 5 shows that an increase in FLT Index can be made using the pulsed mode of operation. The use of the ultrasonic probe for the enhancement of the FiberLean® MFC in quality is recommended. The dramatic increase of the FiberLean® MFC slurry properties can be achieved preferably using a high Amplitude and run in a continuous mode.

Example 15

Figure 6:
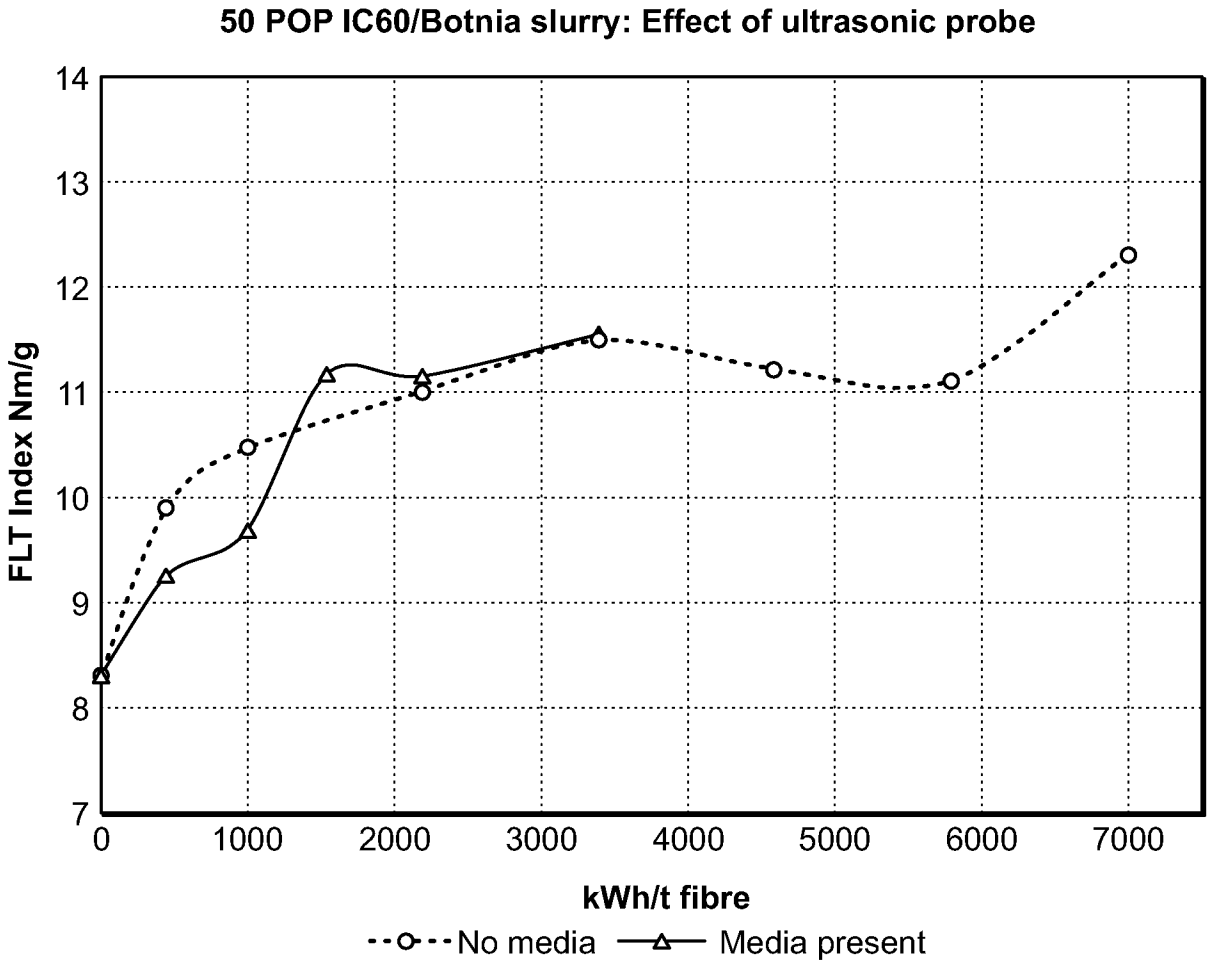
FIG. 6 shows the effect of ceramic media contamination on MFC exposed to ultrasonification.

The Effect of Ceramic Grinding Media on Ultrasound Efficiency within a FiberLean® MFC Slurry The production of a FiberLean® MFC product is achieved by the wet attrition milling of cellulose and mineral in the presence of a ceramic grinding media. This experiment was to investigate the effect of the ultrasonic process with some of the ceramic grinding media being present. Slurries of FiberLean® MFC as prepared in Example 13 and 14, above were doped with 10 ceramic grinding media beads (~3 mm size). The materials were subjected to various energy inputs at 100% Amplitude. FIG. 6 shows that the presence of the media in the sample has no detrimental effect on the increase in FLT Index. The presence of the ceramic grinding media has no effect on the ultrasonic processing of the FiberLean® MFC slurry under these conditions.

Example 16

The Effect of an Ultrasonic Probe on FiberLean® MFC 50% POP Belt Pressed Cake

Figure 7:
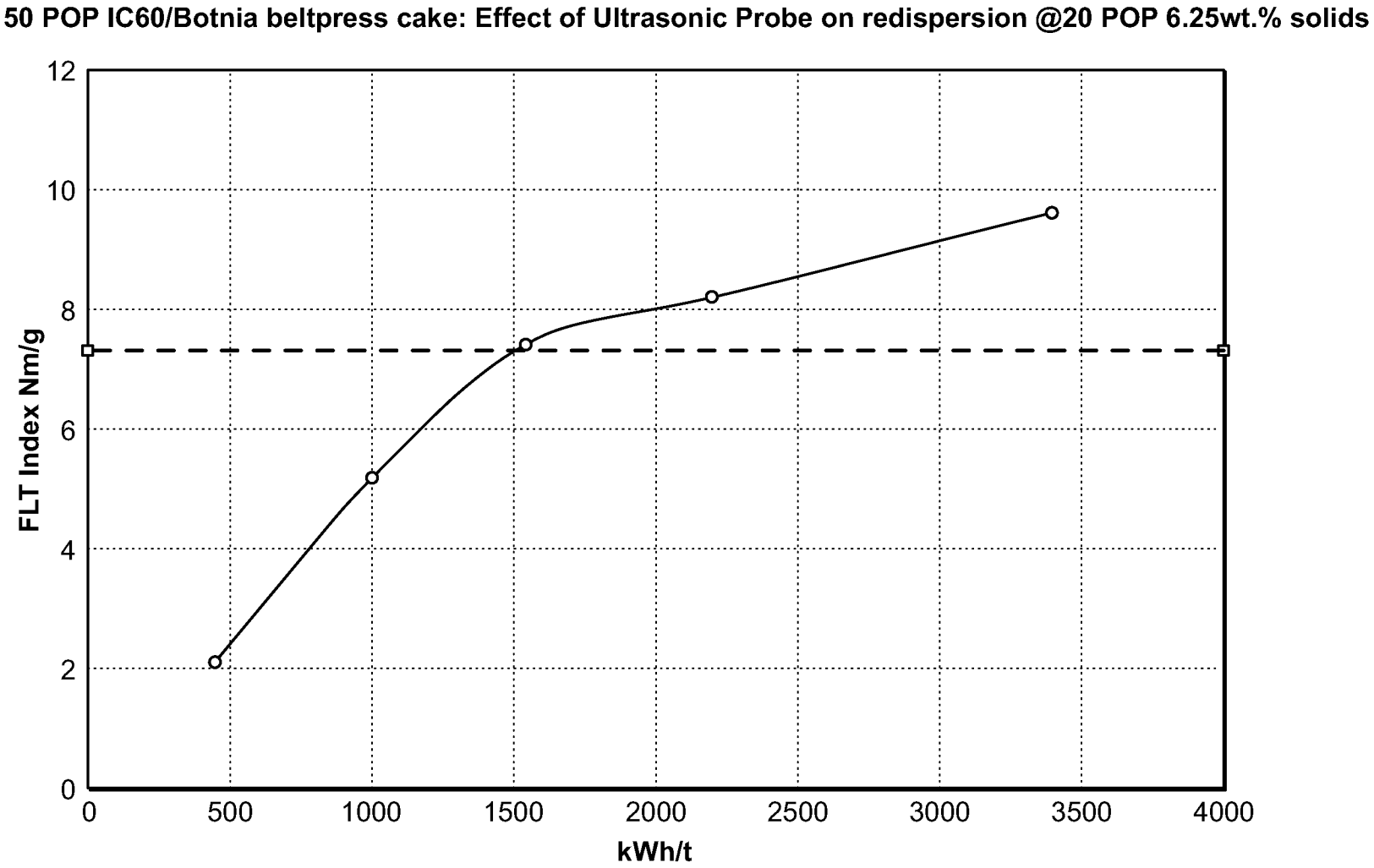
FIG. 7 shows the effect of ultrasonification on a 50% POP pressed cake.

A 50% POP IC60/Botnia belt press cake produced at Trebal was the feed material for this next study. The belt pressed cake was diluted to 20% POP, 6.25 wt. % solids using IC60 carbonate slurry. Samples were made and subjected to:

i) 1 minute of high shear mixing on the Silverson mixer: The control ii) Various times of ultrasound at 100% Amplitude FIG. 7 shows that the belt pressed cake can be re-dispersed in water using the ultrasonic probe and the control FLT Index can be achieved and surpassed.

Example 17

Figure 8:
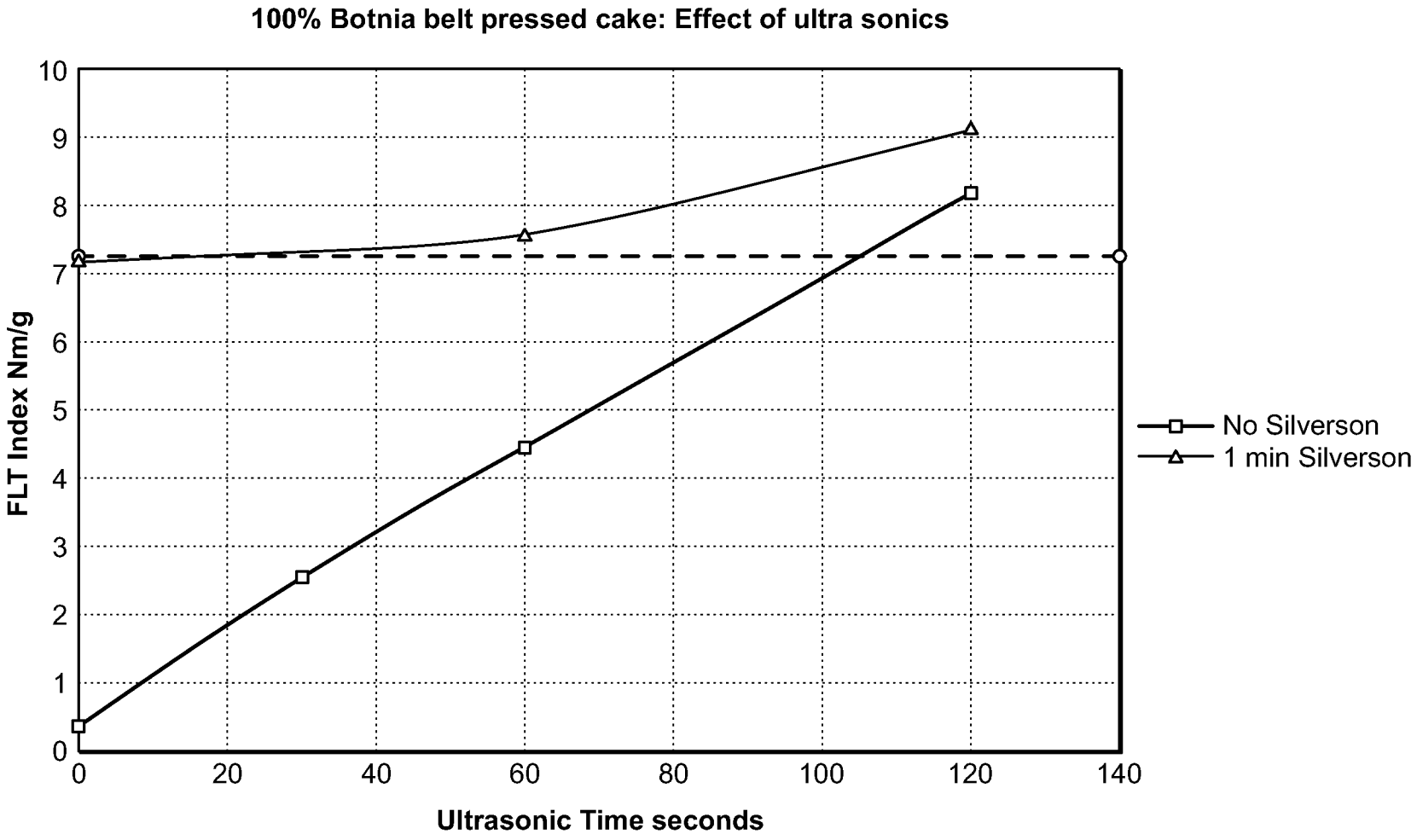
FIG. 8 shows the effect of high shear and ultrasonification on a mineral-free belt pressed cake.

The Effect of an Ultrasonic Probe on FiberLean® MFC Mineral Free Belt Pressed Cake To further explore the re-dispersion of a belt pressed cake, a mineral free version was evaluated. The belt pressed cake was diluted to 20% POP, 6.25 wt. % solids using IC60 carbonate slurry. Samples were made and subjected to:

i) 1 minute of high shear mixing on the Silverson mixer: The control ii) Various times of ultrasound at 100% Amplitude FIG. 8 highlights once again that ultrasonics alone can achieve the sample properties that are produced with high shear mixing. High shear mixing combined with ultrasonics can yield an improved tensile strength.

Example 17

The Effect of an Ultrasonic Probe on 60 wt. % a High Solids Dried FiberLean® MFC A development product that is produced by drying a belt pressed cake was evaluated with the use of ultrasonics. This 50% POP IC60/Botnia 60 wt. % solids material requires 3 to 4 minutes of high shear Silverson mixing to achieve a FLT index of 9 Nm/g.

Figure 9:
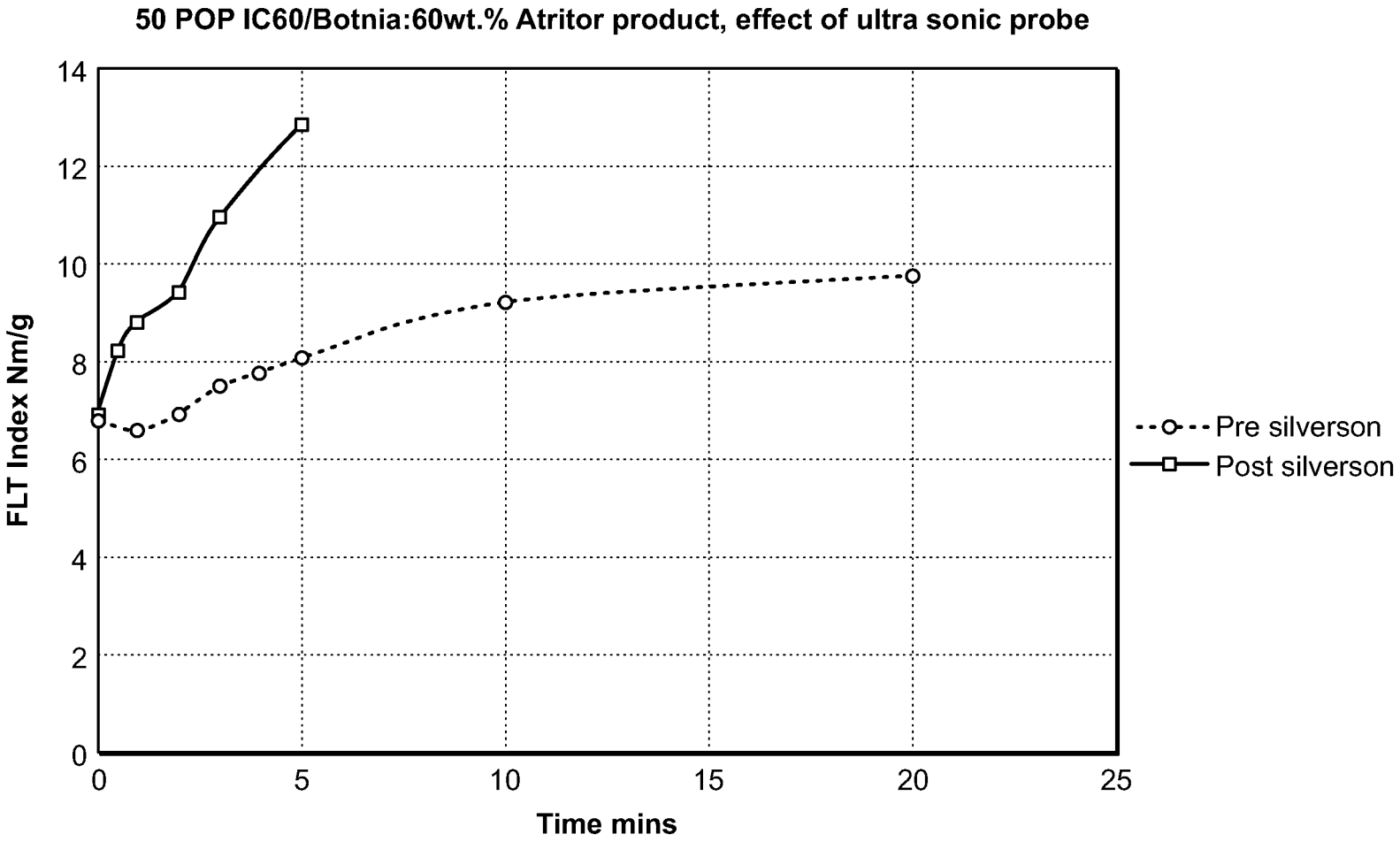
FIG. 9 shows the effect of ultrasonification on a high solids dry milled belt pressed cake.
Figure 10:
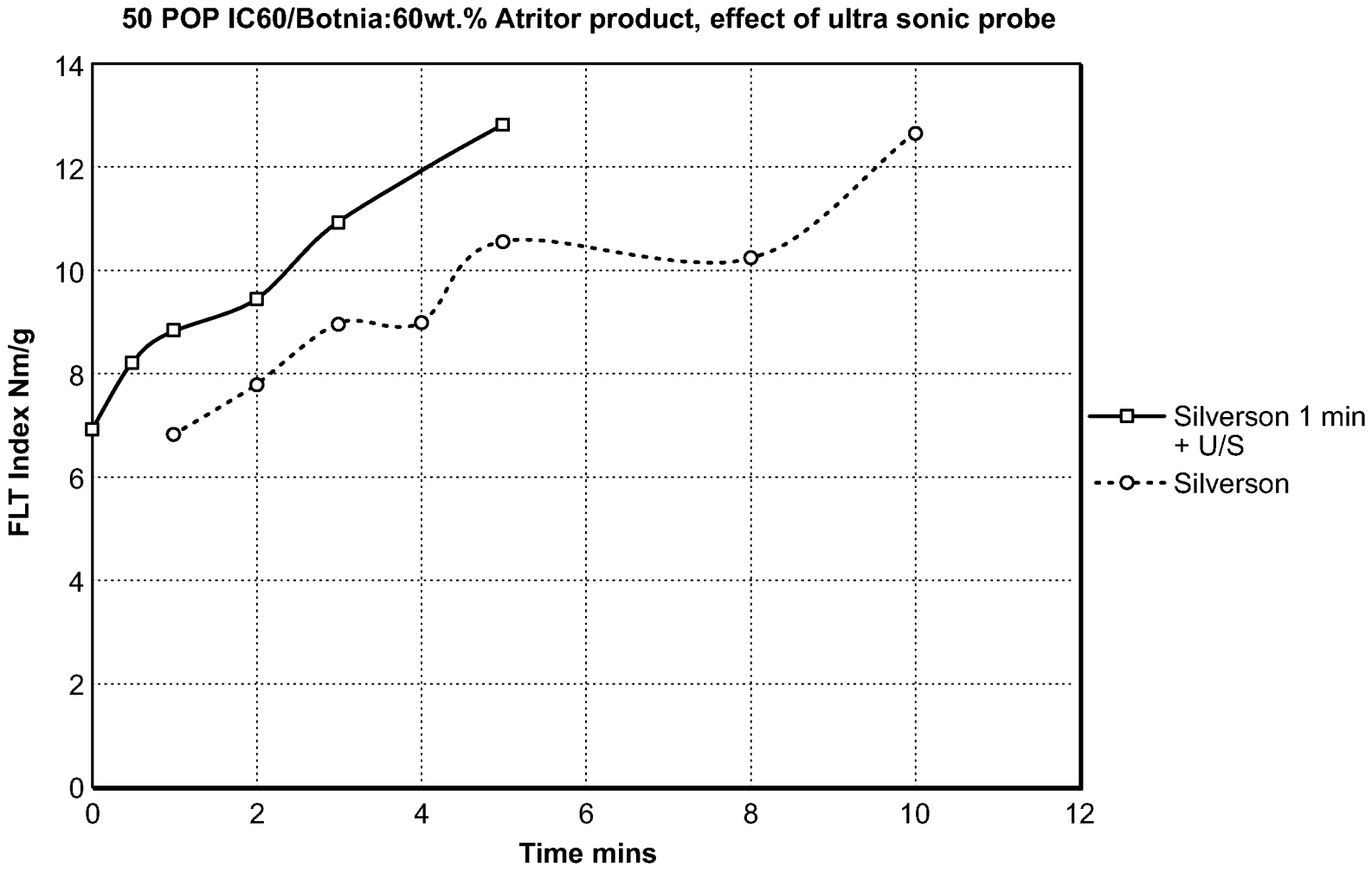
FIG. 10 shows the effect of ultrasonification on a high solids dry milled belt pressed cake.

This Study Explored i) The use of ultrasound as a pre cursor to high energy mixing ii) The use of ultrasound as an additional aid to improve FLT values FIG. 9 shows that the effects of the ultrasonic energy is more effective utilised post high shear mixing. FIG. 10 demonstrates the benefits of high shear mixing and ultrasonics combined. The use of ultrasonics is be an efficient way to re-disperse the dried FiberLean® MFC product either with or without the high shear mixing.

The results of Example 5-10 show at least the following unexpected results of adding ultrasonic processing to MFC production:

- A MFC slurry's properties (e.g., a FiberLean® MFC properties) can be substantially enhanced by ultrasonification if applied preferably by a probe or an ultrasonic water bath
- A higher Amplitude yields a higher FLT Index
- Ceramic contaminants within a MFC slurry (e.g., a FiberLean® MFC properties) has no detrimental effect upon the ability of the ultrasound to affect the slurry's properties beneficially
- A MFC belt press cake (e.g., a FiberLean® MFC press cake) is very amenable to ultrasonics as a way to re-disperse it
- Ultrasonics can either replace high shear re-dispersion or enhance the procedure
- Higher solid content materials can be re-dispersed using ultrasonics

The invention claimed is:

1. A method for preparing a fibre consisting of (a) microfibrillated cellulose and (b) one or more calcium carbonate and/or kaolin, the method comprising the steps of:

(1) preparing a composition consisting of microfibrillated cellulose and calcium carbonate and/or kaolin, wherein the microfibrillated cellulose has a fibre steepness ranging from about 20 to about 50; wherein the microfibrillated cellulose is obtained by a two-stage process of (i) grinding a fibrous substrate comprising cellulose in a grinding vessel in the presence of the calcium carbonate and/or kaolin and (ii) refining in a refiner or homogenizing in a homogenizer; or sonicating with an ultrasonic device the ground fibrous substrate comprising cellulose and the calcium carbonate and/or kaolin; wherein the grinding is carried out in an aqueous environment in the presence or in the absence of a grinding medium; wherein the term "grinding medium" means a medium other than the calcium carbonate and/or kaolin;

(2) extruding the microfibrillated cellulose and the calcium carbonate and/or kaolin from step (1) through an extruder;

(3) attenuating the extruded microfibrillated cellulose and the calcium carbonate and/or kaolin with an attenuating gas; and (4) collecting the extruded fibre.

2. The method of claim 1, wherein the microfibrillated cellulose has a median diameter ($d_{50}$) less than 100 μm.

3. The method of claim 1, wherein the attenuating gas is one or more streams of hot air.

4. The method of claim 1, wherein the ultrasonic device is selected from the group consisting of an ultrasonic probe, an ultrasonic water bath, an ultrasonic homogenizer, an ultrasonic foil and an ultrasonic horn.

5. The method of claim 1, wherein the grinding vessel is a screened grinder.

6. The method of claim 5, wherein the screened grinder is a stirred media detritor.

7. The method of claim 1, wherein the fibre is extruded at a temperature from about 80° C. to about 100° C.

8. The method of claim 1, wherein the fibre has an average diameter of from about 0.1 μm to about 1 mm.

9. The method of claim 1, wherein the fibre has an elastic modulus from about 5 GPa to about 20 GPa as determined by a tensiometer.

10. The method of claim 1, wherein the fibre has a fibre strength of about 40 MPa to about 200 MPa as determined by a tensiometer.

11. The method of claim 1, wherein the fibre is a spunlaid fibre.

12. The method of claim 11, wherein the spunlaid fibre is formed by spunbonding.

13. The method of claim 1, wherein the collecting step is deposition of the fibre onto a foraminous surface to form a non-woven web.

14. The method of claim 13, wherein the foraminous surface is a moving screen or wire.

15. The method of claim 13, wherein the non-woven web is bonded by hydro-entanglement.

16. The method of claim 13, wherein the non-woven web is bonded by through-air thermal bonding.

17. The method of claim 13, wherein the non-woven web is bonded mechanically.

18. The method of claim 1, wherein the grinding is carried out in an aqueous environment in the presence of the grinding medium.

19. The method of claim 1, wherein the grinding is carried out in an aqueous environment in the absence of the grinding medium.

* * * * *